US009241374B2

(12) United States Patent
Matsui et al.

(10) Patent No.: US 9,241,374 B2
(45) Date of Patent: Jan. 19, 2016

(54) INDUCTION COOKING APPLIANCE

(75) Inventors: Eiji Matsui, Osaka (JP); Akira Kataoka, Shiga (JP); Takehiko Shigeoka, Nara (NP); Takaaki Kusaka, Hyogo (JP); Kenji Ogawa, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 943 days.

(21) Appl. No.: 13/393,489

(22) PCT Filed: Mar. 14, 2011

(86) PCT No.: PCT/JP2011/001478
§ 371 (c)(1),
(2), (4) Date: Feb. 29, 2012

(87) PCT Pub. No.: WO2011/114693
PCT Pub. Date: Sep. 22, 2011

(65) Prior Publication Data

US 2012/0152933 A1 Jun. 21, 2012

(30) Foreign Application Priority Data

| | | |
|---|---|---|
| Mar. 17, 2010 | (JP) | 2010-060635 |
| Jun. 15, 2010 | (JP) | 2010-135779 |
| Jun. 16, 2010 | (JP) | 2010-136955 |
| Jun. 16, 2010 | (JP) | 2010-136958 |

(51) Int. Cl.
*H05B 6/12* (2006.01)
*F24C 15/20* (2006.01)

(52) U.S. Cl.
CPC ..... *H05B 6/1263* (2013.01); *H05B 2206/022* (2013.01)

(58) Field of Classification Search
CPC ..... H05B 6/1263; F24C 15/101
USPC ..... 219/623, 400, 452.12, 671, 632, 677, 219/620, 622, 660; 126/21 A, 299 D, 299 R, 126/300, 37 A, 39 K; 99/400, 446, 645, 480, 99/340
See application file for complete search history.

(56) References Cited

U.S. PATENT DOCUMENTS 4,665,893 A * 5/1987 Miyagawa et al. ..... 126/299 D
4,899,028 A 2/1990 Arai et al.

(Continued)

FOREIGN PATENT DOCUMENTS

CN 1737430 A 2/2006
CN 101617561 A 12/2009

(Continued)

OTHER PUBLICATIONS

Extended European Search Report in corresponding European Application No. 11755884.1, dated Oct. 8, 2014, 6 pages.

(Continued)

*Primary Examiner* — Quang Van
(74) *Attorney, Agent, or Firm* — Brinks Gilson & Lione

(57) ABSTRACT

To reduce the air exhausted to outside a main body after cooling a heat generating component from being taken in again from an intake port. The flow of cooling wind cooled the heat generating component is discharged from an exhaust port at other than a first peripheral wall with the flow bent inside the main body. When rectified inside the main body and discharged from the exhaust port, the cooling wind grows to a flow speed of a certain extent to become an exhaust air that a flowing direction is clearly defined, so that it is less likely to be taken in again from the intake port, it is less likely to be subjected to the influence of obstacles of the exhaust port, use can be made in a kitchen cabinet of the intake and exhaust air at the back side, and it is satisfactory and is less likely to be damaged without involving sense of unpleasantness by the exhaust air to the user.

20 Claims, 26 Drawing Sheets

(56) References Cited

U.S. PATENT DOCUMENTS

| | | | | |
|---|---|---|---|---|
| 7,135,661 | B2 * | 11/2006 | Park et al. | 219/623 |
| 8,426,781 | B2 * | 4/2013 | Kim et al. | 219/623 |
| 8,692,169 | B2 * | 4/2014 | Lin | 219/623 |
| 2006/0049177 | A1 | 3/2006 | Park et al. | |
| 2010/0187222 | A1 | 7/2010 | Kim et al. | |

FOREIGN PATENT DOCUMENTS

| | | | |
|---|---|---|---|
| CN | 101637063 | A | 1/2010 |
| DE | 199 35 835 | C2 | 2/2001 |
| EP | 1 628 506 | A2 | 2/2006 |
| FR | 2 635 852 | A1 | 3/1990 |
| JP | 59-118290 | U | 8/1984 |
| JP | 59-165691 | U | 11/1984 |
| JP | 61-149299 | U | 9/1986 |
| JP | 62-200283 | U | 12/1987 |
| JP | 64-002289 | A | 1/1989 |
| JP | 06-004502 | U | 1/1994 |
| JP | 3006175 | B2 | 11/1999 |
| JP | 2001-345168 | A | 12/2001 |
| JP | 2008-171720 | A | 7/2008 |
| JP | 2009-011400 | A | 1/2009 |
| JP | 5036731 | B2 | 9/2012 |

OTHER PUBLICATIONS

International Search Report for International Application No. PCT/JP2011/001478, dated Jun. 14, 2011, 4 pages.

International Preliminary Report on Patentability for International Application No. PCT/JP2011/001478, dated Oct. 23, 2012, 8 pages.

Office Action and Search Report, and partial English language translation thereof, in corresponding Chinese Application No. 201180003651.0, dated Jan. 14, 2015, 11 pages.

Office Action and Search Report, and partial English language translation thereof, in corresponding Chinese Application No. 201180003651.0, dated Jul. 24, 2015, 10 pages.

Office Action and Search Report, and partial English translation thereof, in corresponding Chinese Application No. 201180003651.0, dated May 6, 2014, 8 pages.

* cited by examiner

INDUCTION COOKING APPLIANCE

This application is a 371 application of PCT/JP2011/001478 having an international filing date of Mar. 14, 2011, which claims priority to JP2010-060635 filed Mar. 17, 2010, JP2010-135779 filed Jun. 15, 2010, JP2010-136955 filed Jun. 16, 2010, and JP2010-136958 filed Jun. 16, 2010, the entire contents of which are incorporated herein by reference.

TECHNICAL FIELD

The present invention relates to induction cooking appliances for inductively heating a cooking container such as a metal pan, which is an object to be heated, using a heating coil, and in particular, to a cooling structure in the induction cooking appliance.

BACKGROUND ART

In recent years, an induction cooking appliance is becoming commonplace in the kitchen of a general household as a safe and clean heat source that does not use fire and that does not discharge combustion gas. In the induction cooking appliance used in the kitchen, a built-in type induction cooking appliance in which a main body portion of the induction cooking appliance is fitted to an open portion formed at an upper surface of a box-shaped kitchen cabinet to arrange the main body portion of the induction cooking appliance inside the kitchen cabinet, and a cooking top plate configuring an upper surface of the induction cooking appliance is arranged so as to be exposed at the upper surface of the kitchen cabinet is known.

This type of induction cooking appliance is conventionally configured to include a heating coil for induction heating, an inverter circuit for supplying a high frequency current to the heating coil, a drive portion for driving the inverter circuit, a control portion for controlling the drive portion, and the like. Various electronic components are mounted on a substrate of the control circuit, or the like including the inverter circuit, the drive portion, and the control portion inside the main body portion of the induction cooking appliance.

In induction heating, the heating efficiency differs depending on the magnetic permeability and the resistivity by the material of the cooking container or the like, which is a to-be heated object. Therefore, in the induction cooking appliance, the heat loss increases under a condition of relatively low heat efficiency, and the heat generation of the component such as the heating coil increases by that much.

An electronic component having a very large amount of heat generation at the time of the operation such as an IGBT or a diode bridge, and an electronic component such as a capacitor having a relatively small amount of heat generation coexist in the electronic components on the substrate of the control circuit. A heat sink is attached to the electronic component having a large amount of heat generation to enhance the cooling effect on the electronic component. The heating coil and the electronic component can operate normally by being cooled by a cooling wind from a blower device.

The conventional built-in type induction cooking appliance is used by being incorporated in the kitchen cabinet, and thus an intake port and an exhaust port of the induction cooking appliance are arranged in an internal space of the kitchen cabinet (for example, refer to Patent Literature 1).

If the intake port and the exhaust port are both arranged in a closed space or the internal space of the kitchen cabinet, the exhaust heat after cooling the heating coil and the electronic component may accumulate inside the kitchen cabinet thus raising the temperature of the internal space of the kitchen cabinet. If the temperature-raised exhaust air is again taken in, in the internal space of the kitchen cabinet, the intake air temperature of the induction cooking appliance may rise and the heating coil and the electronic component arranged inside the main body portion of the induction cooking appliance may not be sufficiently cooled.

In the conventional built-in type induction cooking appliance, the following configuration is proposed to avoid the heating coil and the electronic component from not being sufficiently cooled.

FIG. 26 is a plan view showing an internal configuration of a conventional built-in type induction cooking appliance described in Patent Literature 1. As shown in FIG. 26, an intake port 55 and an exhaust port 57 of a kitchen cabinet 50 are arranged by forming a large open portion on a near side (side on which user exists) of the kitchen cabinet 50. An intake port 54 of an induction cooking appliance 51 arranged inside the kitchen cabinet 50 is formed facing a cooling fan 53 for cooling a heating coil etc. 52, and the like, and is arranged on a near side of a bottom surface of the induction cooking appliance 53. Exhaust ports 58, 59 of the induction cooking appliance 51, on the other hand, are arranged on a rear surface side (back side of induction cooking appliance 51), and a side surface side (right side surface side of induction cooking appliance 51). The exhaust port 59 on the rear surface side and the exhaust port 58 on the side surface side are arranged on a right side region of the two regions divided by a center axis extending in a front and back direction of the induction cooking appliance shown in FIG. 26, and are arranged in a region on an opposite side of a left side region in which the intake port 54 of the induction cooking appliance 51 is formed.

In the conventional induction cooking appliance shown in FIG. 26, the cooling wind from the intake port 55 formed in the left side region of the kitchen cabinet 50 is taken in from the intake port 54 in the left side region of the induction cooking appliance 51, and exhausted from the exhaust ports 58, 59 of the induction cooking appliance 51 in the right side region through the exhaust port 57 of the kitchen cabinet 50. In this case, a separation plate 56 arranged along the center axis extending in the front and back direction of the induction cooking appliance 51 is provided to separate the intake air and the exhaust air inside the kitchen cabinet.

Patent Literature 1: Gazette of Japanese Patent No. 3006175

SUMMARY OF THE INVENTION

Technical Problem

However, with the configuration of the conventional induction cooking appliance 51, if the induction cooking appliance 51 is incorporated in the kitchen cabinet 50, incorporated in another device, or even if not incorporated, obstacles to the exhaust air such as the inner wall surface of the kitchen cabinet 50, the wall surface of another device, or a wall surface of a cooking place exist at the position facing the exhaust ports 58, 59 of the induction cooking appliance 51 due to the installing situation and the like of the induction cooking appliance 51.

If the exhaust port 57 of the kitchen cabinet 50 is arranged on the near side in the induction cooking appliance 51, the user himself/herself may become an obstacle of the exhaust air depending on the position the user is standing.

In the conventional induction cooking appliance 51, the cooling wind taken in from the intake port 54 formed on the near side of the left side region in the induction cooking appliance 51 cools the heating coil 52 and the electronic components, and then exhausted from the exhaust ports 58, 59 formed on the rear surface side and the side surface side of the right side region. The cooling wind discharged from the exhaust ports 58, 59 opened on the rear surface side and the side surface side of the induction cooking appliance 51 makes contact with the inner wall surface of the kitchen cabinet 50, and the like, which is an obstacle arranged facing the exhaust ports 58, 59, so that the flow stagnates and the flow speed lowers thus diffusing to four side of the internal space of the kitchen cabinet 50.

In the conventional induction cooking appliance, the intake port 55 and the exhaust port 57 of the kitchen cabinet 50 are separated by providing the separation plate 56. If the separation plate 56 for separating the intake port 55 and the exhaust port 57 of the kitchen cabinet 50 is not provided, the following problems arise. As the intake port 54 of the induction cooking appliance is configured to taken in the internal air of the kitchen cabinet 50 in a perpendicular direction from the back surface, the intake port 54 of the induction cooking appliance takes in not only the cold air from the outside flowing in from the intake port 55 of the kitchen cabinet 50 but also again takes in one part of the exhaust air discharged from the exhaust ports 58, 59 of the induction cooking appliance. As a result, the induction cooking appliance configured as above has a problem in that the temperature of the intake air rises.

Furthermore, the conventional induction cooking appliance has the following problem even if the separation plate 56 for separating the intake port 55 and the exhaust port 57 is arranged. The height of the internal space of the kitchen cabinet 50 for installing the induction cooking appliance differs for each kitchen cabinet 50. Thus, when attempting to completely prevent one part of air exhausted from the induction cooking appliance from being taken in again, a dedicated special separation plate 56 corresponding to each kitchen cabinet 50 needs to be arranged. When attempting to respond to all the kitchen cabinets 50 with one type of separation plate, a gap forms between the kitchen cabinet 50 and the induction cooking appliance, and thus the intake port 55 and the exhaust port 57 cannot be completely separated and it becomes difficult to commonly use the separation plate 56.

It is an object of the present invention to solve the problems of the conventional induction cooking appliance and to provide an induction cooking appliance having a configuration in which the air discharged from the exhaust port is less likely to be taken in again from the intake port and the temperature rise of the cooling wind can be suppressed even if an obstacle exists facing the exhaust port of the induction cooking appliance when incorporated in the kitchen cabinet, when installed near another device, and the like.

Solution to Problem

An induction cooking appliance according to a first aspect of the present invention comprises:

a heating coil which is arranged below a top plate for mounting a to-be-heated object so as to inductively heat the to-be-heated object;

a control circuit, including a heat generating component, for generating and controlling a high frequency current to supply to the heating coil;

a blower device for taking in a cooling wind from an intake port, blowing the cooling wind to the control circuit, and discharging the cooling wind from an exhaust port; and a main case, which configures an outer appearance with the top plate, in which the heating coil, the control circuit, and the blower device are arranged; wherein the main case includes a first side surface wall arranged to face a flow of the cooling wind sent from the intake port to the control circuit; and the induction cooking appliance is configured that in the main case, after the cooling wind taken in from the intake port formed at a portion other than the first side surface wall cools the control circuit, the cooling wing be flowed along the first side surface wall, and then the cooling wind be exhausted from the exhaust port formed at a portion other than the first side surface wall.

According to the induction cooking appliance of a second aspect of the present invention, in the first aspect, the main case may include a second side surface wall continuing to the first side surface wall; and the cooling wind flowed along the first side surface wall may be flowed along the second side surface wall to be discharged from the exhaust port so that a discharging direction of the cooling wind from the exhaust port is the opposite direction of a flowing direction of the cooling wind for cooling the control circuit.

According to the induction cooking appliance of a third aspect of the present invention, in the first aspect, the main case may be configured by a plurality of side surface walls and a bottom surface plate, the exhaust port being formed in a second side surface wall continuing to the first side surface wall through a bent portion, and the intake port being formed in the bottom surface plate.

According to the induction cooking appliance of a fourth aspect of the present invention, a sub-case having an upper side opened may be accommodated in an internal space of the main case of the first aspect, the control circuit and the blower device being arranged inside the sub-case; and a first exhaust flow path may be formed between the first side surface wall and a side surface wall of the sub-case facing the first side surface wall, and is formed inside the internal space so that the cooling wind after cooling the control circuit contacts the side surface wall and flows in a constant direction through the first exhaust flow path.

According to the induction cooking appliance of a fifth aspect of the present invention, a second exhaust flow path, communicating with the first exhaust flow path, for flowing the cooling wind flowed through the first exhaust flow in an orthogonal direction so as to discharge from the exhaust port may be formed in an internal space of the main case of the first aspect.

According to the induction cooking appliance of a sixth aspect of the present invention, an operation portion may be arranged on a front surface side in the internal space of the main case of the fourth aspect; and the first exhaust flow path may be arranged on a lower side of the operation portion.

According to the induction cooking appliance of a seventh aspect of the present invention, a coil base for holding the heating coil and a radiator plate for mounting the coil base are arranged above the sub-case in the internal space of the main case of the fourth aspect, where one part of an upper surface in a flow path, through which the cooling wind from the blower device passes to cool the control circuit, may be configured by the radiator plate.

According to the induction cooking appliance of an eighth aspect of the present invention, in the fourth aspect, a flow path guiding plate having a surface inclined in a flowing direction of the cooling wind for cooling the control circuit may be arranged at an opening of the sub-case so that the cooling wind flows along the first exhaust flow path when the cooling wind after cooling the control circuit passes through an opening formed in a side surface wall of the sub-case to flow in the first exhaust flow path.

According to the induction cooking appliance of a ninth aspect of the present invention, in the internal space of the main case of the fourth aspect, the exhaust port may be formed at a position symmetric with respect to a center line in which a center axis is a front and back direction, one part of the cooling wind guided to the first exhaust flow path after cooling the control circuit may be discharged from one exhaust port, and the remaining cooling wind may be discharged from the other exhaust port.

According to the induction cooking appliance of a tenth aspect of the present invention, the main case of the ninth aspect may include a second side surface wall and a third side surface wall continuing to the first side surface wall through a bent portion; and the cooling wind flowed along the first exhaust flow path configured by the first side surface wall may be flowed along a second exhaust flow path configured by the second side surface wall and a third exhaust flow path configured by the third side surface wall to be exhausted from a first exhaust port communicating to the second exhaust flow path and a second exhaust port communicating to the third exhaust flow path.

According to the induction cooking appliance of an eleventh aspect of the present invention, the first side surface wall of the first aspect may include a vent hole, so that one part of the cooling wind after cooling the control circuit is discharged from the vent hole.

According to the induction cooking appliance of a twelfth aspect of the present invention, in the first aspect, an induction heating block including the heating coil, the control circuit, and the blower device may be arranged in plurals below the top plate;

a flowing direction of a cooling wind for controlling the respective control circuit may be the same in the respective induction heating block, and the induction heating blocks may be arranged side by side inside the main case so that the cooling wind after cooling the respective control circuit contacts the first side surface wall; and the cooling wind which contacts the first side surface wall may be flowed along the first side surface wall so as to be exhausted from the exhaust port.

According to the induction cooking appliance of a thirteenth aspect of the present invention, in the twelfth aspect, the main case may include a second side surface wall continuing to the first side surface wall such that a discharging direction of the cooling wind from the exhaust port flows in a direction of regressing a flowing direction of the cooling wind for cooling the control circuit in the respective induction heating block, and the cooling wind flowed along the first side surface wall may be flowed in a constant direction along the second side surface wall.

According to the induction cooking appliance of a fourteenth aspect of the present invention, each of the induction heating block is accommodated in a plurality of sub-cases having the upper side opened in an internal space of the main case of the thirteenth aspect;

a flowing direction of the cooling wind flowing along the first side surface wall is parallel to an arranged direction of the plurality of sub-cases arranged side by side; and a flowing direction of the cooling wind flowing along the second side surface wall is orthogonal to the arranged direction of the plurality of sub-cases arranged side by side.

According to the induction cooking appliance of a fifteenth aspect of the present invention, in the twelfth aspect, the cooling wind flowed along the first side surface wall may flow through an exhaust flow path formed in a space between the plurality of induction heating blocks arranged side by side so as to be discharged from the exhaust port.

According to the induction cooking appliance of a sixteenth aspect of the present invention, the cooling wind flowed along the first side surface wall of the twelfth aspect is flowed through an exhaust flow path formed in both spaces between the induction heating blocks on both sides of the plurality of induction heating blocks arranged side by side and the main case so as to be discharged from two exhaust ports.

According to the induction cooking appliance of a seventeenth aspect of the present invention, an exhaust port may be formed at a position symmetric with respect to a center line in which a center axis is a front and back direction in the internal space of the main case of the sixteenth aspect, an internal configuration of the induction heating block in the respective sub-case being arranged to be symmetric with respect to the center line.

According to the induction cooking appliance of an eighteenth aspect of the present invention, in the main case of the twelfth aspect, the exhaust flow path through which the cooling wind discharged from the respective induction heating block is divided by a partition plate, and the cooling wind discharged from the respective induction heating block is flowed through an individual exhaust flow path so as to be discharged from a respective exhaust port.

According to the induction cooking appliance of a nineteenth aspect of the present invention, a flowing direction of the cooling wind in the first exhaust flow path of the twelfth aspect may be a direction from a front surface side to a rear surface side in the main case.

According to the induction cooking appliance of a twentieth aspect of the present invention may be configured such that the heat generating component is arranged in a flowing direction of the cooling wind from the blower device of the first aspect, and the exhaust flow path of the cooling wind after cooling the heat generating component is the same direction as a flowing direction of the cooling wind from the blower device.

Advantageous Effects of the Invention

The induction cooking appliance of the present invention realizes a highly reliable cooling configuration in which the air discharged from the exhaust port and taken in again from the intake is reduced and the temperature rise of the cooling wind is reliably suppressed even if an obstacle exists facing the exhaust port of the induction cooking appliance when incorporated in the kitchen cabinet, installed near another device, or the like.

DETAILED DESCRIPTION OF THE PREFERRED EMBODIMENTS

An induction cooking appliance will be described with reference to the accompanying drawings as an embodiment according to the present invention. The induction cooking appliance of the present invention is not limited to the configuration described in the following embodiments, and also encompasses the induction cooking appliance and the induction heating device configured based on the technical concept equivalent to the technical concept described in the following embodiments and the technical common knowledge in the technical field.

First Embodiment

Figure 1:
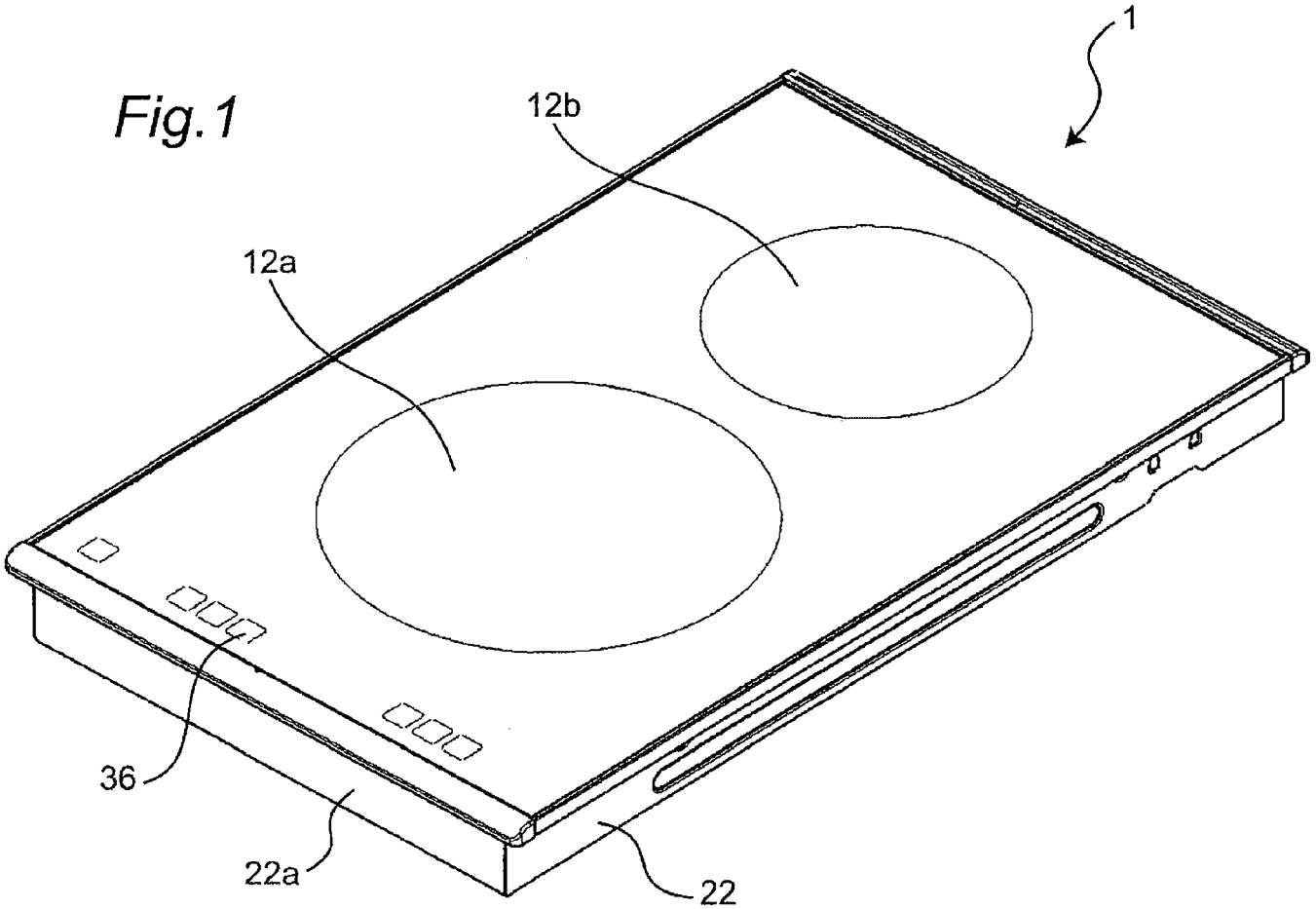
FIG. 1 is a perspective view showing an entire induction cooking appliance of a first embodiment according to the present invention.
Figure 2:
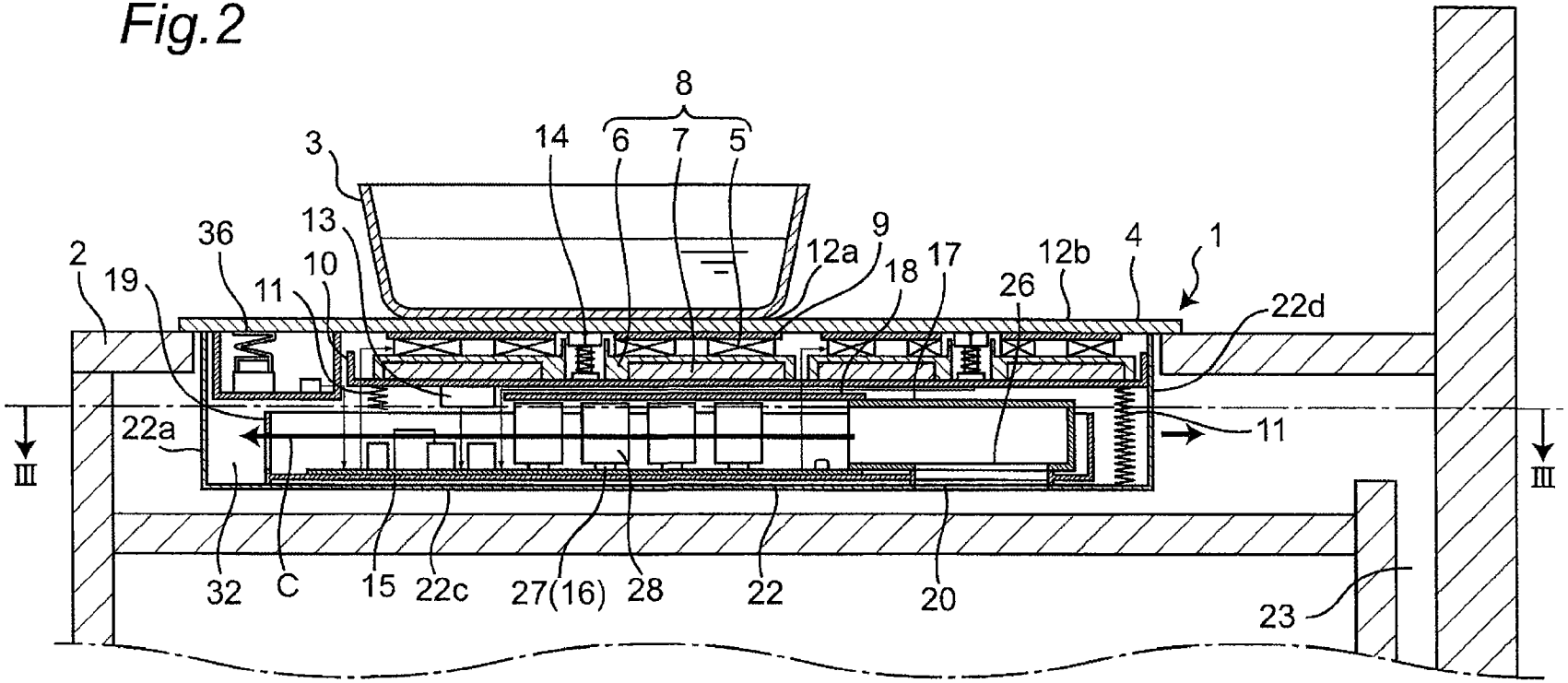
FIG. 2 is a cross-sectional view showing an installed state in which the induction cooking appliance of the first embodiment according to the present invention is incorporated in a kitchen cabinet.
Figure 3:
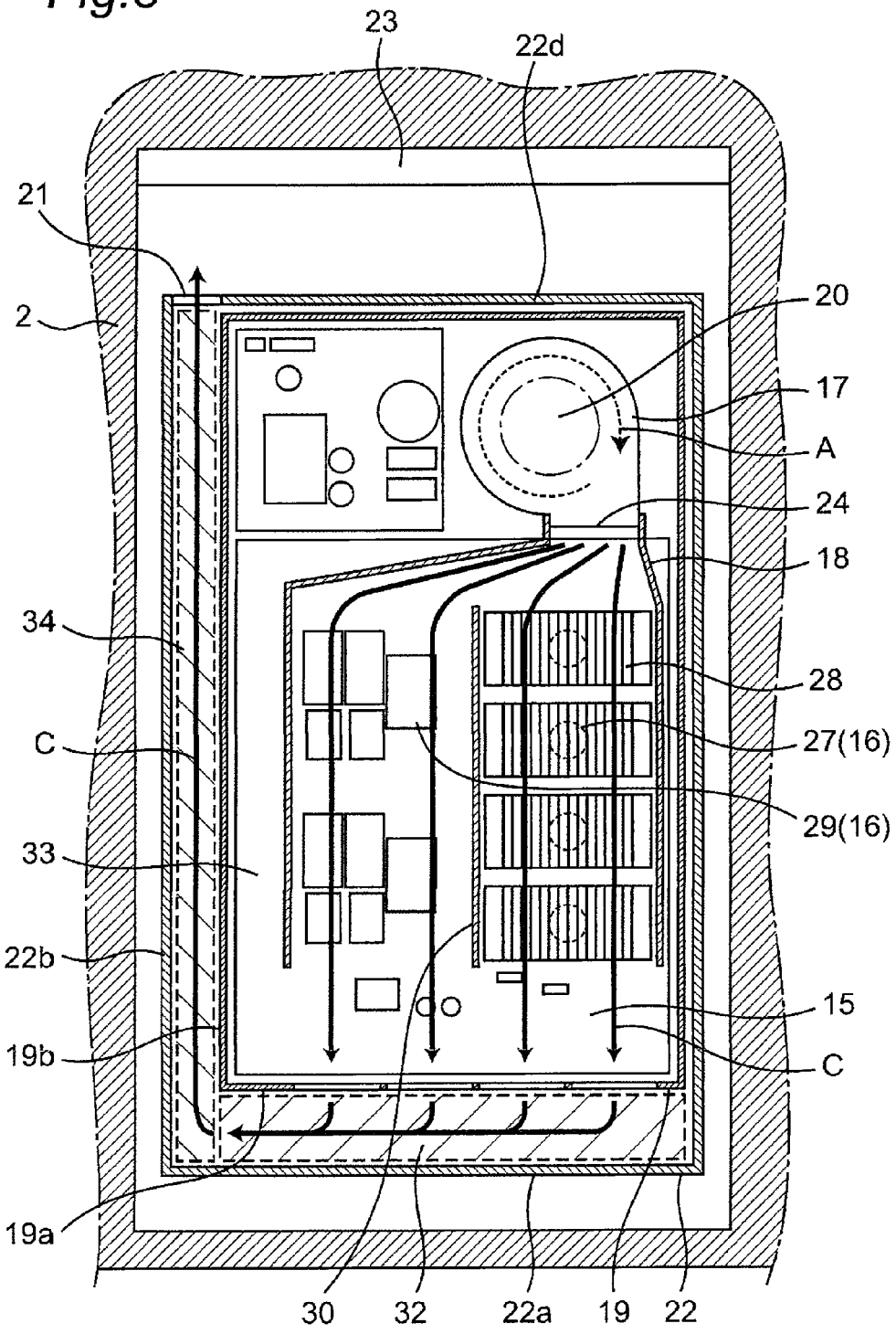
FIG. 3 is a horizontal cross-sectional view showing the induction cooking appliance of the first embodiment according to the present invention.

FIG. 1 is a perspective view showing an entire induction cooking appliance according to a first embodiment of the present invention. FIG. 2 is a cross-sectional view showing an installed state in which the induction cooking appliance of the first embodiment according to the present invention is incorporated in a kitchen cabinet. FIG. 3 is a horizontal cross-sectional view of the induction cooking appliance of the first embodiment according to the present invention, and is a cross-sectional view taken along line III-III of FIG. 2.

In FIG. 1, a top plate 4 for placing a cooking container 3 and the like, which is an object to be heated, is arranged on an upper surface of an induction cooking appliance 1. The top plate 4 of the first embodiment is formed with two heating regions 12*a*, 12*b*. In the induction cooking appliance 1, heating coils 5 (refer to FIG. 2) for inductively heating the cooking container 3, and the like are arranged immediately below each heating region 12*a*, 12*b* of the top plate 4.

A coil base 6 made of heat resistive resin is arranged below the heating coil 5. A ferrite 7 having magnetic album is included in a plurality of through-holes radially provided in the coil base 6, so that the magnetic flux from the heating coil 5 towards the lower side is suppressed by the ferrite 7.

In the first embodiment, a lower surface of the coil base 6 and a lower surface of the ferrite 7 are in the same plane when the ferrite 7 is included in the coil base 6. The ferrite 7 is fixed to the coil base 6 with an adhesive.

A mica plate (not shown) serving as an insulating member is sandwiched between the heating coil 5 and the ferrite 7, as well as between the heating coil 5 and the coil base 6. An adhesive (not shown) also serving as a heat conducting member is applied on both sides of the region facing the heating coil 5 in the mica plate. The heating coil 5 and the mica plate, the mica plate and the ferrite 7, as well as the mica plate and the coil base 6 are respectively adhered and are in a thermally coupled state.

Since the adhesive is used, as described above, the bumps caused by a plurality of wires in the heating coil 5, and the variation in the dimension of the thickness of the ferrite 7 can be absorbed. The coil base 6 and the ferrite 7 can be closely attached without a gap to a radiator plate 10, to be described later, since they are integrated by the adhesive with the lower surface of the coil base 6 and the lower surface of the ferrite 7 held in the same plane.

In the first embodiment, the heating coil 5 and the mica plate, the mica plate and the ferrite 7, as well as the mica plate and the coil base 6 are coupled by the adhesive used to couple the coil base 6 and the ferrite 7. The adhesive having a function serving as the heat conducting member is used.

The shape and the volume of the adhering portion to where the adhesive is to be applied may be set to adjust the amount of adhesive to apply to the adhesive portion so that the coil base 6 and the ferrite 7 can be simultaneously adhered when adhering the mica plate and the ferrite 7. A plurality of members can be adhered all at once by setting the shape and volume of the adhering portion and adjusting the usage amount of the adhesive, and hence the assembly property can be enhanced.

A plurality of openings (not shown) is formed in one part of the region facing both the heating coil 5 and the coil base 6 in the mica plate. The heating coil 5 and the coil base 6 are directly adhered and fixed with the mica plate in between by filling the adhesive in such openings.

As described above, in the first embodiment, the heating coil 5 and the coil base 6 are directly fixed with the mica plate, which can be easily stripped and whose mechanical strength is relatively poor, in between, and at the same time, the coil baser 6 and the ferrite 7 are adhered and fixed. Thus, a coil unit 8 configured to include the heating coil 5, the coil base 6, the ferrite 7, and the mica plate has an enhanced mechanical strength overall, and a structure that is strong with respect to vibration, dropping, and the like during the transportation.

With the use of the mica plate for the insulating member, the distance between the heating coil 5 and the ferrite 7 can be reduced while ensuring a reliable insulating state. As a result, the coil unit 8 can be thinned. Furthermore, if an abnormal heat generation occurs in the heating coil 5, rapid heat conduction to other components can be prevented thus suppressing the temperature rise of the other components.

Moreover, a heat insulating material 9 made of ceramic fiber and the like is arranged between the heating coil 5 and the top plate 4 to alleviate the thermal influence from the heated cooking container 3 to the heating coil 5.

The coil unit 8 is directly placed on the radiator plate 10 made of metal having high heat conductivity such as aluminum. As previously described, the lower surfaces of both the coil base 6 and the ferrite 7 are in the same plane, and thus the lower surfaces of both the coil base 6 and the ferrite 7 are entirely in contact with the radiator plate 10 to become an integrated configuration. A heat generated in the heating coil 5 is consequently transmitted to the radiator plate 10 mainly through the ferrite 7 having relatively high heat conductivity.

A plate-like radiator plate 10 for mounting the coil unit 8 is formed to be wider than a vertical projection area of the heating coil 5, and is pushed upward by a plurality of springs 11. The heating coil 4 is pushed against the back surface (lower surface) of the top plate 4 through the heat insulating material 9 by pushing the radiator plate 10 upward with the spring 11.

However, the space between the heating coil 5 and the top plate 4 is set to a predetermined dimension so as to become a constant distance by a spacer (not shown) arranged on the coil base 6.

In the radiator plate 10, the current that circles the heating coil 5 flows to the outer peripheral region on the outer side than the coil base 6 by the influence of the magnetic field generated by the heating coil 5. The magnetic field excited by the current flowing to the outer peripheral region of the radiator plate 10 acts in the direction opposite to the direction of the magnetic field generated by the heating coil 5. As a result, the magnetic field in the outer side direction from the outer periphery of the heating coil 5 is reduced by the current of the radiator plate 10 flowing to the outer peripheral region on the outer side than the coil base 6.

Therefore, in the induction cooking appliance 1 of the first embodiment, the magnetic field that leaks to the outer side direction of the heating coil 5 without being used to inductively heat the cooking container 3, which is an object to be heated, placed on the heating regions 12*a*, 12*b* of the top plate 4 is reduced.

The induction cooking appliance 1 of the first embodiment has a first coil unit on the near side (left side in FIG. 2) and a second coil unit on the rear surface side (right side in FIG. 2) arranged on the common radiator plate 10 in correspondence with the two heating regions 12 formed in the front and back regions of the top plate 4.

Therefore, in the induction cooking appliance 1 of the first embodiment, the surface area of the radiator plate 10 obviously becomes wider than the radiator plate in which only one coil unit is arranged, and thus the cooling performance of the radiator plate 10 becomes higher. Furthermore, as two coil units commonly use one radiator plate 10, a supporting member for holding the coil unit 8 at a predetermined position through the radiator plate 10 can be eliminated, and the assembly property can be greatly enhanced. Furthermore, space can be saved in the induction cooking appliance 1 in the configuration of the first embodiment.

In the induction cooking appliance 1 of the first embodiment, an infrared sensor 13 is arranged below the heating region 12*a* on the near side in the top plate 4. The infrared sensor 13 is arranged at a position that becomes under the bottom surface of the cooking container 3 to be placed on the heating region 12*a*. The infrared sensor 13 detects the infrared light radiated from the bottom surface of the cooking container 3 through the top plate 4, and outputs a temperature detection signal corresponding to the temperature of the bottom surface of the cooking container 3.

In the induction cooking appliance 1 of the first embodiment, a thermistor 14 is arranged so as to be pushed against the back surface of the top plate 4, facing substantially the central portion of the bottom surface of the cooking container 3 placed on the heating regions 12*a*, 12*b* on the near side and the rear surface side, respectively. The temperature of the top plate 4 facing the bottom surface of each cooking container 3 is detected by the thermistor 14, and the temperature detection signal corresponding to the detected temperature is output.

A control circuit 15 for carrying out an output control of the heating coil 5, and the like based on a signal such as the temperature detection signal output from the infrared sensor 13 and the thermistor 14, and an output setting signal set at an operation portion 36 by the user is arranged near the infrared sensor 13 and the thermistor 14 inside the induction cooking appliance 1 of the first embodiment. The control circuit 15 is configured to include an inverter circuit for supplying a high frequency current to the heating coil, a drive portion for driving the inverter circuit, a control portion for controlling the drive portion, and the like.

As shown in FIG. 3, the control circuit 15 inside the induction cooking appliance includes a heat generating component 16 such as a switching element 27 and a resonance capacitor 28. A blower device 17 for cooling the heat generating component 16, and a duct 18 for guiding the cooling wind C from the blower device 17 to the heat generating component 16 of the control circuit 15 is arranged inside the induction cooking appliance. The blower device 17 and the duct 18 are accommodated inside a box-shaped resin sub-case 19 having the upper side opened.

In the induction cooking appliance 1 of the first embodiment, a sirocco fan is adopted for the blower device 17. The rotating direction of the sirocco fan is the clockwise direction when seen from the vertically upward direction, as shown with an arrow A in FIG. 3.

As shown in FIG. 2, the infrared sensor 13 and the control circuit 15 are arranged on the lower side than the arranged position of the ferrite 7 inside the induction cooking appliance 1. With the arrangement of the infrared sensor 13 and the control circuit 15 in such manner, the influence of the magnetic flux is alleviated by the magnetism preventing effect of the ferrite 7. Furthermore, the infrared sensor 13 and the control circuit 15 are arranged so as to be on the lower side than the radiator plate 10 to eliminate the influence of magnetic flux leakage. The internal space of the induction cooking appliance 1 is partitioned to an upper space in which the heating coil 5 and the like are arranged and a lower space in which the infrared sensor 13, the control circuit 15, the duct 18 and the like are arranged by the radiator plate 10 as the infrared sensor 13 and the control circuit 15 are arranged on the lower side of the radiator plate 10 wider than the projection area of the heating coil 5. Therefore, the internal space of the induction cooking appliance 1 is partitioned by the radiator plate 10 wider than the projection area of the heating coil 5, so that the influence of the magnetic flux of the heating coil 5 in the upper space is greatly alleviated in the lower space.

The internal space in the induction cooking appliance 1 of the first embodiment is formed by the top plate 4, which becomes the upper surface, and a resin main case 22, which is arranged below the top plate 4 and is configured by a side surface wall on four sides and a bottom surface plate.

An intake port 20 and an exhaust port 21 for taking in air and exhausting air with respect to the internal space in the induction cooking appliance 1 are formed on the rear surface side (upper side in FIG. 3) of the main case 22. The intake port 20 and the exhaust port 21 of the main case 22 are opened to the internal space of the kitchen cabinet 2. An elongate air vent 23 is formed along the rear surface side in the internal space of the kitchen cabinet 2. Therefore, the intake port 20 and the exhaust port 21 of the main case 22 are formed in the vicinity of the air vent 23, and are arranged to obtain a smooth air flow with respect to the air vent 23. Therefore, in the induction cooking appliance 1, the pressure loss that occurs when taking in the cooling wind C from the air vent 23 by the intake port 20 is reduced.

As shown in FIG. 3, the intake port 20 of the main case 22 is formed in the right side region on the rear surface side of a bottom surface plate 22*c*, and the exhaust port 21 is formed at a left end of a rear surface wall 22*d* of the main case 22. An inlet port 26 of the blower device 17 is arranged at a position facing the intake port 20 inside the main case 22.

Therefore, in the induction cooking appliance 1 of the first embodiment, the air on the lower side, whose temperature is relatively low, in the internal space of the kitchen cabinet 2 is taken in as the cooling wind C from the intake port 20. The air of high temperature is exhausted to the upper side of the internal space of the kitchen cabinet 2 from the exhaust port 21.

In the internal space of the induction cooking appliance 1 of the first embodiment, the control circuit 15 is arranged in a space on the near side than the position where the intake port 20 is formed. The switching element (IGBT) 27 etc. having a large amount of heat generation among the heat generating components 16 of the control circuit 15 are arranged at a position relatively close from a blowing port 24 of the blower device 17. The switching element 27 is configured to be cooled by being joined to the heat sink 28 to further enhance the cooling performance of the switching element 27.

The cooling wind C from the blowing port 24 of the blower device 17 is guided to a predetermined cooling space by the duct 18, and the heat generating component 16 of the control circuit 15 such as the switching element (IGBT) 27 and the resonance capacitor 29, as well as the infrared sensor 13 are arranged in the cooling space formed by the duct 18. A branched plate 30 is arranged on the inner side of the duct 18, so that the cooling wind C from the blowing port 24 of the blower device 17 reliably makes contact with each component in the duct 18 to reliably cool each component.

The cooling wind C that cooled each component in the duct 18 is discharged from the duct 18, and then cools the radiator plate 10, which partitions the upper space in which the heating coil 5 etc. are arranged and the lower space in which the control circuit 15 etc. are arranged. A cooling wind detection thermistor (not shown) is arranged in the vicinity of the blowing port 24 of the blower device 17. A cooling wind temperature detection signal indicating the temperature of the cooling wind C detected by the thermistor is input to the control circuit 15. When detection is made that the temperature of the cooling wind C exceeded a predetermined temperature, the control circuit 15 controls the output to the heating coil 5 and controls the suppression of heat generation of the electronic components.

As shown in FIG. 3, a predetermined distance is realized between a front surface wall 19*a* on the near side of the sub-case 19 and a side surface wall (front surface wall) 22*a* on the near side of the main case 22, and a front surface exhaust flow path is formed. This front surface exhaust flow path is a first exhaust flow path 32. A predetermined distance is also realized between a left side surface wall 19*b* of the sub-case 19 and a left side surface wall 22*b* of the main case 22, and a left side surface exhaust flow path is formed. This left side surface exhaust flow path is a second exhaust flow path 34. In the first embodiment, a planar cross-section of the sub-case 19 and the main case 22 is rectangular, and the respective front surface wall 19*a*, 22*a* and left side surface wall 19*b*, 22*b* are arranged to be orthogonal.

In the induction cooking appliance 1 of the first embodiment, one induction heating block 33 is configured by the two coil units 8*a*, 8*b* mounted on the radiator plate 10, the control circuit 15 for drive controlling the output of the coil units 8*a*, 8*b*, and the blower device 17 for cooling the heat generating components 16 in the control circuit 15.

The operation portion 36 of the induction cooking appliance 1 of the first embodiment is provided in an operation region arranged on the near side of the top plate 4, and a switch mechanism of the operation portion 36 is provided immediately below the operation region. The switch mechanism of the operation portion 36 is arranged facing each of a plurality of operation buttons printed in the operation region of the top plate 4. An electrode of the switch mechanism of the operation portion 36 is pressed against the back surface of the top plate 4. When the operation button of the top plate 4 is touched with a finger, the electrostatic capacitance of the switch mechanism changes, and the control circuit 15 detects such change in electrostatic capacitance to carry out the control corresponding to the command of the operation portion 36. Therefore, in the induction cooking appliance 1 of the first embodiment, the operation portion 36 has an electrostatic capacitance type touch switch configuration.

The length in the height direction of the operation portion 36 is formed relatively short since the switch mechanism of the operation portion 36 is configured by an operation substrate and a touch switch. Thus, at least one part of the first exhaust flow path 32, which is the front surface exhaust flow path, is arranged below the operation portion 36.

In the first embodiment, the front surface wall 22*a* of the main case 22 is arranged to face the direction of the cooling wind C sent from the blower device 17 to the control circuit 15. The first exhaust flow path 32 is configured by the front surface wall 22*a*. The second exhaust flow path 34 is configured by the left side surface wall 22*b* of the main case 22. The intake port 20 is formed on the rear surface side of the bottom surface plate 22*c* of the main case 22, and the exhaust port 21 is formed on the rear surface wall 22*d* of the main case 22. In the configuration of the first embodiment, the front surface wall 22*a* of the main case 22 corresponds to a first side surface wall, and the left side surface wall 22*b* of the main case 22 corresponds to a second side surface wall.

The operation in the induction cooking appliance 1 of the first embodiment configured as above will now be described.

The cooling wind C taken in from the intake port 20 by the blower device 17 is blown out in the direction of the near side from the blowing port 24 of the blower device 17 so as to cool the control circuit 15. The cooling wind C blown out in the direction of the near side from the blower device 17 is guided by the duct 18 so as to cool each heat generating component 16 of the control circuit 15. The cooling wind C that cooled each heat generating component 16 flows towards the direction of the near side as is, passes through a vent hole of the front surface wall 19*a* of the sub-case 19, and reaches the first exhaust flow path 32, which is the front surface exhaust flow path.

The cooling wind C exhausted from the sub-case 19 makes contact with the front surface wall 22*a* of the main case 22 in the first exhaust flow path 32, so that the flow of the cooling wind C is bent substantially 90 degrees. Since the right end of the first exhaust flow path 32 is closed, the cooling wind C flows towards the direction of the second exhaust flow path 34, which is the left side surface exhaust flow path. Thus, the wind flows in the left direction through the first exhaust flow path 32, thus reaching the second exhaust flow path 34.

In the second exhaust flow path 34, the cooling wind makes contact with the left side surface wall 22*b* of the main case 22 to be further bent substantially 90 degrees, and flows along the second exhaust flow path 34 to be discharged backward from the exhaust port 21 formed on the rear surface wall 22*d* on the rear surface side. In other words, the discharging direction of the cooling wind exhausted from the exhaust port 21 becomes the direction regressing the flowing direction of the cooling wind C for cooling the control circuit 15 inside the sub-case 19. Therefore, the cooling wind C discharged from the sub-case 19 flows through the first exhaust flow path 32 and the second exhaust flow path 34, so that the exhausting direction of the cooling wind C discharged from the exhaust port 21 is backward to the discharging direction of the cooling wind discharged from the sub-case 18 after cooling the control circuit 15, and is bent substantially 180 degrees.

When the cooling wind C is flowing along the second exhaust flow path 34 (left side surface side flow path), the flow in the rear surface side direction is the mainstream in the flow vector of the cooling wind C. Thus, the flow of the cooling wind C discharged from the exhaust port 21 at the rear surface wall 22*d* of the main case 22 is assumed to be directed backward from the main case 22. In other words, the air discharged from the exhaust port 21 is exhausted in the direction that the air vent 23 of the kitchen cabinet 2 is formed. As described above, the air passed through the second exhaust flow path 34 and discharged from the exhaust port 21 has a flow speed of a speed of a certain extent, and is an exhaust air in which the flowing direction is clearly defined or that the air is exhausted backward from the exhaust port 21 of the main case 22. Thus, the exhausting direction from the exhaust port 21 is a direction different from the direction in which the intake port 20 formed in the right side region of the bottom surface plate 22*c* of the main case 22 is arranged, and is a direction of moving away from the intake port 20. Therefore, in the configuration of the first embodiment, the air discharged from the exhaust port 21 is less likely to be taken in again from the intake port 20, and the cooling performance is greatly enhanced.

Inside the induction cooking appliance 1, when changing the direction of the cooling wind C by substantially 180 degrees, a region in which the control circuit 15 is arranged needs to be circumvented after at least the control circuit 15 that needs to be cooled is cooled. Thus, the cooling wind C first changes direction by substantially 90 degrees in the horizontal direction after cooling the control circuit 15. Thereafter, the cooling wind changes the direction by substantially 90 degrees again in the horizontal direction to reach the exhaust port.

As described above, the disturbed flow generated when the cooling wind C changes the direction by substantially 180 degrees is rectified to a flow having the flow vector in a substantially perpendicular direction with respect to the front surface wall 22*a*, which is the first side surface wall, as a mainstream in the second exhaust flow path 34 leading to the exhaust port.

With the exhaust flow path configured in the above manner, the air discharged from the exhaust port 21 is less likely to be taken in again from the intake port 20 in the induction cooking appliance 1 of the first embodiment.

If the exhaust port is formed on the first side surface wall, to which the cooling wind C discharged from the sub-case 19 makes contact, the cooling wind discharged from such exhaust port does not have a constant flowing direction and flows in various directions. As a result, if an obstacle is present facing the exhaust port, for example, the cooling wind C hits the obstacle thus stagnating the flow, and turns back to flow in the direction of the intake port. The flowing direction of the cooling wind C varies, and is a flow having a small flow speed. Therefore, most of the cooling wind C discharged from the exhaust port is taken in from the intake port.

In the exhaust flow path configuration of the induction cooking appliance 1 of the first embodiment, the cooling wind C flows through the exhaust flow path of the main case 22 until discharged from the exhaust port, so that the flow speed advances to the flow speed of a certain extent, and the flow in which the flowing direction is clearly defined or a substantially perpendicular direction with respect to the front surface wall 22*a* or the first side surface wall is obtained. Thus, even if a shielding plate is not arranged between the intake port and the exhaust port and the intake port is arranged near the exhaust port, the cooling wind C discharged from the exhaust port is less likely to be taken in again from the intake port.

In the exhaust flow path configuration according to the first embodiment, the exhaust port is formed at other than the first side surface wall, and thus the cooling wind C discharged from the sub-case 19 after cooling the control circuit 15 is direction-changed substantially 90 degrees in the horizontal direction and flowed along the first side surface wall 22*a*. Therefore, the direction of flow of the cooling wind C is the flow in the direction constant to a certain extent, which is turned back at least substantially 90 degrees with respect to the direction from the intake port 20 to the first side surface wall 22*a*. Therefore, even if an obstacle is present at a position facing the exhaust port and the cooling wind C hits the obstacle, the entire discharged cooling wind is easily flowed while being bent in the perpendicular direction with respect to the first side surface wall 22*a* and is less likely to be taken in again from the intake port.

Therefore, in the induction cooking appliance 1 of the first embodiment, the cooling wind is less likely to be taken in again from the intake port not only if there is not an obstacle facing the exhaust port, but also if there is an obstacle. Therefore, if the induction cooking appliance 1 of the first embodiment is incorporated in the kitchen cabinet or installed near another device, the temperature rise due to re-taking of the exhausted cooling wind C is reduced even if there is an obstacle facing the exhaust port and the degradation in reliability due to the temperature is not accelerated with respect to the component in the induction cooking appliance. Furthermore, the induction cooking appliance 1 of the first embodiment can be applied without using a special member such as a shielding plate in a configuration of a carrying out intake—exhaust at the backward position of the kitchen cabinet 2. Therefore, according to the configuration of the first embodiment, the induction cooking appliance enabling the user to perform a safe and comfortable task that does not involve an unpleasant feeling by the exhaust air is obtained.

Since the induction cooking appliance 1 of the first embodiment configured as above is incorporated in the kitchen cabinet 2, the exhausting direction from the exhaust port 21 of the main case 22 is the rear surface side direction (back side) of the kitchen cabinet 2 in the internal space of the kitchen cabinet 2, and is the direction the air vent 23 is formed. Thus, the air discharged from the exhaust port 21 of the main case 22 flows to the air vent 23 of the kitchen cabinet 2 as is, and becomes an air flow that is less likely to be taken in again from the intake port 20 of the main case 22 of the induction cooking appliance 1.

The cooling wind C taken in from the intake port 20 of the main case 22 cools the control circuit 15 and the like in the sub-case 19 and flows to the front side, and then passes through the first exhaust flow path 32 and the second exhaust flow path 34 to be exhausted from the exhaust port 21. Thus, the flow path of the cooling wind C is bent in a clockwise direction by substantially 180 degrees when seen from the vertically upward direction. Thus, in the configuration of the first embodiment, the pressure loss occurs at the bent portion of the exhaust flow path, the number of rotations of the blower device 17 drops, the flow rate of the cooling wind C reduces, and the cooling performance lowers.

However, in the configuration of the first embodiment, the sirocco fan is used as the blower device 17, so that the flow of the cooling wind C blown out from the sirocco fan has a vector component in the rotating direction same as the clockwise direction, which is the rotating direction of the sirocco fan.

Therefore, in the induction cooking appliance 1 of the first embodiment, the exhaust flow path that bends in the rotating direction same as the vector component in the rotating direction of the cooling wind C blown out from the sirocco fan is formed. The cooling wind C flows along the exhaust flow path to be exhausted from the exhaust port 21 formed at the rear surface wall 22*d* of the main case 22. Therefore, even with the configuration including the bent portion where the exhaust flow path of the cooling wind C greatly bends the flow as in the induction cooking appliance 1 of the first embodiment, the disturbance of air flow at the bent portion is small, the pressure loss of the entire flow path can be reduced, and the reduction in the flow rate of the cooling wind C can be greatly suppressed. Furthermore, according to the configuration of the induction cooking appliance 1 of the first embodiment, the disturbance of the flow in the exhaust flow path is reduced and thus the noise generated from the disturbance of the flow is reduced.

Moreover, in the configuration of the first embodiment, the intake port 20, the exhaust port 21, and the air vent 23 are formed on the rear surface side in the internal space of the kitchen cabinet 2, and hence the noise generated by the cooling wind is less likely to be heard by the user.

In the kitchen cabinet 2 in which the induction cooking appliance 1 of the first embodiment is arranged, the air vent communicating the interior and the exterior of the kitchen cabinet 2 is not arranged on the near side nor the upper surface side of the kitchen cabinet 2, and is arranged only on the rear surface side of the kitchen cabinet 2 where the intake port 20 and the exhaust port 21 of the induction cooking appliance 1 are arranged. Therefore, the ventilation operation of the interior and the exterior of the kitchen cabinet 2 of the cooling wind C in the induction cooking appliance 1 becomes smooth through the interior of the kitchen cabinet 2 by arranging the air vent 23 communicating the interior and the exterior of the kitchen cabinet 2 on the rear surface side. A comfortable operation and cooking can be carried out without the ventilation wind directly hitting the user by arranging the induction cooking appliance 1 of the first embodiment in the kitchen cabinet 2.

In the induction cooking appliance 1 of the first embodiment, the intake port 20 and the exhaust port 21 are arranged on the rear surface side, so that an open portion does not need to be formed on the upper surface of the kitchen cabinet 2. Thus, water vapor and oil smoke are less likely to enter the inside of the kitchen cabinet 2 and the induction cooking appliance 1, and the wind noise generated when taking in or exhausting air is also reduced.

In the induction cooking appliance 1 of the first embodiment, an opening such as the intake port 20 and the exhaust port 21 is not formed in the top plate 4, and hence the degree of freedom of design of the top plate 4 is greatly enhanced.

In the induction cooking appliance 1 of the first embodiment, the air on the lower side of the internal space of the kitchen cabinet 2 where the temperature is relatively low can be taken in since the intake port 20 is arranged at the bottom surface plate 22*c* of the main case 22. Furthermore, the high temperature air from the exhaust port 21 is exhausted to the upper side in the internal space of the kitchen cabinet 2 and hence is discharged towards the rear surface side of the kitchen cabinet 2 since the exhaust port 21 is formed at the left end of the rear surface wall 22*d* and not on the bottom surface plate 22*c* of the main case 22. Therefore, in the configuration of the first embodiment, the intake—exhaust configuration in which the cooling wind C discharged from the exhaust port 21 is less likely to be taken in again from the intake port 20 is provided.

A shielding plate for separating the space between the intake port 20 and the exhaust port 21 of the induction cooking appliance 1 may be arranged inside the kitchen cabinet 2 to more reliably prevent re-take in.

The first exhaust flow path 32 and the second exhaust flow path 34 are described as being configured by forming a special space using the front surface walls 19*a*, 22*a* and the left side surface walls 19*b*, 22*b* in the sub-case 19 and the main case 22, but the first exhaust flow path 32 and the second exhaust flow path 34 having similar effects may be formed without separately arranging a duct or the like. For instance, a similar exhaust flow path may be formed using one part of the front surface wall 22*a*, the left side surface wall 22*b*, and the bottom surface plate 22*c* of the main case 22, or using one part of the lower surface of the radiator plate 10 mounted with the coil unit 8 and the side surface wall in the sub-case 19. The space can be saved by forming the exhaust flow path using one part of the radiator plate 10, the sub-case 19, or the main case 22.

Forming the exhaust flow path using the lower surface of the radiator plate 10 further enhances the cooling effect of the radiator plate 10, and lowers the temperature of the heating coil 5. As a result, a configuration for directly cooling the heating coil 5 becomes unnecessary, and the flow path of the cooling wind C to the heating coil 5 does not need to be formed. Therefore, enhancing the cooling effect of the radiator plate 10 leads to thinning of the induction cooking appliance 1 and saving of space.

In the induction cooking appliance 1 of the first embodiment, the cooling wind C, which temperature raised by cooling the heating coil 5, the heat generating component 16 and the like, is immediately exhausted to the outside of the main case 22 without making contact with other electronic components. Thus, in the induction cooking appliance 1, the other electronic components and the like are prevented from being heated and temperature raised by the temperature raised cooling wind C, so that degradation of the electronic components caused by the temperature rise does not occur, and a highly reliable induction cooking appliance can be obtained.

Since a large component that inhibits the flow of the cooling wind C is not arranged in the exhaust flow path of the induction cooking appliance 1 of the first embodiment, the flow of the cooling wind C discharged from the sub-case 19 can be smoothly changed. Therefore, in the induction cooking appliance 1 of the first embodiment, the pressure loss is reduced in the flow path of the cooling wind.

In the induction cooking appliance 1 of the first embodiment, the space on the lower side of the operation portion 36 can be used for the first exhaust flow path 32, and the dead space in the internal space of the induction cooking appliance 1 can be utilized to save space.

In the induction cooking appliance 1 of the first embodiment, a configuration is adopted so that the cooling wind C does not mix between the flow in which the cooling wind C from the blower device 17 on the rear surface side flows towards the direction of the near side by the duct 18 and the side surface wall of the sub-case 19 and reaches the first exhaust flow path 32, and the flow in which the direction is changed substantially 180 degrees to flow through the second exhaust flow path 34 to be directed from the near side towards the exhaust port 21 on the rear surface side. Thus, a short circuit from the blowing port 24 of the blower device 17 to the exhaust port 21 does not occur inside the induction cooking appliance 1, and each heat generating component 16 inside the induction cooking appliance can be reliably and stably cooled. Furthermore, as the disturbance of the flow due to the mixed flow does not occur inside the induction cooking appliance, the air is exhausted without the magnitude of the flow vector in the direction from the near side to the rear surface side greatly attenuated in the induction cooking appliance 1. As a result, the induction cooking appliance 1 of the first embodiment has a configuration in which the cooling wind discharged from the exhaust port 21 is less likely to be taken in again from the intake port 20, and thus the cooling performance is enhanced.

If the component that particularly requires forced air cooling in the induction cooking appliance 1 is only the heat generating component 16 attached to the heat sink 28, the radiator plate 10 and the heat sink 28 may be used in place of the duct 18 for guiding the cooling wind C. For instance, the lower surface of the radiator plate 10 may be used as the upper wall in the duct, and the fin on the outermost side of the heat sink 28 may be extended to be used as the side surface wall of the duct.

Through the use of the radiator plate 10 and the heat sink 28, the cooling wind C does not mix between the flow from the blower device 17 on the rear surface side towards the direction of the near side to the first exhaust flow path 32 and the flow flowing through the second exhaust flow path 34 from the near side towards the direction of the rear surface side, in which the direction is changed substantially 180 degrees, inside the induction cooking appliance even if the side surface wall of the sub-case 19 and the duct 18 are not arranged. Thus, the short circuit from the blowing port 24 of the blower device 17 to the exhaust port 21 does not occur inside the induction cooking appliance, and each component inside the induction cooking appliance can be reliably and stably cooled.

In the induction cooking appliance 1 of the first embodiment, the exhaust air from the exhaust port 21 is less likely to be taken in by the intake port 20 even if nothing is provided between the intake port 20 and the exhaust port 21 opened to the internal space of the kitchen cabinet 2. However, the air exhausted from the exhaust port 20 is reliably prevented from being taken in again by the intake port 20 by arranging a partition plate that blocks the flow of the cooling wind C between the intake port 20 and the exhaust port 21, so that the cooling performance can be further enhanced.

The partition plate desirably has a configuration that completely divides the region where the intake port 20 is arranged and the region where the exhaust port 21 is arranged in the internal space of the kitchen cabinet 2. The partition plate may exhibit the effect with a configuration that guides the flow of the air flow by arranging the partition plate at one part of the internal space rather than completely dividing the region where the intake port 20 is arranged and the region where the exhaust port 21 is arranged.

In the induction cooking appliance 1 of the first embodiment, a configuration using the duct 18 that forms the flow path to guide the cooling wind C from the blowing port 24 of the blower device 17 to the heat generating component 16 in the control circuit 15, the infrared sensor 13, and the like has been described, but the present invention is not limited to such configuration of the duct 18 and may be configured merely with a flat plate guide plate.

The guide plate may be configured to rise from the bottom surface plate 22*c* of the main case 22. In another configuration, the guide plate may be arranged on the lower surface of the radiator plate 10 arranged on the upper side of the control circuit 15 and the like, and the radiator plate 10 and the guide plate may be integrally configured.

In the configuration of the first embodiment, an example in which one intake port 20 is arranged on the rear surface side in the bottom surface plate 22*c* of the induction cooking appliance 1, and one exhaust port 21 is arranged on the rear surface wall 22*d* of the induction cooking appliance 1 has been described, but the present invention is not limited to such configuration. For instance, with the intake port 20 and the exhaust port 21 of the first embodiment as a main intake port and a main exhaust port, an auxiliary intake port and exhaust port with lesser air intake quantity and air exhaust quantity may be added to other side surface wall and bottom surface plate in the induction cooking appliance 1.

If the auxiliary intake port and exhaust port are arranged in plurals on the left side surface wall 22*b*, the bottom surface plate 22*c*, the rear surface wall 22*d*, and the like of the main case 22 in the induction cooking appliance 1, even when installed such that one part of the inner wall of the kitchen cabinet incorporating the induction cooking appliance 1 is proximate to one of the intake ports or the exhaust ports, the air can be taken in and the air can be exhausted from the intake port and the exhaust port provided at other places, so that rise in pressure loss can be prevented.

In the main case 22 of the induction cooking appliance 1, a surface may be depressed to the inner side or may be inclined, and the intake port and the exhaust port may be formed on the depressed surface or the inclined surface. With the intake port and the exhaust port arranged in such manner, even when installed such that the inner wall of the kitchen cabinet 2 and the wall of the kitchen are proximate to the main case 22, the distance to the wall surface facing the intake port and the exhaust port can be reliably ensured, and the rise in pressure loss caused by the installing situation can be prevented.

The air vent 23 in the kitchen cabinet 2 has been described as opened downward on the rear surface side, but this is not the sole case, and may be opened upward on the rear surface side. A ventilation hole opened to the wall surface of the kitchen, where the kitchen cabinet 2 is installed, may be formed to communicate with the exterior of the kitchen through such ventilation hole to carry out ventilation.

In the induction cooking appliance 1 of the first embodiment, a configuration of cooling the radiator plate 10 with the cooling wind C from the duct 18 has been described, but the present invention is not limited to such configuration. For instance, a cooling fan for cooling the radiator plate 10 may be separately arranged. The blower device 17 is configured to taken in air from outside of the main case 22, but may slightly taken in air from the inside of the main case 22, so that the flow of air circulating along the radiator plate 10 is formed to cool the radiator plate 10.

In the induction cooking appliance 1 of the first embodiment, an example in which one infrared sensor 13 and one thermistor 14 are respectively arranged has been described, but the present invention is not limited to such configuration. For instance, two or more of the infrared sensors 13 and the thermistors 14, respectively, may be arranged or only either one may be arranged.

In the induction cooking appliance 1 of the first embodiment, an example in which aluminum is used for the material of the radiator plate 10 has been described, but is not limited thereto, and may be formed using other non-magnetic metal materials such as brass or copper.

In the induction cooking appliance 1 of the first embodiment, an example in which the switch of the operation portion 36 uses the electrostatic capacitance type touch switch has been described, but is not limited thereto, and may use a push type tact switch, a slide switch, a rotary switch, or the like.

In the induction cooking appliance 1 of the first embodiment, a configuration in which the sirocco fan is used for the blower device 17 has been described, but is not limited thereto, and a propeller fan, a cross flow fan, a turbo fan, or the like may be used.

In the induction cooking appliance 1 of the first embodiment, an example in which the heating regions 12*a*, 12*b* in the top plate 4 are aligned in one row one in front of the other has been described, but is not limited thereto. For instance, the heating region can be arranged at an arbitrary position on the front, back, left, or right in the top plate. Furthermore, the number of heating regions is not limited to two and may be increased or decreased, where one may be arranged at substantially the central portion of the top plate or three or more may be arranged.

Second Embodiment

Figure 4:
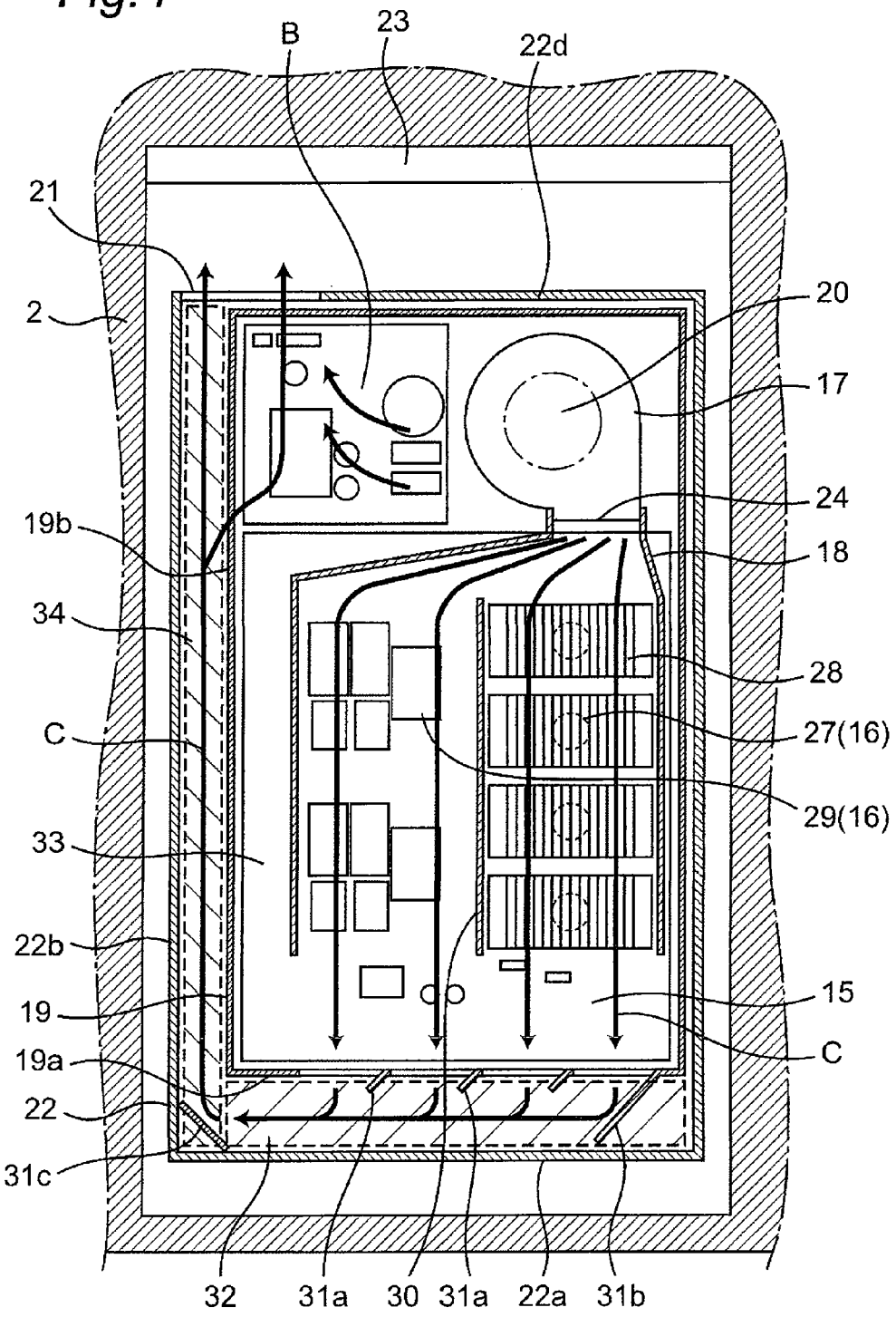
FIG. 4 is a horizontal cross-sectional view showing an internal configuration of an induction cooking appliance of a second embodiment according to the present invention.

An induction cooking appliance according to a second embodiment of the present invention will be hereinafter described with reference to the accompanied drawings. FIG. 4 is a horizontal cross-sectional view showing an internal configuration of the induction cooking appliance according to the second embodiment of the present invention. In the induction cooking appliance of the second embodiment, the basic configuration is the same as the induction cooking appliance of the first embodiment described above, and thus the different aspect will be centrally described. In the following description of the second embodiment, the same reference numerals are denoted on the configuring elements having the same functions and configurations as the configuring elements in the induction cooking appliance 1 of the first embodiment, so that the detailed description thereof is omitted and the description of the first embodiment is applied.

As shown in FIG. 4, the induction cooking appliance of the second embodiment is configured such that the cooling wind C from the blower device 17 is guided by the duct 18 to cool the heat generating component 16 and the like, and is flowed to the first exhaust flow path 32 at the inside. In the induction cooking appliance of the second embodiment, a plurality of flow path guiding plates 31*a*, 31*b* are arranged at a region where the cooling wind C flows from the sub-case 19 to the first exhaust flow path 32, that is, a region where the flow of the cooling wind C is bent substantially 90 degrees. A flow path guiding plate 31*c* is arranged at a region where the cooling wind C flows from the first exhaust flow path 32 to the second exhaust flow path 34, that is, a region where the flow of the cooling wind C is bent substantially 90 degrees.

The flow path guiding plate 31*a* is integrally formed with the front surface wall 19*a*, which is the side surface wall on the front surface side of the sub-case 19, and is arranged to bend the cooling wind C passing through an opening formed in the front surface wall 19*a* by substantially 90 degrees. The flow path guiding plate 31*a* is arranged to include a surface inclined substantially 45 degrees with respect to the flowing direction (refer to arrows in FIG. 4) of the cooling wind C flowing from the rear surface side to the near side by the blower device 17. Similarly, the flow path guiding plate 31*b* is formed obliquely to the right end of the opening at the front surface wall 19*a* of the sub-case 19, and is arranged such that the cooling wind C passing the vicinity of the right end of the opening is bent substantially 90 degrees to flow in the left side direction. The flow path guiding plate 31*c* is arranged at a corner portion bending from the first exhaust flow path 32 to the second exhaust flow path 34, and is arranged to include a surface inclined substantially 45 degrees with respect to the flowing direction (refer to arrows in FIG. 4) in the first exhaust flow path 32. The flow path guiding plates 31*b*, 31*c* are attached and fixed to the bottom surface plate 22*c* of the main case 22.

In the induction cooking appliance of the second embodiment, the blower device 17, the duct 18, and the heat generating component 16 having a large amount of heat generation in the control circuit 15 are arranged inside the sub-case 19. The component having small amount of heat generation in the control circuit 15 is arranged in a region indicated with a reference numeral B (refer to FIG. 4), which is the outer side of the side surface wall of the sub-case 19.

In the induction cooking appliance of the second embodiment, the front surface wall 22*a* of the main case 22 is arranged in the wind direction of the cooling wind C sent from the blower device 17 arranged on the rear surface side to the control circuit 15. The first exhaust flow path 32 is configured by the front surface wall 22*a*. The second exhaust flow path 34 is configured by the left side surface wall 22*b* of the main case 22. The intake port 20 is arranged on the rear surface side in the bottom surface plate 22*c* of the main case 22, and the exhaust port 21 is arranged on the rear surface wall 22*d* of the main case 22. In the configuration of the second embodiment, the front surface wall 22*a* of the main case 22 corresponds to the first side surface wall, and the left side surface wall 22*b* of the main case 22 corresponds to the second side surface wall.

The operation in the induction cooking appliance of the second embodiment configured as above will now be described.

In the induction cooking appliance of the second embodiment, the cooling wind C from the blower device 17 is guided by the duct 18 to cool each heat generating component 16 of the control circuit 15, and passed through the opening of the front surface wall 19*a* of the sub-case 19 to flow to the first exhaust passage 32. A plurality of flow path guiding plates 31*a*, 31*b* oblique with respect to the flowing direction of the cooling wind C in the sub-case 19 is arranged with a predetermined interval at the opening of the front surface wall 19*a* of the sub-case 19. Thus, the cooling wind C exhausted from the opening of the front surface wall 19*a* of the sub-case 19 smoothly flows in the flow path direction (leftward direction in FIG. 4) of the first exhaust flow path 32. The cooling wind C flowed in the flow path direction of the first exhaust flow path 32 smoothly flows through the second exhaust flow path 34 without stagnating at the bent portion by the flow path guiding plate 31*c*.

The flow of the cooling wind C becomes smooth and the pressure loss is greatly reduced since the flow path guiding plates 31*a*, 31*b*, 31*c* are arranged in the region where the flow of the cooling wind C is greatly bent. Therefore, the occurrence of disturbance of flow in the cooling wind C is more suppressed, and the flow of the cooling wind C exhausted from the exhaust port 21 through the second exhaust flow path 34 grows to a larger flow speed with the flow vector towards the back side as the mainstream. Furthermore, the exhaust air in which the flowing direction is clearly defined as flowing from the near side to the rear surface side in the induction cooking appliance is obtained as the cooling wind C flows through the second exhaust flow path 34. Therefore, the air exhausted and heated from the exhaust port 21 at the left end side of the rear surface wall 22*d* of the main case 22 becomes difficult to be taken in again from the intake port 20 on the right side of the bottom surface plate 22*c*, so that the cooling performance is enhanced.

In the induction cooking appliance of the second embodiment, one part of the control circuit 15 (component in the region indicated with reference symbol B in FIG. 4) is arranged near the second exhaust flow path 34, and the middle of the second exhaust flow path 34 is opened so that one part of the cooling wind C flows out from such opening to the one part of the control circuit 15. Thus, when the cooling wind C flows through the second exhaust flow path 34, the cooling wind C flows to one part of the control circuit 15 from the middle of the second exhaust flow path 34, and thus the control circuit 15 close to the second exhaust flow path 34 and the electronic components on the control circuit, especially, are brought into contact with the cooling wind C and cooled.

When the cooling wind C flows in the second exhaust flow path 34, negative pressure generates at the position set back away from the second exhaust flow path 34 in the region indicated with the reference symbol B in FIG. 4, and some air flows to the exhaust port 21. Thus, the temperature of the control circuit 15 arranged on the outer side of the sub-case 19 and each electronic component on the control circuit can be reduced compared to when the air is not flowing at all and is stagnated.

In the configuration of the second embodiment, a configuration in which the flow path guiding plate 31*a* is integrally formed with the front surface wall 19*a* of the sub-case 19 and the flow path guiding plates 31*b*, 31*c* are attached to the bottom surface plate 22*c* of the main case 22 has been described, but the present invention is not limited to such configuration. For instance, the flow path guiding plate may be formed on the lower surface of the radiator plate 10 or may be formed on the lower surface of the switch mechanism configuring the operation portion 36.

The operation portion 36 is generally configured by a substrate mounted with a touch switch, and a resin substrate case for including and holding the relevant substrate, whereby the assembly becomes easy and convenient and lower cost is achieved by integrally arranging the flow path guiding plate with the lower surface of the substrate case.

Third Embodiment

Figure 5:
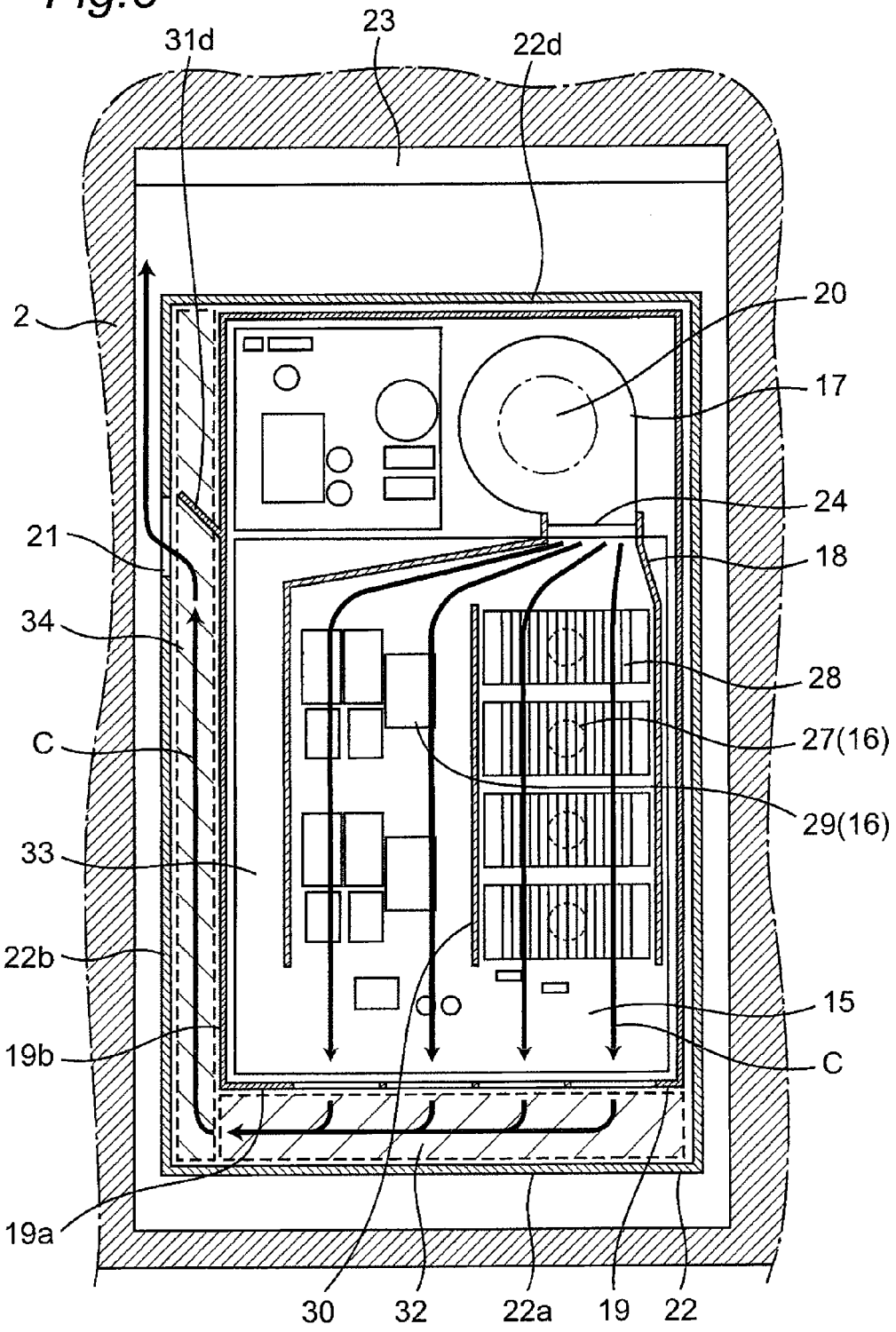
FIG. 5 is a horizontal cross-sectional view showing an internal configuration of an induction cooking appliance of a third embodiment according to the present invention.

An induction cooking appliance according to a third embodiment of the present invention will be hereinafter described with reference to the accompanied drawings. FIG. 5 is a horizontal cross-sectional view showing an internal configuration of the induction cooking appliance according to the third embodiment of the present invention. In the induction cooking appliance of the third embodiment, the basic configuration is the same as the induction cooking appliance of the first embodiment described above, and thus the different aspect will be centrally described. In the following description of the third embodiment, the same reference numerals are denoted on the configuring elements having the same functions and configurations as the configuring elements in the induction cooking appliance 1 of the first embodiment, so that the detailed description thereof is omitted and the description of the first embodiment is applied.

As shown in FIG. 5, in the induction cooking appliance of the third embodiment, the exhaust port 21 is formed on the rear surface side in the left side surface wall 22*b* of the main case 22. A flow path guiding plate 31*d* is arranged to smoothly guide the cooling wind C flowing through the second exhaust flow path 34 to the exhaust port 21. The flow path guiding plate 31*d* is arranged to include a surface inclined substantially 45 degrees with respect to the flowing direction (refer to arrows in FIG. 5) of the cooling wind C flowing in the second exhaust flow path 34. The position where the flow path guiding plate 31*d* is arranged is the rear surface side than half of the length in the depth direction of the main case 22. Therefore, the cooling wind C flowing in the second exhaust flow path 34 is guided to the exhaust port 21 by the flow path guiding plate 31 after the direction of flow from the near side to the rear surface side is confirmed.

In the induction cooking appliance of the third embodiment, the front surface wall 22*a* of the main case 22 is arranged in the wind direction of the cooling wind C sent from the blower device 17 arranged on the rear surface side to the control circuit 15. The first exhaust flow path 32 is configured by the front surface wall 22*a*. The second exhaust flow path 34 is configured by the left side surface wall 22*b* of the main case 22. The intake port 20 is arranged on the rear surface side at the bottom surface plate 22*c* of the main case 22, and the exhaust port 21 is arranged at the left side surface wall 22*b* of the main case 22. In the configuration of the third embodiment, the front surface wall 22*a* of the main case 22 corresponds to the first side surface wall, and the left side surface wall 22*b* of the main case 22 corresponds to the second side surface wall.

The operation in the induction cooking appliance of the third embodiment configured as above will now be described.

In the induction cooking appliance of the third embodiment, the cooling wind C from the blower device 17 is guided by the duct 18 to cool the heat generating component 16 of the control circuit 15, and is passed through a plurality of openings in the front surface wall 19*a* of the sub-case 19 to flow through the first exhaust passage 32 and the second exhaust flow path 34.

The cooling wind C is rectified while flowing through the second exhaust flow path 34, which is a linear flow path, to grow into a greater flow speed, and the cooling wind C in the second exhaust flow path 34 becomes a flow in which the direction is clearly defined to be from the near side to the rear surface side of the induction cooking appliance. The cooling wind C flowing in such manner is smoothly exhausted backward from the exhaust port 21 with the flowing direction becoming obliquely backward by the flow path guiding plate 31*d* inclined in the middle of the second exhaust flow path 34. In the cooling wind C exhausted from the exhaust port 21 in such manner, the main component of the vector in the flowing direction is the direction (backward direction) on substantially the rear surface side. Therefore, even if an obstacle such as the inner wall of the kitchen cabinet 2 or the wall of the kitchen exists at a position facing the exhaust port 21, the majority of the exhausted cooling wind C flows in the direction of the rear surface side (backward), and thus the induction cooking appliance of the third embodiment has a configuration in which the cooling wind is less likely to be again taken in from the intake port 20. Therefore, the induction cooking appliance of the third embodiment has a configuration in which the cooling performance is enhanced.

The induction cooking appliance of the third embodiment in which the exhaust port 21 is formed on the left side surface wall 22*b* does not need the rear surface side portion of the second exhaust flow path 34, which is a space on the rear surface side of the flow path guiding plate 31*d*, as the flow path compared to when the exhaust port 21 is arranged on the rear surface wall 22*d* as in the induction cooking appliance of the first embodiment shown in FIG. 3. This space can be used for other purposes such as arranging the control circuit 15, and hence the induction cooking appliance of the third embodiment can save space in the induction cooking appliance as a whole.

However, although redundant space on the rear surface side becomes greater the more the position formed with the exhaust port 21 becomes closer to the near side, the flow of the cooling wind C becomes difficult to be rectified and the magnitude of the flow vector from the near side to the rear surface side also becomes difficult to grow by that much. Therefore, the position formed with the exhaust port 21 is set in view of the cooling performance by the cooling wind C.

In the configuration of the third embodiment, an example in which the exhaust port 21 is formed in the left side surface wall 22*b* in the second exhaust flow path 34 has been described, but is not limited thereto, and the exhaust port may be formed in the bottom surface plate 22*c* in the second exhaust flow path 34, and the flow path guiding plate for smoothly exhausting the cooling wind C backward may be similarly arranged at the relevant exhaust port.

Fourth Embodiment

Figure 6:
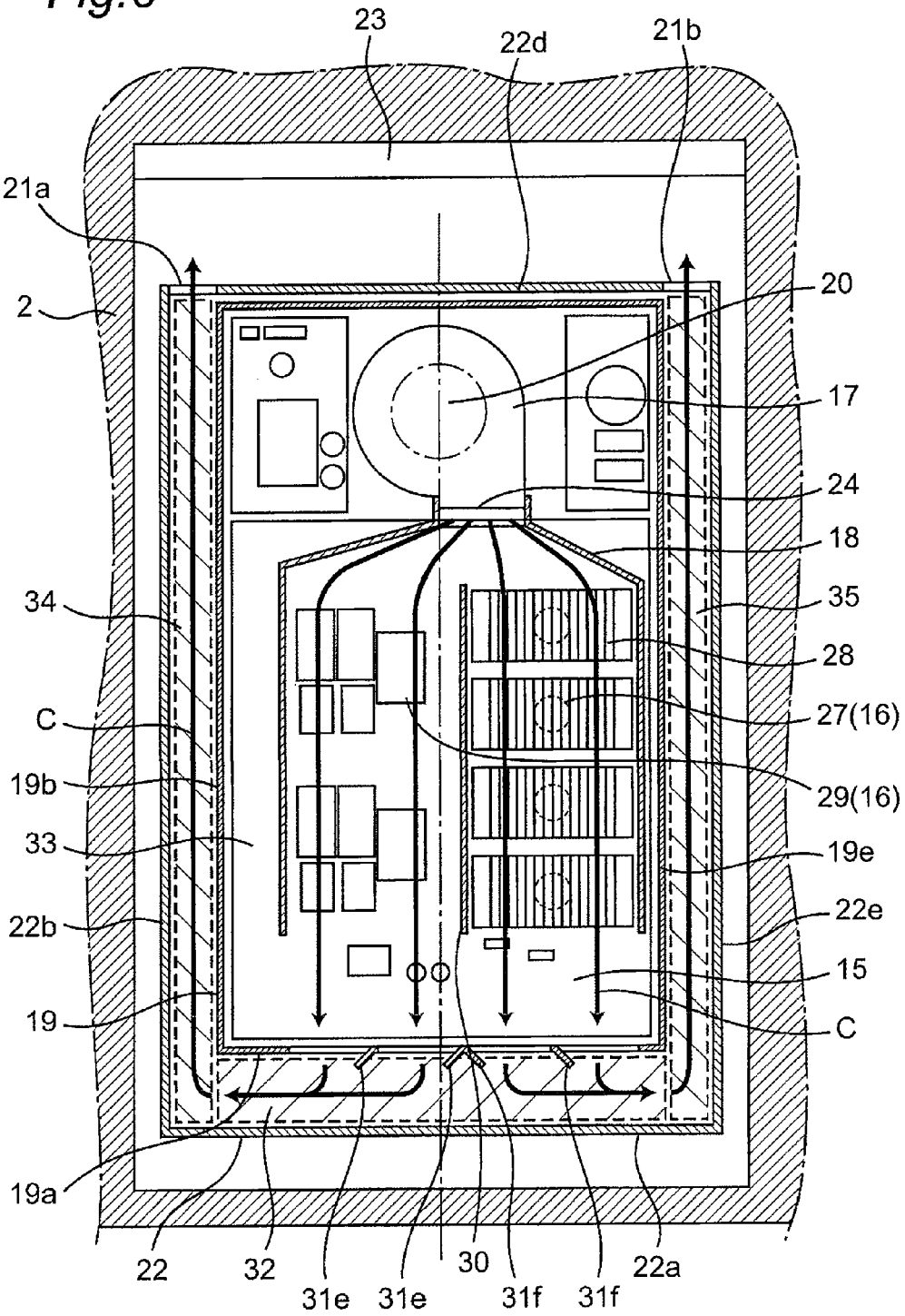
FIG. 6 is a horizontal cross-sectional view showing an internal configuration of an induction cooking appliance of a fourth embodiment according to the present invention.

An induction cooking appliance according to a fourth embodiment of the present invention will be hereinafter described with reference to the accompanied drawings. FIG. 6 is a horizontal cross-sectional view showing an internal configuration of the induction cooking appliance according to the fourth embodiment of the present invention. In the induction cooking appliance of the fourth embodiment, the basic configuration is the same as the induction cooking appliance of the first embodiment described above, and thus the different aspect will be centrally described. In the following description of the fourth embodiment, the same reference numerals are denoted on the configuring elements having the same functions and configurations as the configuring elements in the induction cooking appliance 1 of the first embodiment, so that the detailed description thereof is omitted and the description of the first embodiment is applied.

As shown in FIG. 6, in the induction cooking appliance of the fourth embodiment, the cooling wind C from the blower device 17 arranged at substantially the middle on the rear surface side is guided by the duct 18 to cool the heat generating component 16, and the like, and is flowed into the first exhaust flow path 32. The intake port 20 for taking into the blower device 17 is formed at substantially the middle on the rear surface side in the bottom surface plate 22*c* of the main case 22. The cooling wind C that reached the first exhaust flow path 32 is divided and flowed to the left and the right to flow to the second exhaust flow path 34 and a third exhaust flow path 35, respectively. The second exhaust flow path 34 is a flow path formed between the left side surface wall 19*b* of the sub-case 19 and the left side surface wall 22*b* of the main case 22. The third exhaust flow path 35 is a flow path formed between the right side surface wall 19*e* of the sub-case 19 and the left side surface wall 22*e* of the main case 22. The exhaust ports 21*a*, 21*b* are formed at the respective ends on the rear surface side of the second exhaust flow path 34 and the third exhaust flow path 35, which exhaust ports 21*a*, 21*b* are formed at the left and right ends of the rear surface wall 22*d* of the main case 22.

A plurality of flow path guiding plates 31*e*, 31*f* are arranged in a region the flow of the cooling wind C is bent substantially 90 degrees when the cooling wind C flows into the first exhaust flow path 32 from the interior of the sub-case 19. The flow path guiding plates 31*e*, 31*f* are arranged inclined by substantially 45 degrees with respect to the direction of the flow from the rear surface side to the near side of the induction cooking appliance, so that the cooling wind C from the sub-case 19 is smoothly bent substantially 90 degrees to flow through the first exhaust flow path 32. The plurality of flow path guiding plates 31*e*, 31*f* are arranged at the open portion of the front surface wall 19*a* of the sub-case 19, where the flow path guiding plate 31*e* of the left side region and the flow path guiding plate 31*f* of the right side region are inclined in different directions. The flow path guiding plate 31*e* of the left side region is inclined to flow the majority of the cooling wind C of the left side region of the branched plate 30 in the sub-case 19 to the second exhaust flow path 34 in the left side. The flow path guiding plate 31*f* of the right side region is inclined to flow the majority of the cooling wind C of the right side region of the branched plate 30 in the sub-case 19 to the third exhaust flow path 35 in the right side.

As described above, in the induction cooking appliance of the fourth embodiment, the intake port 20 of the bottom surface plate 22*c* of the main case 22 is formed at substantially the middle, and the two exhaust ports 21*a*, 21*b* are formed at positions substantially horizontally symmetric to a center line X in which the center axis direction in the induction cooking appliance including the center of the intake port 20 becomes the front and back direction, as shown in the horizontal cross-sectional view of FIG. 6. The second exhaust flow path 34 and the third exhaust flow path 35 are arranged to be substantially horizontally symmetric with respect to the center line X.

In the induction cooking appliance of the fourth embodiment, the front surface wall 22*a* of the main case 22 is arranged in the wind direction of the cooling wind C sent from the blower device 17 arranged on the rear surface side to the control circuit 15. The first exhaust flow path 32 is configured by the front surface wall 22*a*. The second exhaust flow path 34 is configured by the left side surface wall 22*b* of the main case 22, and the third exhaust flow path 35 is configured by the right side surface wall 22*e*. The intake port 20 is arranged at substantially the middle on the rear surface side in the bottom surface plate 22*c* of the main case 22, and the exhaust ports 21*a*, 21*b* are arranged on both sides of the rear surface wall 22*d* of the main case 22. In the configuration of the fourth embodiment, the front surface wall 22*a* of the main case 22 corresponds to the first side surface wall, the left side surface wall 22*b* of the main case 22 corresponds to the second side surface wall, and the right side surface wall 22*e* of the main case 22 corresponds to the third side surface wall.

The operation in the induction cooking appliance of the fourth embodiment configured as above will now be described.

In the induction cooking appliance of the fourth embodiment, the cooling wind C from the blower device 17 arranged on the rear surface side at substantially the middle is guided by the duct 18 to cool each heat generating component 16 of the control circuit 15, and is flowed to the first exhaust passage 32 through the opening of the front surface wall 19*a* of the sub-case 19.

A plurality of flow path guiding plates 31*e*, 31*f* inclined with respect to the flowing direction of the cooling wind C in the sub-case 19 is arranged at the opening of the front surface wall 19*a* of the sub-case 19. At the opening of the front surface wall 19*a* of the sub-case 19, the flow path guiding plate 31*e* on the left side arranged in the left region from substantially the middle is arranged inclined by substantially 45 degrees to the left with respect to the flowing direction from the rear surface side to the near side in the sub-case 19 so that the cooling wind C from the sub-case 19 flows in the left direction through the first exhaust flow path 32.

The flow path guiding plate 31*f* on the right side arranged in the right region from substantially the middle at the opening of the front surface wall 19*a* is arranged inclined by substantially 45 degrees to the right with respect to the flowing direction from the rear surface side to the near side in the sub-case 19 so that the cooling wind C from the sub-case 19 flows in the right direction through the first exhaust flow path 32. The branched position of the flow path guiding plate 31*e* on the left side and the flow path guiding plate 31*f* on the right side is on substantially the extended line of the branched plate 30 arranged on the inner side of the duct 18 in the sub-case 19.

Since the plurality of flow path guiding plates 31*e*, 31*f* are arranged at the opening of the front surface wall 19*a* of the sub-case 19, the cooling wind C exhausted from the opening of the front surface wall 19*a* of the sub-case 19 is smoothly divided to the left and the right, and flowed through the first exhaust flow path 32.

As described above, in the configuration of the fourth embodiment, the cooling wind C smoothly flows to the left and the right through the first exhaust flow path 32 from the sub-case 19 to be guided to the second exhaust flow path 34 on the left side and the third exhaust flow path 35 on the right side. The cooling wind C in the second exhaust flow path 34 and the third exhaust flow path 35 is flowed from the near side to the rear surface side of the induction cooking appliance, and exhausted backward from the respective exhaust ports 21*a*, 21*b*.

The cooling wind C flowing through the second exhaust flow path 34 and the third exhaust flow path 35 is rectified with the disturbance in the flow suppressed, and the flow vector towards the back side becomes the mainstream. Thus, the flow of air discharged from each exhaust port 21*a*, 21*b* through the second exhaust flow path 34 and the third exhaust flow path 35 grows to a greater flow speed. Furthermore, as the cooling wind C flows through the second exhaust flow path 34 and the third exhaust flow path 35, the wind is exhausted such that the flowing direction is clearly defined from the near side to the rear surface side in the induction cooking appliance. Thus, the air exhausted and heated from the exhaust ports 21*a*, 21*b* on both end sides of the rear surface 22*d* of the main case 22 is prevented from being taken in again from the intake port 20 at the central portion of the main case 22, and hence the cooling performance is enhanced.

In the induction cooking appliance of the fourth embodiment, the exhausting direction from the exhaust port 21*a*, 21*b* is the direction (backward) on the rear surface side in the kitchen cabinet 2, and thus the exhausted air is led to the air vent 23 formed on the rear surface side of the kitchen cabinet 2 as is. Therefore, the air exhausted from the exhaust ports 21*a*, 21*b* of the induction cooking appliance is less likely to be taken in again from the intake port 20.

In the induction cooking appliance of the fourth embodiment, the flow path configuration of the cooling wind C (first exhaust flow path 32, second exhaust flow path 34, and third exhaust flow path 35) is substantially symmetric with respect to the center line X in which the center axis direction in the induction cooking appliance is the front and back direction. Thus, the heated air is dispersed to about half each and then exhausted from the left and right exhaust ports 21*a*, 21*b*. Therefore, in the induction cooking appliance of the fourth embodiment, the local temperature rise in the region on the rear surface side in the internal space of the kitchen cabinet 2 is suppressed, and hence the temperature is raised substantially evenly without variation in the entire internal space of the kitchen cabinet 2.

In the configuration of the induction cooking appliance of the fourth embodiment, the cooling wind C, which became a heated air, flows along both side surface walls 22*b*, 22*e* of the main case 22, and thus the heat of the cooling wind C is transmitted to both side surface walls 22*b*, 22*e* and the bottom surface plate 22*c* thus raising the temperature of the main case 22. However, the cooling wind C is divided, and the heat conduction to both side surface walls 22*b*, 22*e* and the bottom surface plate 22*c* is also substantially symmetric with respect to the center line X. Therefore, the induction cooking appliance of the fourth embodiment has the local temperature rise suppressed in the main case 22 configured by the side surface walls 22*b*, 22*e* and the bottom surface plate 22*c*.

In the induction cooking appliance of the fourth embodiment, the plurality of flow path guiding plates 31*e*, 31*f* are arranged at the front surface wall 19*a* of the sub-case 19 to separate the cooling wind C flowed through the sub-case 19 to the second exhaust flow path 34 and the third exhaust flow path 35, but a partition plate for separating the cooling wind C to the left and the right may be arranged at substantially the middle of the first exhaust flow path 32 to more reliably separate the cooling wind C. The partition plate preferably has a configuration of being inclined with respect to the flowing direction of the cooling wind C so that the cooling wind C is separated to the left and right and then smoothly flowed.

If the amount of heat generation in each heat generating component 16 arranged on the inner side of the duct 18 is asymmetric with respect to the center line X, the temperature of the cooling wind C discharged from the duct 18 differs between the left and right regions. Thus, the temperature of the cooling wind C discharged from the left and right exhaust ports 21*a*, 21*b* and the temperature of both side surface walls 22*b*, 22*e* and the bottom surface plate 22*c* also become uneven between the left and the right.

Therefore, if the amount of heat generation of the heat generating component 16 in the duct 18 is asymmetric with respect to the center line X, the tilt angle, the shape, and the number of the flow path guiding plates 31*e*, 31*f* are preferably adjusted so that the heat quantity of the cooling wind C flowing to the second exhaust flow path 34 and the third exhaust flow path 40 is substantially equal. For instance, the tilt angle of the flow path guiding plates 31*e*, 31*f* is adjusted so that the cooling wind C discharged from the left and right regions of the duct 18 are both directed to the central portion of the first exhaust flow path 32 (portion near center line X in which center axis direction in induction cooking appliance is front and back direction). At least one part of the cooling wind C is mixed at the central portion of the first exhaust flow path 32 by adjusting the tilt angle of the flow path guiding plates 31*e*, 31*f* in such manner. Thereafter, the cooling wind is separated to each direction of the second exhaust flow path 34 and the third exhaust flow path 35, and flowed to the second exhaust flow path 34 and the third exhaust flow path 35. According to such configuration, the temperature difference of the cooling wind C divided to the left and the right can be alleviated.

Fifth Embodiment

Figure 7:
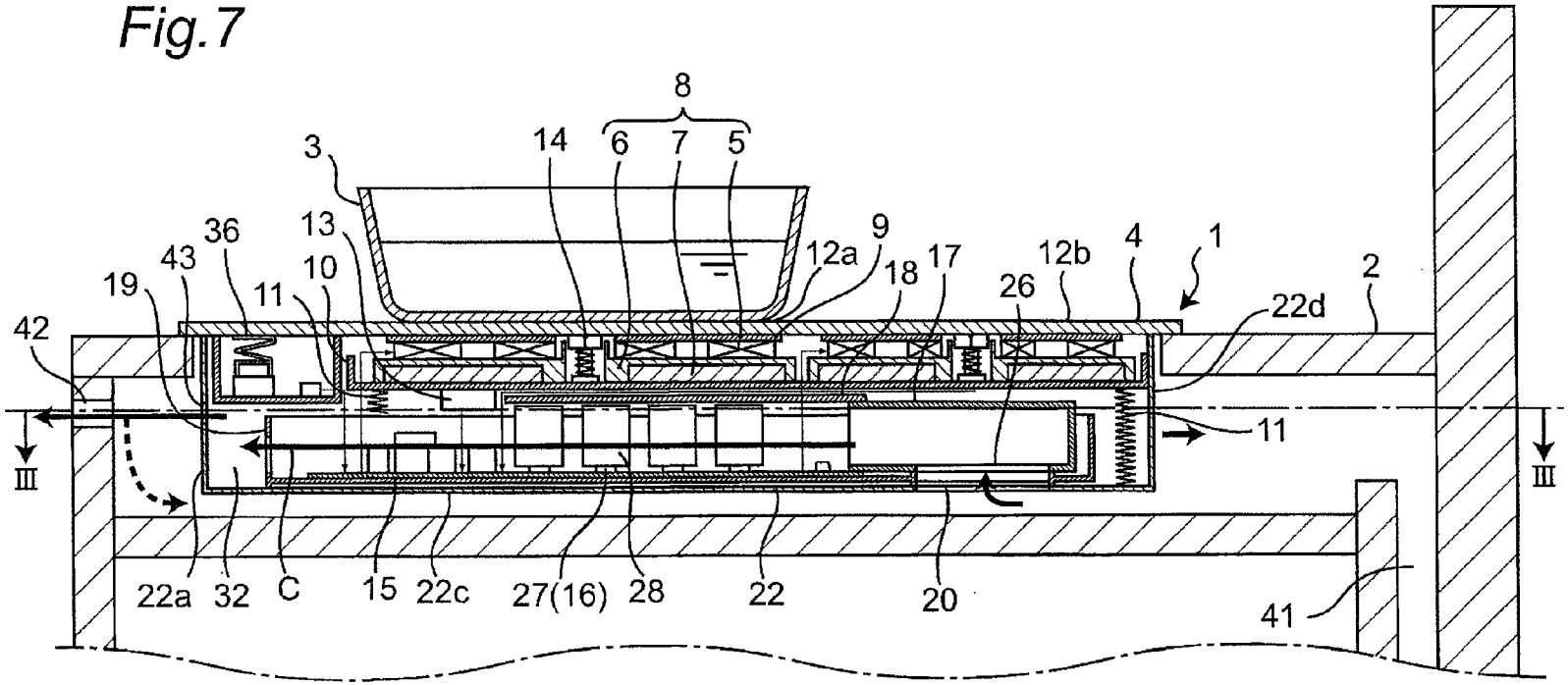
FIG. 7 is a horizontal cross-sectional view showing an internal configuration of an induction cooking appliance of a fifth embodiment according to the present invention.

An induction cooking appliance according to a fifth embodiment of the present invention will be hereinafter described with reference to the accompanied drawings. FIG. 7 is a cross-sectional view of the main parts in a state the induction cooking appliance according to the fifth embodiment of the present invention is installed in the kitchen cabinet. In the induction cooking appliance of the fifth embodiment, the basic configuration is the same as the induction cooking appliance of the first embodiment described above, and thus the different aspect will be centrally described. In the following description of the fifth embodiment, the same reference numerals are denoted on the configuring elements having the same functions and configurations as the configuring elements in the induction cooking appliance 1 of the first embodiment, so that the detailed description thereof is omitted and the description of the first embodiment is applied.

In the kitchen cabinet 2 in which the induction cooking appliance of the fifth embodiment is installed, a first air vent 41 is formed on the rear surface side and a second air vent 42 is formed on the near side to carry out ventilation between the interior and the exterior. A vent hole 43 communicating the internal space of the kitchen cabinet 2 and the internal space of the main case 22 is formed in the front surface wall 22*a* of the main case 22 of the induction cooking appliance. The opening area of the vent hole 43 is substantially the same as the second air vent 42 in the kitchen cabinet 2, and the vent hole 43 is arranged substantially facing the second air vent 42.

In the induction cooking appliance of the fifth embodiment, the internal configuration of the sub-case 19 and the exhaust flow path configuration (first exhaust flow path 32 and second exhaust flow path 34) are the same as the induction cooking appliance 1 of the first embodiment shown in FIG. 3 as described above.

The operation in the induction cooking appliance of the fifth embodiment configured as above will now be described.

In the induction cooking appliance of the fifth embodiment, the operation is the same as that in the induction cooking appliance of the first embodiment regarding the flow of the cooling wind C from the interior of the sub-case 19 to the first exhaust flow path 32.

One part of the cooling wind C that reached the first exhaust flow path 32 is discharged to the interior of the kitchen cabinet 2 through the vent hole 43. The remaining cooling wind C that reached the first exhaust flow path 32 has the direction changed 180 degrees by passing the first exhaust flow path 32 and the second exhaust flow path 34, and is discharged from the exhaust port 21 arranged on the left side in the rear surface wall 22*d* of the main case 22.

As described above, at least the majority of the cooling wind C that reached the first exhaust flow path 32 is flowed to the second exhaust flow path 34, and is rectified to the flow having the flow vector in the direction from the near side to the rear surface side as the main stream while flowing through the second exhaust flow path 34. Therefore, the cooling wind C is grown to a flow speed of a certain extent when discharged from the exhaust port 21, and becomes a flow in which the direction is clearly defined as being from the near side to the rear surface side of the induction cooking appliance. The direction of the flow exhausted from the exhaust port 21 is the direction of moving away from the intake port 20, and hence the air exhausted and heated from the exhaust port 21 is less likely to be taken in from the intake port 20, and hence the cooling performance is enhanced.

The cooling performance of the induction cooking appliance enhances as the exhaust amount of the exhaust port 21 formed on the rear surface wall 22*d* of the main case 22 becomes greater than the exhaust amount of the vent hole 43 formed on the front surface wall 22*a* of the main case 22.

As described above, in the induction cooking appliance of the fifth embodiment, one part of the cooling wind C flowing in the sub-case 19 traverses the first exhaust flow path 32, and is exhausted through the vent hole 43 or the gap formed in the front surface wall 22*a* of the main case 22.

In the configuration of the fifth embodiment, the second air vent 42 of the kitchen cabinet 2 is formed at a position facing the vent hole 43 of the main case 22. Thus, the majority of the cooling wind C discharged from the vent hole 43 is discharged to the outside of the kitchen cabinet 2 through the second air vent 42. Therefore, when the cooling wind C exhausted from the vent hole 43 hits the front surface wall of the kitchen cabinet 2 to have the direction changed to remain inside the kitchen cabinet 2 without being discharged to the outside of the kitchen cabinet 2, the amount of the remained cooling wind becomes a minimum.

As described above, in the configuration of the fifth embodiment, the induction cooking appliance is installed in the kitchen cabinet 2 so that the second air vent 42 of the kitchen cabinet 2 is arranged at a position facing the vent hole 43 of the main case 22, and hence the cooling wind C exhausted from the vent hole 43 is discharged to the outside from the second air vent 42. Therefore, the cooling wind C to be taken in again from the intake port 20 becomes a minimum for the entire cooling wind C discharged from the induction cooking appliance, and the cooling performance can be enhanced.

In the configuration of the fifth embodiment, the vent hole 43 formed in the main case 22 is always opened, but is not limited thereto, and the shielding plate that can completely shield the vent hole 43 may be attached from the outer side of the main case.

With the configuration capable of shielding the vent hole 43, the necessity of attachment of the shielding plate can be determined according to the specification of the kitchen cabinet 2 when installing the induction cooking appliance in the kitchen cabinet 2. In other words, in the specification in which the second air vent 42 is opened on the near side in the kitchen cabinet 2, the vent hole 43 and the second air vent 42 are communicated without attaching the shielding plate, so that one part of the cooling wind C can be discharged to the outside of the kitchen cabinet 2 through the second air vent 42 as in the configuration of the fifth embodiment. As a result, the induction cooking appliance has an intake—exhaust configuration in which the exhausted cooling wind C is less likely to be again taken in from the intake port 20.

In the specification of the kitchen cabinet 2 in which the air vent is not arranged on the near side of the kitchen cabinet 2 and the first air vent 41 is formed only on the rear surface side of the kitchen cabinet 2 so that the ventilation of the interior and the exterior of the kitchen cabinet 2 is carried out, response can be made by blocking the vent hole 43 with the shielding plate. All the cooling wind C is discharged from the exhaust port 21 arranged on the rear surface wall 22*d* to become the exhaust air in which the flowing direction to the back side is definite by blocking the vent hole 43 with the shielding plate. Therefore, the induction cooking appliance has an intake—exhaust configuration in which the exhausted cooling wind C is less likely to be again taken in from the intake port 20.

In the configuration of the fifth embodiment, installation can be made to the kitchen cabinet having various ventilation configurations, and thus a highly versatile induction cooking appliance can be obtained.

Furthermore, the shielding plate may be fixed at a plurality of different positions so that the opening area and the opening position of the vent hole 43 can be adjusted. The versatility with respect to the kitchen cabinet to which installation can be made can be further enhanced by configuring such that the opening area and the opening position of the vent hole 43 can be adjusted.

Sixth Embodiment

Figure 8:
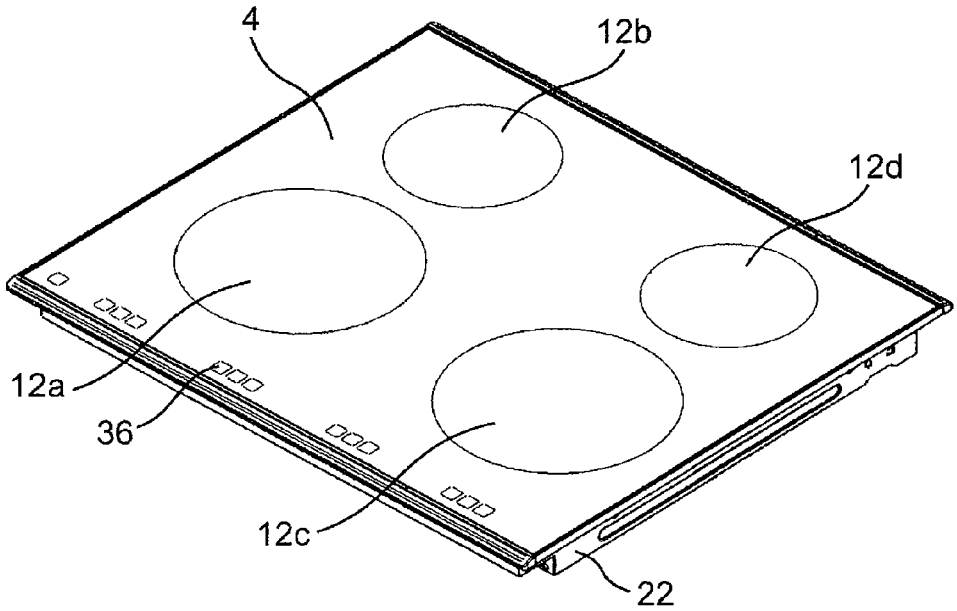
FIG. 8 is a perspective view showing an overall induction cooking appliance of a sixth embodiment according to the present invention.
Figure 9:
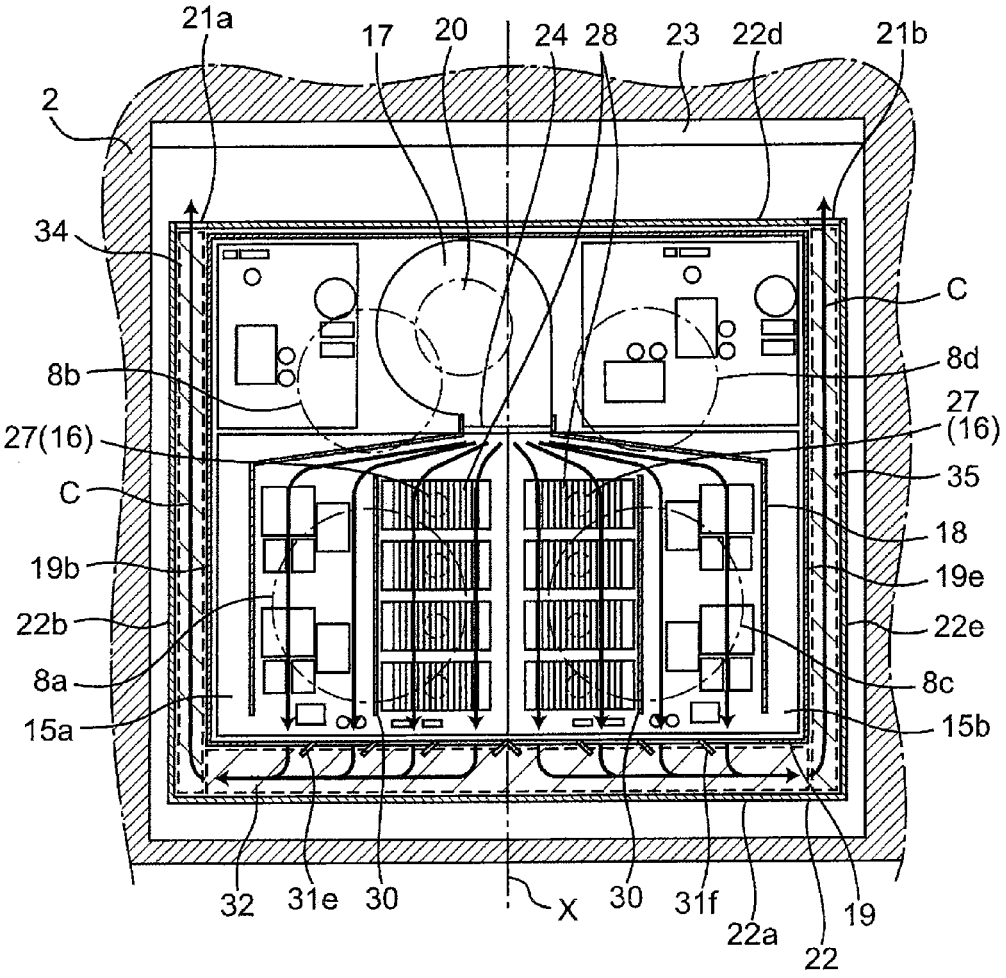
FIG. 9 is a horizontal cross-sectional view showing an internal configuration of the induction cooking appliance of the sixth embodiment according to the present invention.

An induction cooking appliance according to a sixth embodiment of the present invention will be hereinafter described with reference to the accompanied drawings. FIG. 8 is a perspective view showing an entire induction cooking appliance of the sixth embodiment of the present invention. FIG. 9 is a horizontal cross-sectional view showing an internal configuration of the induction cooking appliance of the sixth embodiment of the present invention. The induction cooking appliance of the sixth embodiment has a configuration of including four heating regions, but the basic configuration is the same as the induction cooking appliance of the fourth embodiment shown in FIG. 6. In the following description of the sixth embodiment, the same reference numerals are denoted on the configuring elements having the same functions and configurations as the configuring elements in the induction cooking appliance of the first embodiment and the fourth embodiment, so that the detailed description thereof is omitted and the description of the first embodiment and the fourth embodiment is applied.

As shown in FIG. 8, four heating regions 12*a*, 12*b*, 12*c*, 12*d* are formed in the top plate 4, and coil units 8*a*, 8*b*, 8*c*, 8*d* are respectively arranged immediately below each heating region 12*a*, 12*b*, 12*c*, 12*d* in correspondence with each heating region 12*a*, 12*b*, 12*c*, 12*d*.

In the internal configuration of the induction cooking appliance shown in FIG. 9, the control circuit 15*a*, 15*b* is roughly divided to the left side region and the right side region. The two coil units 8*a*, 8*b* at the front and the back corresponding to the two heating regions 12*a*, 12*b* on the left side are controlled with the control circuit 15*a* of the left side region, and the two coil units 8*c*, 8*d* at the front and the back corresponding to the two heating regions 12*c*, 12*d* on the right side are controlled with the control circuit 15*b* of the right side.

The intake port 20 is formed at substantially the middle on the rear surface side in the bottom surface plate 22*c* of the main case 22. The suction port of the blower device 17 is formed at a position facing the intake port 20. The left and right control circuits 15*a*, 15*b* and the blower device 17 are arranged inside one sub-case 19.

The duct 18 is arranged so as to guide the cooling wind C with respect to each heat generating component 16 in the left and right control circuits 15*a*, 15*b* from the blower device 17. In the heat generating component 16 in the control circuit 15*a*, 15*b*, in particular, the switching element (IGBT) 27 having a large amount of heat generation is joined to the heat sink 28 to further enhance the cooling performance and is arranged on the central side to further enhance the cooling performance. As shown in FIG. 9, the switching element 27 joined to the heat sink 28 in each left and right control circuit 15*a*, 15*b* are both arranged on the central side, and are arranged at positions relatively close from the blowing port 24 of the blower device 17. In the configuration of the sixth embodiment, the mounting configuration of the left and right control circuits 15*a*, 15*b* is symmetrically arranged with respect to the center line X (refer to FIG. 9) in which the center axis in the induction cooking appliance is the front and back direction.

Therefore, the arrangement of the heat generating component 16 such as the switching element (IGBT) 27 and the resonance capacitor 29 in the control circuit 15*a*, 15*b* is substantially symmetric with respect to the center line X.

In the configuration of the sixth embodiment, the center of the blowing port 24 of the blower device 17 is arranged on the center line X, and the duct 18 continuing to the blowing port 24 of the blower device 17 is arranged symmetric with respect to the center line X. Furthermore, two branched plates 30 are arranged substantially symmetric with respect to the center line X on the inner side of the duct 18, and the duct 18 and the branched plate 30 are arranged such that the cooling wind C from the blower device 17 highly efficiently contacts the switching element 27 joined to the heat sink 28 in the left and right control circuits 15*a*, 15*b*.

As shown in FIG. 9, in the induction cooking appliance of the sixth embodiment, the cooling wind C from the blower device 17 arranged at substantially the middle on the rear surface side is guided by the duct 18 to cool the heat generating components 16 and the like and flow into the first exhaust flow path 32. The cooling wind C that reached the first exhaust flow path 32 is divided to the left and the right and then flowed, and respectively flows through the second exhaust flow path 34 and the third exhaust flow path 35. The second exhaust flow path 34 is a flow path formed between the left side surface wall 19*b* of the sub-case 19 and the left side surface wall 22*b* of the main case 22. The third exhaust flow path 35 is a flow path formed between the right side surface wall 19*e* of the sub-case 19 and the left side surface wall 22*e* of the main case 22. The respective ends on the rear surface side of the second exhaust flow path 34 and the third exhaust flow path 35 are the exhaust ports 21*a*, 21*b*, which exhaust ports 21*a*, 21*b* are formed at the left and right ends of the rear surface wall 22*d* of the main case 22.

A plurality of flow path guiding plates 31*e*, 31*f* is arranged in a region where the flow of the cooling wind C is bent substantially 90 degrees when the cooling wind C flows into the first exhaust flow path 32 from the interior of the sub-case 19. The flow path guiding plates 31*e*, 31*f* are arranged inclined by substantially 45 degrees with respect to the direction of the flow from the rear surface side to the near side of the induction cooking appliance, so that the cooling wind C from the sub-case 19 is smoothly bent substantially 90 degrees. The plurality of flow path guiding plates 31*e*, 31*f* are arranged at the open portion of the front surface wall 19*a* of the sub-case 19, where the flow path guiding plate 31*e* of the left side region and the flow path guiding plate 31*f* of the right side region are inclined in different directions. The flow path guiding plate 31*e* of the left side region is inclined to flow the majority of the cooling wind C that cooled the control circuit 15*a* on the left side in the sub-case 19 to the second exhaust flow path 34 in the left side. The flow path guiding plate 31*f* of the right side region is inclined to flow the majority of the cooling wind C that cooled the control circuit 15*b* on the right side in the sub-case 19 to the third exhaust flow path 35 in the right side.

The second exhaust flow path 34 and the exhaust port 21*a* on the left side are communicated, and the third exhaust flow path 35 and the exhaust port 21*b* on the right side are communicated. The left and right exhaust ports 21*a*, 21*b* are arranged to be substantially symmetric with respect to the center line X in which the center axis direction in the induction cooking appliance becomes the front and back direction.

In the induction cooking appliance of the sixth embodiment, the front surface wall 22*a* of the main case 22 is arranged in the wind direction of the cooling wind C sent from the blower device 17 arranged on the rear surface side to the control circuits 15*a*, 15*b*. The first exhaust flow path 32 is configured by the front surface wall 22*a*. The second exhaust flow path 34 is configured by the left side surface wall 22*b* of the main case 22, and the third exhaust flow path 35 is configured by the right side surface wall 22*e*. The intake port 20 is arranged at substantially the middle on the rear surface side in the bottom surface plate 22*c* of the main case 22, and the exhaust ports 21*a*, 21*b* are arranged on both sides of the rear surface wall 22*d* of the main case 22. In the configuration of the sixth embodiment, the front surface wall 22*a* of the main case 22 corresponds to the first side surface wall, the left side surface wall 22*b* of the main case 22 corresponds to the second side surface wall, and the right side surface wall 22*e* of the main case 22 corresponds to the third side surface wall.

The operation in the induction cooking appliance of the sixth embodiment configured as above will now be described.

In the induction cooking appliance of the sixth embodiment, the cooling wind C from the blower device 17 arranged on the rear surface side at substantially the middle is guided by the duct 18 to cool each heat generating component 16 of the control circuit 15*a*, 15*b*, and is flowed to the first exhaust passage 32 through the opening of the front surface wall 19*a* of the sub-case 19.

A plurality of flow path guiding plates 31*e*, 31*f* inclined with respect to the flowing direction of the cooling wind C in the sub-case 19 are arranged at the opening of the front surface wall 19*a* of the sub-case 19. At the opening of the front surface wall 19*a* of the sub-case 19, the flow path guiding plate 31*e* on the left side arranged in the left region from substantially the middle is arranged inclined by substantially 45 degrees to the left with respect to the flowing direction from the rear surface side to the near side in the sub-case 19 so that the cooling wind C from the sub-case 19 flows in the left direction through the first exhaust flow path 32.

On the other hand, the flow path guiding plate 31*f* on the right side arranged in the right region from substantially the middle at the opening of the front surface wall 19*a* is arranged inclined by substantially 45 degrees to the right with respect to the flowing direction from the rear surface side to the near side in the sub-case 19 so that the cooling wind C from the sub-case 19 flows in the right direction through the first exhaust flow path 32. The branched position of the flow path guiding plate 31*e* on the left side and the flow path guiding plate 31*f* on the right side is on the center line X in which the center axis direction in the induction cooking appliance is the front and back direction.

Since the plurality of flow path guiding plates 31*e*, 31*f* are arranged at the opening of the front surface wall 19*a* of the sub-case 19, the cooling wind C exhausted from the opening of the front surface wall 19*a* of the sub-case 19 is smoothly divided to the left and the right, and flowed through the first exhaust flow path 32.

As described above, in the configuration of the sixth embodiment, the cooling wind C smoothly flows to the left and the right through the first exhaust flow path 32 from the sub-case 19 to be guided to the second exhaust flow path 34 on the left side and the third exhaust flow path 35 on the right side. The cooling wind C in the second exhaust flow path 34 and the third exhaust flow path 35 is flowed from the near side to the rear surface side of the induction cooking appliance, and exhausted backward from the respective exhaust port 21*a*, 21*b*.

The cooling wind C flowing through the second exhaust flow path 34 and the third exhaust flow path 35 has the disturbance in the flow suppressed, and the flow vector towards the back side becomes the mainstream. Thus, the flow of air exhausted from each exhaust port 21*a*, 21*b* through the second exhaust flow path 34 and the third exhaust flow path 35 grows to a greater flow speed. As the cooling wind C flows through the second exhaust flow path 34 and the third exhaust flow path 35, the wind is exhausted such that the flowing direction is clearly defined from the near side to the rear surface side in the induction cooking appliance. Thus, the air exhausted and heated from the exhaust ports 21*a*, 21*b* on both end sides of the rear surface 22*d* of the main case 22 is prevented from being taken in again from the intake port 20 at the central portion of the main case 22, and hence the cooling performance is enhanced.

In the induction cooking appliance of the sixth embodiment, the exhausting direction from the exhaust port 21*a*, 21*b* is the direction on the rear surface side in the kitchen cabinet 2, and thus the exhausted cooling wind C is led to the air vent 23 formed on the rear surface side of the kitchen cabinet 2 as is. Therefore, the cooling wind C exhausted from the exhaust ports 21*a*, 21*b* of the induction cooking appliance is less likely to be taken in again from the intake port 20 of the induction cooking appliance.

In the induction cooking appliance of the sixth embodiment, the control circuits 15*a*, 15*b* each including the heat generating component 16 are separately arranged in the left and right regions, respectively. In such configuration, the respective heat generating component 16 is intensively arranged on the central side so as to be cooled by the cooling wind C from the one blower device 17 arranged at the central portion. Thus, in the induction cooking appliance of the sixth embodiment, the respective heat generation component 16 in the two control circuits 15*a*, 15 is cooled by the cooling wind C taken in from the one intake port 20 formed in the bottom surface plate 22, and the cooling wind is exhausted from the exhaust ports 21*a*, 21*b* on both sides of the rear surface wall 22*d*. Therefore, in the configuration of the sixth embodiment, the distance between the exhaust ports 21*a*, 21*b* arranged at both ends of the rear surface wall 22*d* and the intake port 20 becomes long and the exhaust air from the exhaust ports 21*a*, 21*b* are less likely to be taken in again from the intake port 20 compared to the configuration in which the intake port and the blower device corresponding thereto are arranged for each left and right control circuit.

In the configuration of the sixth embodiment, the space can be saved since the blower device 17 can be collected to one. As the blower device 17 can be collected to one, the intake port 20 can be designed large, and the blower device 17 of large diameter can be adopted. As a result, the amount of cooling wind can be increased and the cooling performance can be enhanced in the induction cooking appliance of the sixth embodiment.

In the induction cooking appliance of the sixth embodiment, a configuration in which a total of four heating regions 12*a*, 12*b*, 12*c*, 12*d*, two in the region on the left side and two in the region on the right side, is arranged has been described, but the number of heating regions is not limited to the number in the sixth embodiment, and three heating regions may be arranged. In such a case, three heating regions may be arranged as a whole with either one of the left or right region as one heating region, or two may be arranged in the region on the near side of the top plate 4 and one may be arranged at substantially the middle in the region on the rear surface side so as to be substantially symmetric with respect to the center line X in which the center axis direction in the induction cooking appliance becomes the front and back direction.

In the induction cooking appliance of the present invention, five or more heating regions may be arranged by further adding the control circuit and the like. In this case as well, a configuration in which a guide or the like is arranged by the one blower device to cool the heat generating component in the entire control circuit so as to be exhausted from the exhaust port on both sides of the rear surface wall through the exhaust flow path is preferable.

Seventh Embodiment

Figure 10:
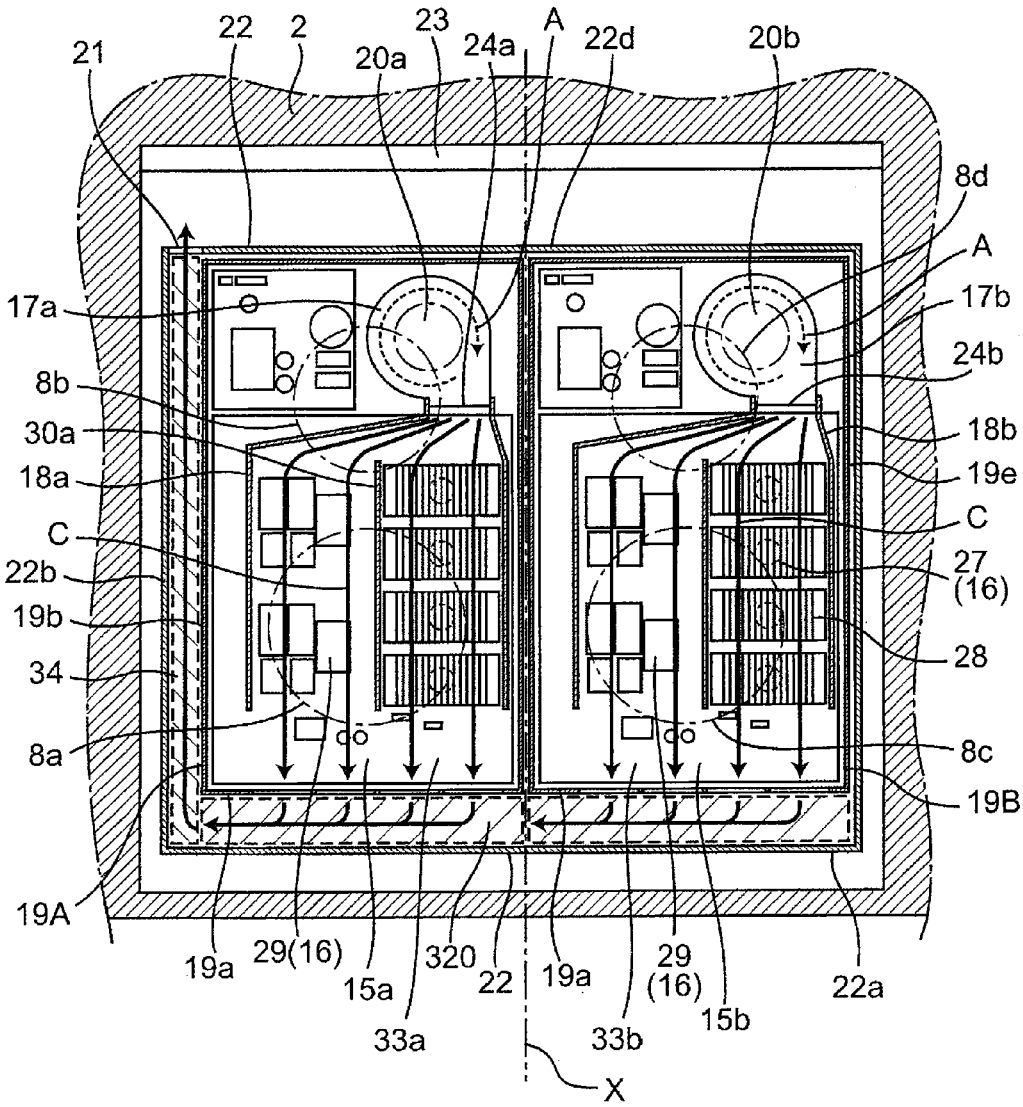
FIG. 10 is a horizontal cross-sectional view showing an internal configuration of an induction cooking appliance of a seventh embodiment according to the present invention.

An induction cooking appliance according to a seventh embodiment of the present invention will be hereinafter described with reference to the accompanied drawings. FIG. 10 is a horizontal cross-sectional view showing an internal configuration of the induction cooking appliance according to the seventh embodiment of the present invention. The induction cooking appliance of the seventh embodiment includes four heating regions 12*a*, 12*b*, 12*c*, 12*d* as in the sixth embodiment shown in FIG. 8. Furthermore, the induction cooking appliance of the seventh embodiment has a configuration in which two sets of sub-case 19 in the induction cooking appliance 1 (refer to FIG. 3) of the first embodiment described above are arranged side by side. The internal configuration of each sub-case 19A, 19B is the same as the sub-case 19 in the induction cooking appliance 1 of the first embodiment. In the following description of the seventh embodiment, the same reference numerals are denoted on the configuring elements having the same functions and configurations as the configuring elements in the induction cooking appliance of the first embodiment and the sixth embodiment, so that the detailed description thereof is omitted and the description of the first embodiment and the sixth embodiment is applied.

In the induction cooking appliance of the seventh embodiment, four heating regions 12*a* (near side of left region), 12*b* (rear surface side of left region), 12*c* (near side of right region), 12*d* (rear surface side of right region) are formed in the top plate 4, as in the sixth embodiment shown in FIG. 8. In correspondence with the heating regions 12*a*, 12*b*, 12*c*, 12*d*, four coil units 8*a* (near side of left region), 8*b* (rear surface side of left region), 8*c* (near side of right region), 8*d* (rear surface side of right region) are formed immediately below the top plate 4 (shown with chain dashed line in FIG. 10). Each coil unit 8*a*, 8*b*, 8*c*, 8*d* is configured to include the heating coil 5, the coil base 6, the ferrite 7, and the mica plate, as described in the first embodiment (refer to FIG. 2).

The coil units 8*a*, 8*b* of the left region are mounted on the radiator plate of the left region, and the coil units 8*c*, 8*d* of the right region are mounted on the radiator plate of the left region. In the configuration of the seventh embodiment, the surface area of the radiator becomes wider and hence the cooling performance is enhanced by commonly using the radiator plate by a plurality of coil units 8*a*, 8*b* and 8*c*, 8*d*. The assembly property enhances and the space can be saved since the supporting member for supporting the coil units 8*a*, 8*b*, 8*c*, 8*d* through the radiator plate can be reduced.

In the induction cooking appliance of the seventh embodiment, the infrared sensor 13 is arranged below each heating region 12*a*, 12*c* arranged on the near side (refer to FIG. 2). The infrared sensor 13 is arranged at a position to become the lower side of the bottom surface of the cooking container 3 or the to-be-heated object mounted on the heating regions 12*a*, 12*c*. The infrared sensor 13 detects the infrared light radiated from the bottom surface of the cooking container 3 through the top plate 4, and outputs a temperature detection signal corresponding to the temperature of the bottom surface of the cooking container 3.

In the induction cooking appliance of the seventh embodiment, the thermistor 14 is arranged at each position facing substantially the central portion of the bottom surface of the cooking container 3 mounted on the heating regions 12*a*, 12*b*, 12*c*, 12*d* so as to be pushed against the back surface of the top plate 4 (refer to FIG. 2). The temperature of the top plate 4 facing the bottom surface of each cooking container 3 is detected by the thermistor 14, and the temperature detection signal corresponding to the detection temperature is output.

Inside the induction cooking appliance of the seventh embodiment, the control circuits 15*a*, 15*b* for drive controlling the heating coil 5 in the coil units 8*a*, 8*b*, 8*c*, 8*d* based on signals such as the temperature detection signal output from the infrared sensor 13 and the thermistor 14, and the output setting signal set at the operation portion 36 by the user are arranged in the vicinity of the infrared sensor 13 and the thermistor 14.

The control circuits 15*a*, 15*b* inside the induction cooking appliance respectively includes the heat generating component 16 such as the switching element 27 and the resonance capacitor 28. Two blower devices 17*a*, 17*b* for cooling the heat generating components 16, and ducts 18*a*, 18*b* for guiding the respective cooling wind C from the blower devices 17*a*, 17*b* to the heat generating component 16 of the control circuits 15*a*, 15*b* are arranged inside the induction cooking appliance. The blower devices 17*a*, 17*b* and the ducts 18*a*, 18*b* are accommodated inside the resin box-shaped sub-cases 19A, 19B having the upper side opened.

In the induction cooking appliance of the seventh embodiment, a sirocco fan is adopted for the blower devices 17*a*, 17*b*. The rotating direction of the sirocco fan is the clockwise direction when seen from the vertically upward direction, as shown with an arrow A in FIG. 10.

The internal space in the induction cooking appliance of the seventh embodiment is formed by the top plate 4 that becomes the upper surface, and the resin main case 22 arranged below the top plate 4 and configured by the side surface walls on four sides and the bottom surface plate.

The intake ports 20*a*, 20*b* and the exhaust port 21 for taking in and exhausting the air with respect to the internal space in the induction cooking appliance are provided on the rear surface side of the main case 22. The intake ports 20*a*, 20*b* and the exhaust port 21 of the main case 22 are opened to the internal space of the kitchen cabinet 2. An elongate air vent 23 is formed along the rear surface side in the internal space of the kitchen cabinet 2. Therefore, the intake ports 20*a*, 20*b* and the exhaust port 21 of the main case 22 are in a communicable state so as to obtain a smooth air flow with respect to the air vent 23. Therefore, the pressure loss that occurs when the cooling wind C is taken in by the intake ports 20*a*, 20*b* is reduced.

In the induction cooking appliance of the seventh embodiment, the intake ports 20*a*, 20*b* formed in the bottom surface plate of the main case 22 and each sub-case 19A, 19B are formed in the right side region on the rear surface side in each bottom surface plate. The exhaust port 21 is formed at the left end of the rear surface wall 22*d* of the main case 22 covering the two sub-cases 19A, 19B. The inlet port 26 (refer to FIG. 2) of the blower device 17*a*, 17*b* is arranged at a position facing each intake port 20*a*, 20*b* inside the main case 22.

In the internal space of the induction cooking appliance of the seventh embodiment, each control circuit 15*a*, 15*b* is arranged in the space on the near side than the position formed with the intake port 20*a*, 20*b*. The switching element (IGBT) 27 etc. having a large amount of heat generation among the heat generating components 16 of the control circuits 15, 15*b* are arranged at a position relatively close from a blowing ports 24*a*, 24*b* of the blower devices 17*a*, 17*b*.

The cooling wind C from each blowing port 24*a*, 24*b* of the blower device 17*a*, 17*b* is guided to a predetermined cooling space by the duct 18*a*, 18*b*, and the heat generating component 16 of the control circuit 15*a*, 15*b* such as the switching element (IGBT) 27 and the resonance capacitor 29, as well as the infrared sensor 13 are arranged in the cooling space formed by the duct 18*a*, 18*b*. Branched plates 30*a*, 30*b* are arranged in the duct 18*a*, 18*b*, so that the cooling wind C from the blowing port 24*a*, 24*b* of each blower device 17*a*, 17*b* reliably makes contact with each component in the duct 18*a*, 18*b* to reliably cool each component to a desired temperature.

The cooling wind C that cooled each component in the duct 18*a*, 18*b* is discharged from the duct 18*a*, 18*b*, and then cools each radiator plate, which partitions the upper space in which the heating coil 5 etc. are arranged and the lower space in which the control circuit 15*a*, 15*b* etc. are arranged. A cooling wind detection thermistor (not shown) is arranged in the vicinity of the blowing port 24*a*, 24*b* of the blower device 17*a*, 17*b*. A cooling wind temperature detection signal indicating the temperature of the cooling wind C detected by the cooling wind detection thermistor is input to the control circuit 15*a*, 15*b*. When detection is made that the temperature of the cooling wind C exceeded a predetermined temperature, the control circuit 15*a*, 15*b* controls the output to the corresponding heating coil 5 and controls the suppression of heat generation of the electronic components.

As described above, in the induction cooking appliance of the seventh embodiment, a first induction heating block 33*a* including the first sub-case 19A and a second induction heating block 33*b* including the second sub-case 19B are arranged inside the main case 22.

In the first induction heating block 33*a*, the two coil units 8*a*, 8*b* mounted on the radiator plate, the control circuit 15*a* for controlling the output of the coil units 8*a*, 8*b*, the duct 18*a* for guiding the cooling wind C to cool the heat generating component 16 and the like in the control circuit 15*a*, and the blower device 17*a* for forming the cooling wind C are arranged in the first sub-case 19A.

Similarly, in the second induction heating block 33*b*, the two coil units 8*c*, 8*d* mounted on the radiator plate, the control circuit 15*b* for controlling the output of the coil units 8*c*, 8*d*, the duct 18*b* for guiding the cooling wind C to cool the heat generating component 16 and the like in the control circuit 15*b*, and the blower device 17*b* for forming the cooling wind C are arranged in the second sub-case 19B.

The first induction heating block 33*a* and the second induction heating block 33*b* are arranged side by side in the main case 22, the control circuit 15*a*, 15*b* in each sub-case 19A, 19B has the same mounting configuration, and the flowing direction of the cooling wind C for cooling the control circuits 15*a*, 15*b* is the same direction.

As shown in FIG. 10, a predetermined distance is realized between a front surface wall 19*a* of the first sub-case 19A and a front surface wall 22*a* or the side surface wall on the near side of the main case 22, and a front surface exhaust flow path is formed. This front surface exhaust flow path is included in a first exhaust flow path 320. A predetermined distance is realized between a front surface wall 19*a* of the second sub-case 19B and a front surface wall 22*a* or the side surface wall on the near side of the main case 22, and a front surface exhaust flow path is formed. This front surface exhaust flow path is included in the first exhaust flow path 320. Therefore, the first exhaust flow path 320 is configured by the front surface exhaust flow path of the first sub-case 19A and the front surface exhaust flow path of the second sub-case 19B.

A predetermined distance is realized between a left side surface wall 19*b* of the first sub-case 19A and a left side surface wall 22*b* of the main case 22, and a left side surface exhaust flow path is formed. This left side surface exhaust flow path is a second exhaust flow path 34.

The operation portion 36 of the induction cooking appliance of the seventh embodiment has the same configuration as the operation portion 36 of the first embodiment, and is arranged on the near side of the top plate 4.

As the operation portion 36 is configured by an operation substrate and a touch switch, the length in the height direction of the operation portion 36 is formed relatively short. Thus, at least one part of the first exhaust flow path 320, which is the front surface exhaust flow path, is arranged below the operation portion 36.

In the seventh embodiment, the front surface wall 22*a* of the main case 22 is arranged in the wind direction of the cooling wind C sent from the blower device 17*a*, 17*b* to the control circuit 15*a*, 15*b*. The first exhaust flow path 320 is configured by the front surface wall 22*a*. The second exhaust flow path 34 is configured by the left side surface wall 22*b* of the main case 22. The intake ports 20*a*, 20*b* are formed on the rear surface side of the bottom surface plate 22*c* of the main case 22, and the exhaust port 21 is formed in the rear surface wall 22*d* of the main case 22. In the configuration of the seventh embodiment, the front surface wall 22*a* of the main case 22 corresponds to the first side surface wall, and the left side surface wall 22*b* of the main case 22 corresponds to the second side surface wall.

The operation in the induction cooking appliance of the seventh embodiment configured as above will now be described.

In the first induction heating block 33*a*, the cooling wind C taken in from the intake port 20*a* by the blower device 17*a* is blown out in the direction of the near side from the blower device 17*a* to cool the control circuit 15*a*. The cooling wind C blown out in the direction of the near side from the blower device 17*a* is guided by the duct 18*a* to cool each heat generating component 16 of the control circuit 15*a*. The cooling wind C that cooled each heat generating component 16 is flowed towards the direction of the near side as is, and passed through the vent hole of the front surface wall 19*a* of the first sub-case 19A to reach the first exhaust flow path 320, which is the front surface exhaust flow path.

In the second induction heating block 33*b*, the cooling wind C taken in from the intake port 20*b* by the blower device 17*b* is blown out in the direction of the near side from the blower device 17*b* to cool the control circuit 15*b*. The cooling wind C blown out in the direction of the near side from the blower device 17*b* is guided by the duct 18*b* to cool each heat generating component 16 of the control circuit 15*b*. The cooling wind C that cooled each heat generating component 16 is flowed towards the direction of the near side as is, and passed through the vent hole of the front surface wall 19*a* of the second sub-case 19B to reach the first exhaust flow path 320, which is the front surface exhaust flow path.

In the first exhaust flow path 320, the cooling wind C from the first induction heating block 33*a* and the second induction heating block 33*b* makes contact with the front surface wall 22*a* of the main case 22 so that the flow of the cooling wind C is bent substantially 90 degrees. As the right end of the first exhaust flow path 320 is closed, the cooling wind C is bent in the direction of the second exhaust flow path 34 or the left side surface exhaust flow path to reach the second exhaust flow path 34. In the second exhaust flow path 34, the cooling wind C is brought into contact with the left side surface wall 22*b* of the main case 22 to be further bent substantially 90 degrees, and is flowed along the second exhaust flow path 34 and discharged from the exhaust port 21 on the rear surface side.

When the cooling wind C is flowing along the second exhaust flow path 34 (left side surface exhaust flow path), the flow vector of the cooling wind C has the flow in the rear surface side direction as the main stream. Thus, the flow of air discharged from the exhaust port 21 at the rear surface wall 22*d* of the main case 22 is directed backward from the main case 22. In other words, the air discharged from the exhaust port 21 is exhausted in the direction the air vent 23 of the kitchen cabinet 2 is formed. The air passed through the second exhaust flow path 34 and discharged from the exhaust port 21 has a flow speed having a speed of a certain extent, and is an exhaust air in which the flowing direction is clearly defined as being exhausted backward from the exhaust port 21 of the main case 22. Therefore, the exhausting direction from the exhaust port 21 is a direction different from the direction in which the intake ports 20*a*, 20*b* formed in the bottom surface plate of the main case 22 are arranged, and is a direction of moving away from the intake port 20. Thus, in the configuration of the seventh embodiment, the air discharged from the exhaust port 21 is less likely to be taken in again from the intake ports 20*a*, 20*b*, and hence the cooling performance is greatly enhanced.

As the induction cooking appliance of the seventh embodiment configured as above is incorporated in the kitchen cabinet 2, the exhausting direction from the exhaust port 21 of the main case 22 is the rear surface side direction (backward) of the kitchen cabinet 2 in the internal space of the kitchen cabinet 2, and is the direction the air vent 23 is formed. Thus, the air discharged from the exhaust port 21 of the main case 22 is flowed to the air vent 23 of the kitchen cabinet 2 as is, and becomes an air flow that is less likely to be taken in again from the intake ports 20*a*, 20*b* of the main case 22 of the induction cooking appliance.

In the induction cooking appliance of the seventh embodiment, one part of the cooling wind C in both the first induction heating block 33*a* and the second induction heating block 35*b* mixes in the first exhaust flow path 32. The amount of heat generation in the respective control circuit 15*a*, 15*b* may differ such as when using only the heating region in either one of the induction heating block 33*a* or 33*b*, or when changing the load of each heating region in the respective induction heating block 33*a*, 35*b* and using the same. In such a case, the temperature rise of the cooling wind after cooling the control circuits 15*a*, 15*b* becomes different. However, in the induction cooking appliance of the seventh embodiment, one part of the cooling wind C in both the first induction heating block 33*a* and the second induction heating block 35*b* mixes in the first exhaust flow path 320. Thus, in the first exhaust flow path 320, the cooling wind C on the high temperature side and the cooling wind C on the low temperature side mix thus lowering the temperature on the high temperature side.

As described above, in the first exhaust flow path 320, the local heat generation in the main case 22 of the induction cooking appliance is suppressed as the function of uniforming the temperature of the cooling wind C is provided. Thus, in the configuration of the seventh embodiment, the temperature rise of the intake air is consequently suppressed since the local temperature rise inside the kitchen cabinet 2 is suppressed in the configuration of the seventh embodiment. Therefore, in the induction cooking appliance of the seventh embodiment, the high output heat cooking can be performed for a long time.

In the induction cooking appliance of the seventh embodiment, an extra obstacle is not arranged in the exhaust flow path, and hence the flow of the cooling wind C can be smoothly changed to the desired direction and the effect as the mixing region of the cooling wind C can be further enhanced.

A flow path guiding plate and the like may be separately arranged at the flow-in port of the first exhaust flow path 320 and the second exhaust flow path 34 of the cooling wind C. The flow of the cooling wind can be more smoothly bent by such flow path guiding plate, the pressure loss can be reduced, and the disturbance of the flow can be suppressed more. As a result, the flow of the exhaust air discharged from the exhaust port 21 grows to a greater flow speed, and becomes an exhaust air in which the flowing direction is clearly defined. Thus, the air discharged from the exhaust port 21 is less likely to be taken in again from the intake ports 20*a*, 20*b*, and the cooling performance can be enhanced.

In the induction cooking appliance of the seventh embodiment, the independent intake ports 20*a*, 20*b* and the blower devices 17*a*, 17*b* are arranged in correspondence with the respective control circuits 15*a*, 15*b*. Therefore, each blower device 17*a*, 17*b* can be miniaturized, and the flow path of the cooling wind C can be a relatively simple shape. Furthermore, the increase in pressure loss at the flow path of the cooling wind C can be suppressed. Thus, each blower device 17*a*, 17*b* can be further miniaturized, and the space can be saved in the induction cooking appliance as a whole.

According to the configuration of the seventh embodiment, the components and the like can be commonly used since the configuring elements for inductively heating can be blocked (induction heating block) with respect to a plurality of heating regions. Even if the number of heating regions is increased in correspondence with a wide kitchen space, this can be easily responded by increasing the induction heating blocks.

The cooling wind C taken in from the intake ports 20*a*, 20*b* of the main case 22 is flowed forward after cooling the control circuits 15*a*, 15*b* and the like in each sub-case 19A, 19B, and passed through the first exhaust flow path 320 and the second exhaust flow path 34 to be exhausted from the exhaust port 21. The flow path of the cooling wind C is thus bent in the clockwise direction by substantially 180 degrees when viewed from the vertically upward direction. Thus, in the configuration of the seventh embodiment, the pressure loss may occur at the bent portion of the exhaust flow path, the number of rotations of the blower devices 17*a*, 17*b* may drop, the flow rate of the cooling wind C may reduce, and the cooling performance may lower.

However, in the configuration of the seventh embodiment, the sirocco fan is used as the blower device 17*a*, 17*b*, so that the flow of the cooling wind C blown out from the sirocco fan has a vector component in the rotating direction same as the clockwise direction, which is the rotating direction of the sirocco fan.

Therefore, in the induction cooking appliance of the seventh embodiment, the exhaust flow path that bends the flow of the cooling wind C in the rotating direction same as the vector component of the cooling wind C blown out from the sirocco fan is formed. The cooling wind C thus flows along the exhaust flow path to reach the exhaust port 21. Therefore, even with the configuration including the bent portion where the exhaust flow path of the cooling wind C greatly bends the flow substantially 180 degrees as in the induction cooking appliance of the seventh embodiment, the disturbance of air flow at the bent portion where the flow path is bent is small, the pressure loss of the entire flow path can be reduced, and the reduction in the flow rate of the cooling wind C can be greatly suppressed. Furthermore, according to the configuration of the induction cooking appliance of the seventh embodiment, the disturbance of the flow in the exhaust flow path is reduced and thus the noise generated from the disturbance of the flow is reduced.

Moreover, in the kitchen cabinet 2 arranged with the induction cooking appliance of the seventh embodiment, the air vent 23 communicating the interior and the exterior of the kitchen cabinet 2 is not arranged on the near side nor the upper surface side of the kitchen cabinet 2, and is arranged only on the rear surface side of the kitchen cabinet 2 where the intake ports 20*a*, 20*b* and the exhaust port 21 of the induction cooking appliance are arranged. Therefore, the ventilation operation of the interior and the exterior of the kitchen cabinet 2 of the cooling wind C in the induction cooking appliance becomes smooth through the interior of the kitchen cabinet 2 by arranging the air vent 23 communicating the interior and the exterior of the kitchen cabinet 2 on the rear surface side. A comfortable operation and cooking can be carried out without the ventilation wind directly hitting the user by arranging the induction cooking appliance of the seventh embodiment in the kitchen cabinet 2.

In the induction cooking appliance of the seventh embodiment, the intake ports 20*a*, 20*b* and the exhaust port 21 are arranged on the rear surface side, and the open portion does not need to be formed on the upper surface of the kitchen cabinet 2. Thus, water vapor, oil smoke and the like are less likely to enter inside the kitchen cabinet 2 and the induction cooking appliance, and the wind noise when taking in and exhausting air is reduced.

In the induction cooking appliance of the seventh embodiment, the opening such as the intake ports 20*a*, 20*b* and the exhaust port 21 are not formed in the top plate 4, and thus the degree of freedom in design of the top plate 4 is enhanced.

In the induction cooking appliance of the seventh embodiment, the air on the lower side in the kitchen cabinet 2 having a relatively low temperature can be taken in since the intake ports 20*a*, 20*b* are arranged in the bottom surface plate 22*c* of the main case 22. Since the exhaust port 21 is formed at the left end in the rear surface wall 22*d* instead of the bottom surface plate 22*c* of the main case 22, the high temperature exhaust air is discharged to the rear surface side of the kitchen cabinet 2 and the intake—exhaust configuration in which the air is less likely to be taken in again from the intake ports 20*a*, 20*b* is realized.

A shielding plate for shielding the intake ports 20*a*, 20*b* and the exhaust port 21 of the induction cooking appliance is arranged inside the kitchen cabinet 2 to more reliably prevent the re-taking.

In the induction cooking appliance of the seventh embodiment, an example in which the exhaust port 21 is formed near the left side surface wall 22*b* of the rear surface wall 22*d* has been described, but the present invention is not limited thereto. For instance, similar effects can be obtained even if formed on the rear surface side of the bottom surface plate 22*c* or the rear surface side of the left side surface wall 22*b* in the second exhaust flow path 34. The second exhaust flow path 34 and the exhaust port 21 may not be formed in the left side region of the main case 22 and may be formed in the right side region of the main case 22, and for example, the exhaust port 21 may be formed near the right side surface wall of the rear surface wall 22*d* and the second exhaust flow path 34 may be formed along the right side surface wall 22*e* of the main case 22.

The first exhaust flow path 32 and the second exhaust flow path 34 are configured by specially forming the gap between the sub-case 19 and the main case 22, but similar exhaust flow path may be configured using one part of the side surface wall (front surface wall 22*a*, left side surface wall 22*b*, right side surface wall 22*e*) and the bottom surface plate 22*c* of the main case 22, the lower surface of the radiator plate 10 mounted with the coil unit, and the side surface wall (front surface wall 19*a*, left side surface wall 19*b*, right side surface wall 19*e*) of each sub-case 19A, 19*b* without separately arranging the duct or the like. Thus, the space can be saved by forming the exhaust passage using one part of the radiator plate 10, the sub-cases 19A, 19B for mounting the control circuits 15*a*, 15*b*, and the main case 22 for covering the entire device.

Furthermore, the cooling effect of the radiator plate 10 can be enhanced and the temperature of the heating coil 5 can be lowered by forming the exhaust flow path using the lower surface of the radiator plate 10. As a result, the heating coil 5 does not need to be directly cooled, and hence the flow path of the cooling wind C to the heating coil 5 does not need to be formed, so that the induction cooking appliance can be thinned and the space can be saved.

In the induction cooking appliance of the seventh embodiment, the cooling wind C, whose temperature is raised by cooling the heating coil 5, the heat generating component 16 and the like, is immediately exhausted to the outside of the main case 22 without making contact with other electronic components. Thus, in the induction cooking appliance, the other electronic components and the like are prevented from being heated and temperature raised by the temperature raised cooling wind C.

In the induction cooking appliance of the seventh embodiment a particularly large component that inhibits the flow of the cooling wind C is not used, and hence the cooling wind C smoothly flows in the direction from the rear surface side to the near side in the sub-cases 19A, 19B. Thus, the pressure loss is reduced in the configuration of the seventh embodiment.

In the induction cooking appliance of the seventh embodiment, the space on the lower side of the operation portion 36 can be used for the first exhaust flow path 32, and the dead space in the internal space of the induction cooking appliance can be utilized to save space.

In the induction cooking appliance of the seventh embodiment, the exhaust port 21 is formed at a position closer to the first induction heating block 33*a* than the second induction heating block 33*b*. In other words, the exhaust port 21 is at a position farther from the intake port 20*b* of the second induction heating block 33*b* than the intake port 20*a* of the first induction heating block 33*a*. Therefore, the intake port 20*b* is at a position where the air discharged from the exhaust port 21 and temperature raised is less likely to be taken in again compared to the intake port 20*a*.

According to the above configuration, the temperature rise of the cooling wind C in the second induction heating block 33*b* is further suppressed compared to the temperature rise of the cooling wind C in the first induction heating block 33*a*. If the power consumption of the first induction heating block 33*a* and the second induction heating block 33*b* is the same, the heating regions 12*c*, 12*d* inductively heated by the second induction heating block 33*b* can be operated for a longer time. If designed so that the operation time of each induction heating block 33*a*, 33*b* is the same, the second induction heating block 33*b* can carry out the inductive heating of larger power consumption compared to the first induction heating block 33*a*.

In the induction cooking appliance of the seventh embodiment, configuration is made such that the cooling wind C does not mix between the flow in which the cooling wind C from the blower device 17*a*, 17*b* on the rear surface side flows towards the direction of the near side by the duct 18*a*, 18*b* and the side wall of the sub-case 19A, 19B to reach the first exhaust flow path 32, and the flow in which the cooling wind is direction changed substantially 180 degrees to flow through the second exhaust flow path 34 from the near side towards the exhaust port 21 on the rear surface side. Thus, a short circuit from each blowing port 24*a*, 24*b* of the blower device 17*a*, 17*b* to the exhaust port 21 does not occur inside the induction cooking appliance, and each heat generating component 16 inside the induction cooking appliance can be reliably and stably cooled. Furthermore, as the disturbance of the flow due to the mixed flow does not occur inside the induction cooking appliance, the air is exhausted without the magnitude of the flow vector in the direction from the near side to the rear surface side greatly attenuated in the induction cooking appliance. As a result, the induction cooking appliance of the seventh embodiment has a configuration in which the exhaust air discharged from the exhaust port 21 is less likely to be taken in again from the intake ports 20*a*, 20*b*, and thus the cooling performance is enhanced.

In the induction cooking appliance of the seventh embodiment, an example in which the heating regions 12*a*, 12*b*, 12*c*, 12*d* in the top plate 4 are aligned by twos in the front and the back has been described, but this is not the sole case. For instance, the heating region can be arranged at an arbitrary position on the front, back, left, or right of the top plate 4. The number of heating regions is not limited and may be increased or decreased, so that two to three heating regions including a large diameter coil may be arranged, or five or more heating regions may be arranged.

Eighth Embodiment

Figure 11:
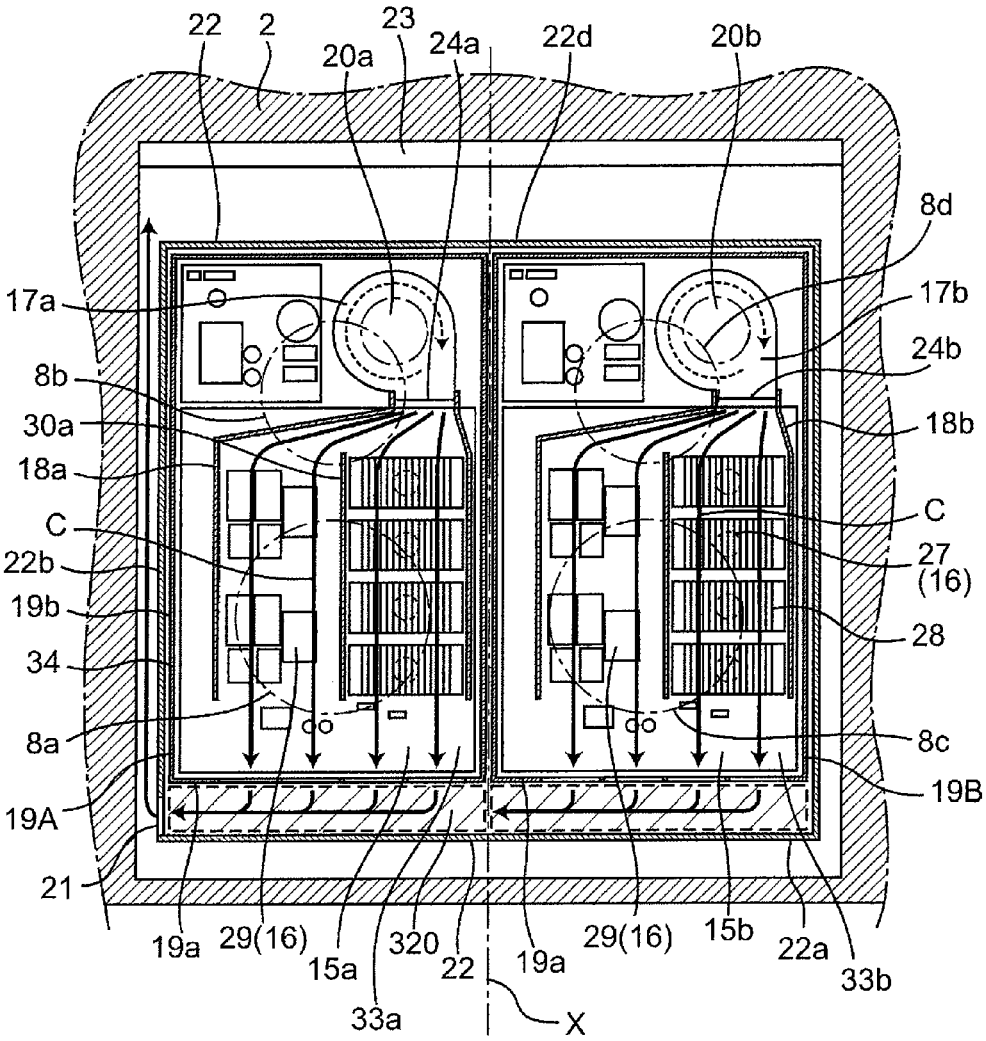
FIG. 11 is a horizontal cross-sectional view showing an internal configuration of an induction cooking appliance of an eighth embodiment according to the present invention.

An induction cooking appliance according to an eighth embodiment of the present invention will be hereinafter described with reference to the accompanied drawings. FIG. 11 is a horizontal cross-sectional view showing an internal configuration of the induction cooking appliance according to the eighth embodiment of the present invention. In the induction cooking appliance of the eighth embodiment, four heating regions 12*a*, 12*b*, 12*c*, 12*d* are arranged as in the seventh embodiment. The induction cooking appliance of the eighth embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. In the following description of the eighth embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

In the induction cooking appliance of the eighth embodiment, the exhaust port 21 is formed in the vicinity of the front surface wall 2*a* in the left side surface wall 22*b* of the main case 22, as shown in FIG. 11. In other words, the exhaust port 21 is formed on the near side in the left side surface wall 22*b*, and is arranged in the flow path direction (left direction in FIG. 11) in the first exhaust flow path 320 to communicate with the first exhaust flow path 320.

In the eighth embodiment, the front surface wall 22*a* of the main case 22 is arranged in the wind direction of the cooling wind C sent from the blower device 17*a*, 17*b* to the control circuit 15*a*, 15*b*. The first exhaust flow path 320 is configured by the front surface wall 22*a*. The intake ports 20*a*, 20*b* are formed on the rear surface side of the bottom surface plate 22*c* of the main case 22, and the exhaust port 21 is formed in the left side surface wall 22*b* of the main case 22. In the configuration of the eighth embodiment, the front surface wall 22*a* of the main case 22 corresponds to the first side surface wall.

The operation in the induction cooking appliance of the eighth embodiment configured as above will now be described.

In the first induction heating block 33*a*, the cooling wind C taken in from the intake port 20*a* by the blower device 17*a* is blown out in the direction of the near side from the blower device 17*a* to cool the control circuit 15*a*. The cooling wind C blown out in the direction of the near side from the blower device 17*a* is guided by the duct 18*a* to cool each heat generating component 16 (switching element 27, resonance capacitor 29, etc.) of the control circuit 15*a*. The cooling wind C that cooled each heat generating component 16 is flowed towards the direction of the near side as is to pass through the vent hole of the front surface wall 19*a* of the first sub-case 19A and reach the first exhaust flow path 320, which is the front surface exhaust flow path.

On the other hand, in the second induction heating block 33*b*, the cooling wind C taken in from the intake port 20*b* by the blower device 17*b* is blown out in the direction of the near side from the blower device 17*b* to cool the control circuit 15*b*. The cooling wind C blown out in the direction of the near side from the blower device 17*b* is guided by the duct 18*b* to cool each heat generating component 16 (switching element 27, resonance capacitor 29, etc.) of the control circuit 15*b*. The cooling wind C that cooled each heat generating component 16 is flowed towards the direction of the near side as is to pass through the vent hole of the front surface wall 19*a* of the second sub-case 19B and reach the first exhaust flow path 320, which is the front surface exhaust flow path.

In the first exhaust flow path 320, the respective cooling wind C from the first sub-case 19A and the second sub-case 19B makes contact with the front surface wall 22*a* of the main case 22 so that the flow of the cooling wind C is bent substantially 90 degrees. As the right end of the first exhaust flow path 320 is closed, the cooling wind C becomes a flow in which the flowing direction of flowing in the left direction becomes constant in the first exhaust flow path 320, and is discharged from the exhaust port 21 formed in the left side surface wall 22*b* of the main case 22.

The discharged cooling wind C from the exhaust port 21 is flowed in the left direction in the first exhaust flow path 320, and thus becomes a flow in which the flow vector in the left direction is the main stream. Thus, the discharged cooling wind C from the exhaust port 21 hits the inner wall surface of the kitchen cabinet 2 facing the exhaust port 21. The cooling wind that hit the inner wall surface of the kitchen cabinet 2 is bent substantially 90 degrees and flowed in the direction of the rear surface side since the near side is blocked and the air vent 23 is formed on the rear surface side. In this case, the cooling wind C flows along the space between the inner wall surface of the kitchen cabinet 2 and the left side surface wall 22*b* of the main case 22 of the induction cooking appliance. Thus, the discharged cooling wind C from the exhaust port 21 becomes a flow in the direction of the rear surface side simply by being bent substantially 90 degrees, and is flowed while maintaining a flow speed of a certain extent. Therefore, the cooling wind C is less likely to be taken in again from the intake ports 20*a*, 20*b* formed in the bottom surface plate 22*c* of the main case 22, and the cooling performance is enhanced in the induction cooking appliance of the eighth embodiment. Furthermore, the exhaust air that contacts the inner wall surface of the kitchen cabinet 2 and becomes the flow in the direction of the rear surface side reaches the air vent 23 as is, and hence is less likely to be taken in again from the intake ports 20*a*, 20*b*.

Ninth Embodiment

Figure 12:
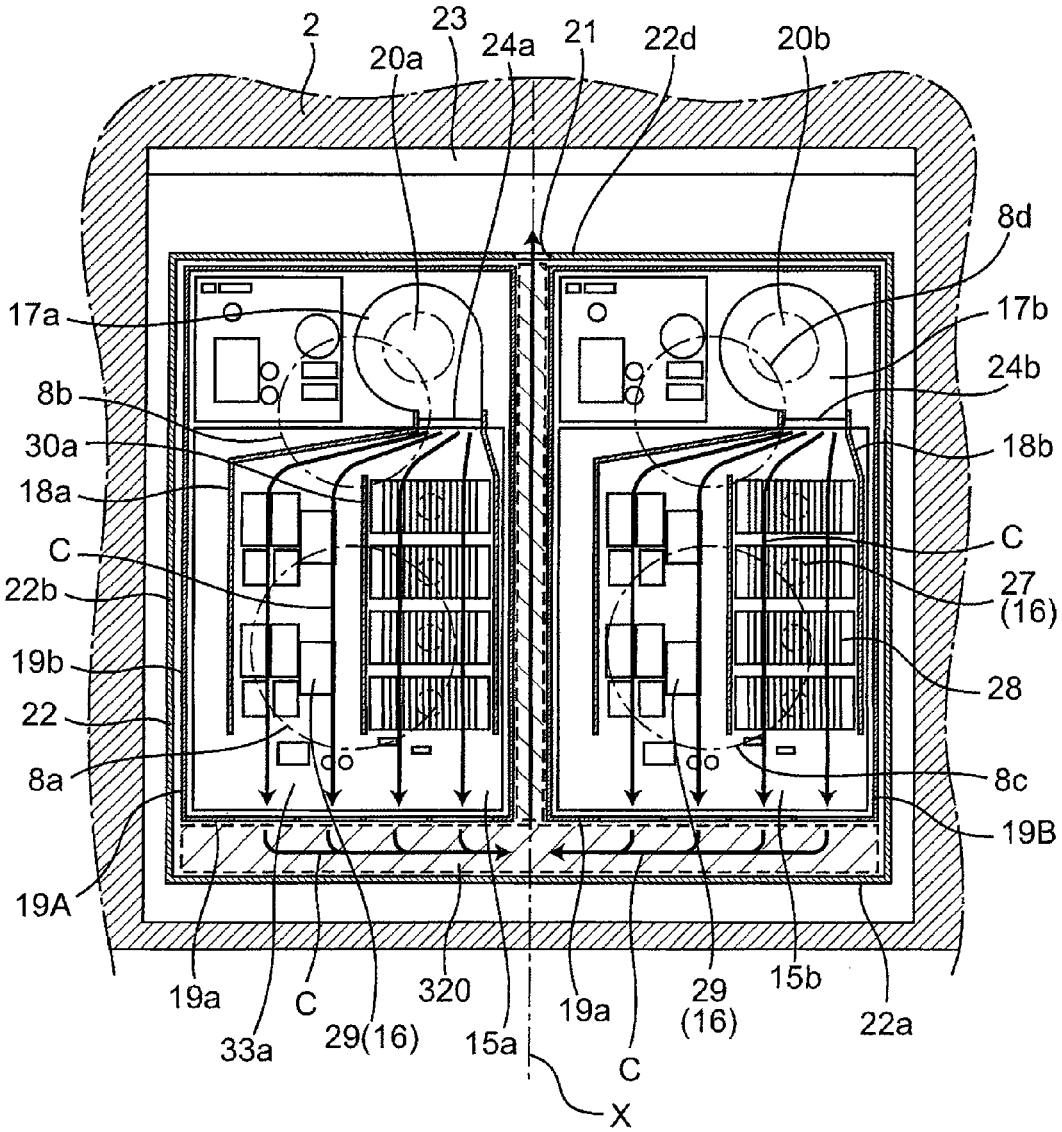
FIG. 12 is a horizontal cross-sectional view showing an internal configuration of an induction cooking appliance of a ninth embodiment according to the present invention.

An induction cooking appliance according to a ninth embodiment of the present invention will be hereinafter described with reference to the accompanied drawings. FIG. 12 is a horizontal cross-sectional view showing an internal configuration of the induction cooking appliance according to the ninth embodiment of the present invention. In the induction cooking appliance of the ninth embodiment, four heating regions 12*a*, 12*b*, 12*c*, 12*d* are arranged as in the seventh embodiment. The induction cooking appliance of the ninth embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. In the following description of the ninth embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

In the induction cooking appliance of the ninth embodiment, the exhaust port 21 is formed at substantially the middle in the rear surface wall 22*d* of the main case 22, as shown in FIG. 12. In the ninth embodiment, a second exhaust flow path 340 is formed between the first sub-case 19A and the second sub-case 19B, which are arranged side by side, and the second exhaust flow path 340 is communicated to the exhaust port 21.

In the ninth embodiment, the front surface wall 22*a* of the main case 22 is arranged in the wind direction of the cooling wind C sent from the blower device 17*a*, 17*b* to the control circuit 15*a*, 15*b*. The first exhaust flow path 320 is configured by the front surface wall 22*a*. The second exhaust flow path 340 is configured by the space between the sub-cases 19A, 19B. The intake ports 20*a*, 20*b* are formed on the rear surface side of the bottom surface plate 22*c* of the main case 22, and the exhaust port 21 is communicated to the second exhaust flow path 340 and formed at substantially the middle of the rear surface wall 22*d* of the main case 22. In the configuration of the ninth embodiment, the front surface wall 22*a* of the main case 22 corresponds to the first side surface wall, and the rear surface wall 22*d* of the main case 22 corresponds to the second peripheral wall.

The operation in the induction cooking appliance of the ninth embodiment configured as above will now be described.

In the first induction heating block 33*a*, the cooling wind C taken in from the intake port 20*a* by the blower device 17*a* is blown out in the direction of the near side from the blower device 17*a* to cool the control circuit 15*a*. The cooling wind C blown out in the direction of the near side from the blower device 17*a* is guided by the duct 18*a* to cool each heat generating component 16 of the control circuit 15*a*. The cooling wind C that cooled each heat generating component 16 is flowed in the direction of the near side as is and passed through the vent hole of the front surface wall 19*a* of the first sub-case 19A to reach the first exhaust flow path 320 or the front surface exhaust flow path.

On the other hand, in the second induction heating block 33*b*, the cooling wind C taken in from the intake port 20*b* by the blower device 17*b* is blown out in the direction of the near side from the blower device 17*b* to cool the control circuit 15*b*. The cooling wind C blown out in the direction of the near side from the blower device 17*b* is guided by the duct 18*b* to cool each heat generating component 16 of the control circuit 15*b*. The cooling wind C that cooled each heat generating component 16 is flowed in the direction of the near side as is and passed through the vent hole of the front surface wall 19*a* of the second sub-case 19B to reach the first exhaust flow path 320 or the front surface exhaust flow path.

In the first exhaust flow path 320, the cooling wind C from the first sub-case 19A makes contact with the front surface wall 22*a* of the main case 22 so that the flow of the cooling wind C is bent substantially 90 degrees. In this case, the cooling wind C flows in the right direction through the first exhaust flow path 320 since the left end of the first exhaust flow path 320 is closed. On the other hand, the cooling wind C from the second sub-case 19B makes contact with the front surface wall 22*a* of the main case 22 so that the flow of the cooling wind C is bent substantially 90 degrees. In this case, the cooling wind C flows in the left direction through the first exhaust flow path 320 since the right end of the first exhaust flow path 320 is closed.

The cooling wind C from the first sub-case 19A and the cooling wind C from the second sub-case 19B are mixed at substantially the central portion of the first exhaust flow path 320. The mixed cooling wind C is flowed in the direction of the rear surface side through the second exhaust flow path 340 formed between the first sub-case 19A and the second sub-case 19B to be discharged from the exhaust port 21. The cooling wind C flowed to the second exhaust flow path 340 becomes a flow in which the flow vector in the direction of the rear surface side is the main stream, and hence grows to a flow speed of a certain extent when discharged from the exhaust port 21, and becomes an exhaust air in which the flowing direction is clearly defined as the direction (backward) of the rear surface side of the kitchen cabinet 2. The exhausting direction is the direction away from the intake ports 20*a*, 20*b*, and thus the air discharged from the exhaust port 21 is less likely to be taken in again from the intake ports 20*a*, 20*b*, and the cooling performance of the induction cooking appliance is enhanced.

Furthermore, in the configuration of the induction cooking appliance of the ninth embodiment, the exhausting direction from the exhaust port 21 is the rear surface side direction of the kitchen cabinet 2 and reaches the air vent 23 of the kitchen cabinet 2 as is, so that the cooling wind C exhausted from the exhaust port 21 is less likely to be taken in again from the intake ports 20*a*, 20*b*.

In the induction cooking appliance of the ninth embodiment, the second exhaust flow path 340 and the exhaust ports 21 are arranged at substantially the central portion of the induction cooking appliance, so that the cooling wind C in the left region in the first induction heating block 33*a* and the cooling wind C in the right region in the second induction heating block 33*b* are reliably mixed at the flow-in port of the second exhaust flow path 340. Thus, the cooling wind C of the left and right regions mix to uniform the temperature of the exhaust air. Therefore, in the induction cooking appliance of the ninth embodiment, the local temperature rise of the temperature of the exhaust air discharged to the inside of the kitchen cabinet 2 is prevented, and consequently, the rise in the temperature of the intake air is suppressed, so that the high output cooking can be carried out for a long time.

As described above, in the induction cooking appliance of the ninth embodiment, the exhaust port 21 is arranged at substantially the middle of the rear surface wall 22*d* of the main case 22, and the intake ports 20*a*, 20*b* are arranged at the bottom surface plate 22*c*, so that the distance from the exhaust port 21 to the respective intake port 20*a*, 20*b* is not greatly different. Therefore, in the induction cooking appliance of the ninth embodiment, the cooling wind C exhausted from the exhaust port 21 is less likely to be taken in again from both intake ports 20*a*, 20*b*, and is reliably discharged from the air vent 23 arranged on the rear surface side of the kitchen cabinet 2.

Tenth Embodiment

Figure 13:
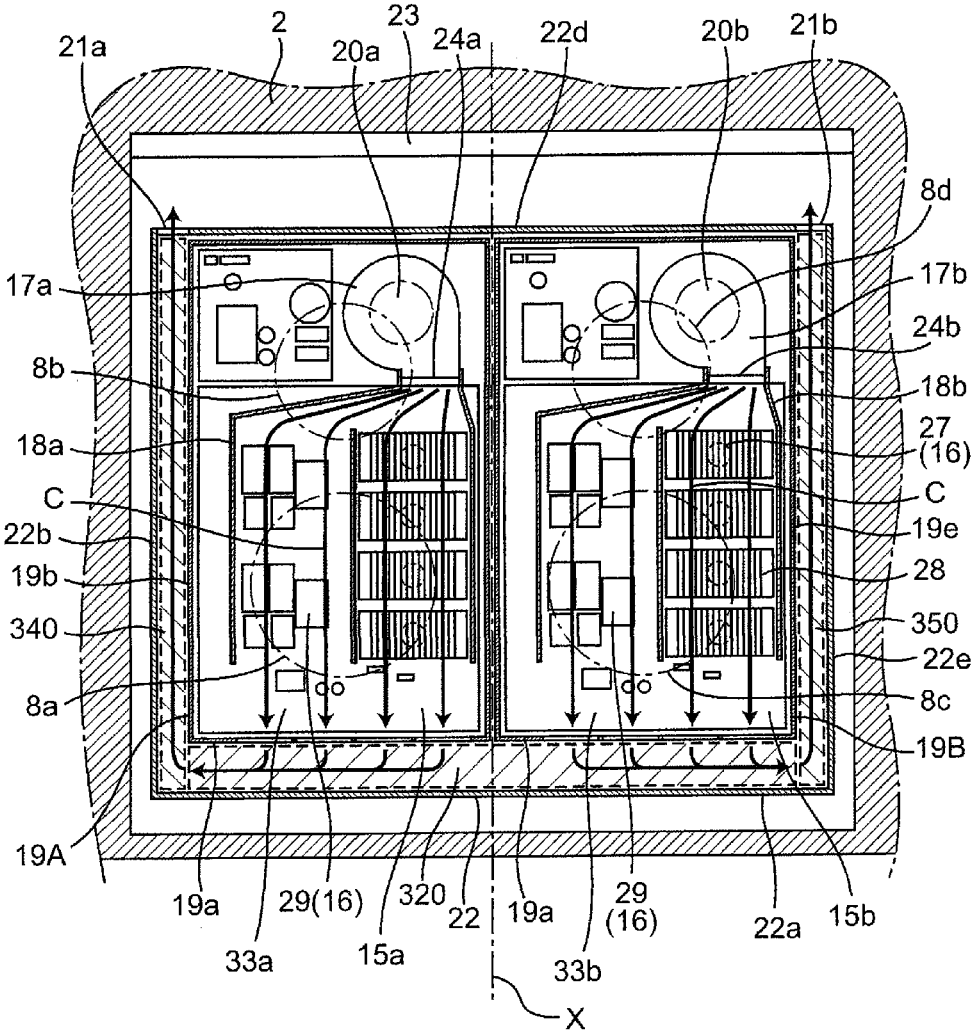
FIG. 13 is a horizontal cross-sectional view showing an internal configuration of an induction cooking appliance of a tenth embodiment according to the present invention.

An induction cooking appliance according to a tenth embodiment of the present invention will be hereinafter described with reference to the accompanied drawings. FIG. 13 is a horizontal cross-sectional view showing an internal configuration of the induction cooking appliance according to the tenth embodiment of the present invention. In the induction cooking appliance of the tenth embodiment, four heating regions 12*a*, 12*b*, 12*c*, 12*d* are arranged as in the seventh embodiment. The induction cooking appliance of the tenth embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. In the following description of the tenth embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

As shown in FIG. 13, in the induction cooking appliance of the tenth embodiment, the two exhaust ports 21*a*, 21*b* are arranged in the rear surface wall 22*d* of the main case 22, or formed near the left side surface wall 22*b* and near the right side surface wall 22*e* in the rear surface wall 22*d*. In the tenth embodiment, the second exhaust flow path 340 is formed between the left side surface wall 19*b* of the first sub-case 19A and the left side surface wall 22*b* of the main case 22, and a third exhaust flow path 350 is formed between the right side surface wall 19*e* of the second sub-case 19B and the right side surface wall 22*e* of the main case 22.

The second exhaust flow path 340 is communicated to the exhaust port 21*a* formed on the left end side of the rear surface wall 22*d* of the main case 22, and the third exhaust flow path 350 is communicated to the exhaust port 21*b* formed on the right end side of the rear surface wall 22*d* of the main case 22. The two exhaust ports 21*a*, 21*b* are symmetrically arranged with respect to the center line X (refer to FIG. 13) in which the center axis direction in the induction cooking appliance is the front and back direction (refer to FIG. 13). In the first exhaust flow path 320, the second exhaust flow path 340, and the third exhaust flow path 350 as well, they are symmetric with respect to the center line X in which the center axis direction in the induction cooking appliance is the front and back direction.

In the tenth embodiment, the front surface wall 22*a* of the main case 22 is arranged in the wind direction of the cooling wind C sent from the blower device 17*a*, 17*b* to the control circuit 15*a*, 15*b*. The first exhaust flow path 320 is configured by the front surface wall 22*a*. The second exhaust flow path 340 is configured by the left side surface wall 22*b* of the main case 22, and the third exhaust flow path 350 is configured by the right side surface wall 22*e*. The intake ports 20*a*, 20*b* are formed on the rear surface side of the bottom surface plate 22*c* of the main case 22, and the exhaust ports 21*a*, 21*a* are formed at left and right ends of the rear surface wall 22*d* of the main case 22. In the configuration of the tenth embodiment, the front surface wall 22*a* of the main case 22 corresponds to the first side surface wall, the left side surface wall 22*b* of the main case 22 corresponds to the second side surface wall, and the right side surface wall 22*e* of the main case 22 corresponds to the third side surface wall.

The operation in the induction cooking appliance of the tenth embodiment configured as above will now be described.

In the first induction heating block 33*a*, the cooling wind C taken in from the intake port 20*a* by the blower device 17*a* is blown out in the direction of the near side from the blower device 17*a* to cool the control circuit 15*a*. The cooling wind C blown out in the direction of the near side from the blower device 17*a* is guided by the duct 18*a* to cool each heat generating component 16 of the control circuit 15*a*. The cooling wind C that cooled each heat generating component 16 is flowed towards the direction of the near side as is, and passed through the vent hole of the front surface wall 19*a* of the first sub-case 19A to reach the first exhaust flow path 320, which is the front surface exhaust flow path.

On the other hand, in the second induction heating block 33*b*, the cooling wind C taken in from the intake port 20*b* by the blower device 17*b* is blown out in the direction of the near side from the blower device 17*b* to cool the control circuit 15*b*. The cooling wind C blown out in the direction of the near side from the blower device 17*b* is guided by the duct 18*b* to cool each heat generating component 16 of the control circuit 15*b*. The cooling wind C that cooled each heat generating component 16 is flowed towards the direction of the near side as is, and passed through the vent hole of the front surface wall 19*a* of the second sub-case 19B to reach the first exhaust flow path 320, which is the front surface exhaust flow path.

In the first exhaust flow path 320, the cooling wind C from the first induction heating block 33*a* and the second induction heating block 33*b* makes contact with the front surface wall 22*a* of the main case 22 so that the flow of the cooling wind C is bent substantially 90 degrees. One part of the cooling wind C from the first induction heating block 33*a* is further bent substantially 90 degrees in the clockwise direction, and reaches the second exhaust flow path 340 or the left side surface exhaust flow path. One part of the cooling wind C from the second induction heating block 33*b* is further bent substantially 90 degrees in the counterclockwise direction, and reaches the third exhaust flow path 350 or the right side surface exhaust flow path. In this case, one part of the cooling C from each of the first induction heating block 33*a* and the second induction heating block 33*b* in the first exhaust flow path 320 mix at substantially the central portion.

The respective cooling wind C divided to the left and the right at the first exhaust flow path 320 flows through the second exhaust flow path 340 and the third exhaust flow path 350 in the direction from the near side to the rear surface side. Therefore, the cooling wind C flowing through the second exhaust flow path 340 and the third exhaust flow path 350 becomes the flow in which the flow vector in the direction from the near side to the rear surface side is the main stream, and thus grows to the flow speed of a certain extent when discharged from each exhaust port 21*a*, 21*b* to become the exhaust air in which the flowing direction is clearly defined in the direction of the rear surface side (backward) of the kitchen cabinet 2. The exhausting direction is the direction of moving away from the intake ports 20*a*, 20*b*, so that the air discharged from the exhaust ports 21*a*, 21*b* is less likely to be taken in again from the intake ports 20*a*, 20*b*, and the cooling performance of the induction cooking appliance can be enhanced.

In the configuration of the induction cooking appliance of the tenth embodiment, the direction of the exhaust air from the exhaust ports 21*a*, 21*b* is the rear surface side direction of the kitchen cabinet 2, and reaches the air vent 23 of the kitchen cabinet 2 as is, so that the cooling wind C exhausted from the exhaust ports 21*a*, 21*b* is less likely to be taken in again from the intake ports 20*a*, 20*b*.

In the configuration of the induction cooking appliance of the tenth embodiment, the exhaust flow path configuration of the cooling wind C is substantially horizontally symmetric with respect to the center line X in which the center axis direction in the induction cooking appliance is the front and back direction, and thus the amount of exhaust air from each exhaust port 21*a*, 21*b* is dispersed to substantially half to the right and the left, and then discharged. Therefore, in the internal space of the kitchen cabinet 2, the local temperature rise in the region on the rear surface side is suppressed, the temperature rise does not vary, and the temperature is substantially evened. As a result, in the induction cooking appliance of the tenth embodiment, the temperature rise of the intake air is suppressed and the high output cooking can be performed for a long time.

The induction cooking appliance of the tenth embodiment is configured so that the cooling wind C flows along the side surface walls (22*a*, 22*b*, 22*e*) and the bottom surface plate (22*c*) of the main case 22, and thus the heat of the cooling wind C, which temperature raised, is transmitted to the side surface walls (22*a*, 22*b*, 22*e*) and the bottom surface plate (22*c*) so that the temperature of the main case 22 rises. However, in the configuration of the tenth embodiment, the heat conduction to the side surface walls (22*a*, 22*b*, 22*e*) and the bottom surface plate (22*c*) from the cooling wind C is substantially symmetric with respect to the center line X, and the exhaust flow path configuration is formed along the three side surface walls, so that the local temperature rise of the main case 22 configured by the side surface walls (22*a*, 22*b*, 22*e*) and the bottom surface plate (22*c*) is suppressed.

The induction cooking appliance of the tenth embodiment may include a flow path guiding plate for guiding the cooling wind C in the direction of separating to the front surface wall 19*a* in the sub-cases 19A, 19B to separate the cooling wind C in the direction of the second exhaust flow path 340 and the direction of the third exhaust flow path 350 in the first exhaust flow path 320. A partition plate may be arranged at the central part of the first exhaust flow path 320 to more reliably separate the cooling wind C in the first exhaust flow path 320. As described above, the respective cooling wind C from the first induction heating block 33*a* and the second induction heating block 33*b* is smoothly flowed to each exhaust flow path by arranging the partition plate in the first exhaust flow path 320, so that the pressure loss can be reduced.

The respective cooling wind C may be actively mixed in the first exhaust flow path 320 to alleviate the temperature difference of the cooling wind C from the first induction heating block 33*a* and the second induction heating block 33*b*. The cooling wind C can be more easily mixed at the central portion of the first exhaust flow path 320 and the temperature of the cooling wind C can be substantially evened by making the direction of the flow path guiding plate arranged on the front surface wall 19*a* of the sub-cases 19A, 19B to the direction of guiding the respective cooling wind C both in the substantially center direction X. According to such configuration, the cooling wind C is divided and flowed to the second exhaust flow path 340 and the third exhaust flow path 350 after the temperature of the cooling wind C is substantially evened in the first exhaust flow path 320. Thus, the temperature difference of the air exhausted from the left and right exhaust ports 21*a*, 21*b* is alleviated. The induction cooking appliance of the tenth embodiment configured as above has the local temperature rise in the region on the rear surface side in the internal space of the kitchen cabinet 2 suppressed, the variation in the temperature rise in the entire internal space of the kitchen cabinet 2 prevented, and the temperature in the internal space of the kitchen cabinet 2 substantially evened.

Eleventh Embodiment

Figure 14:
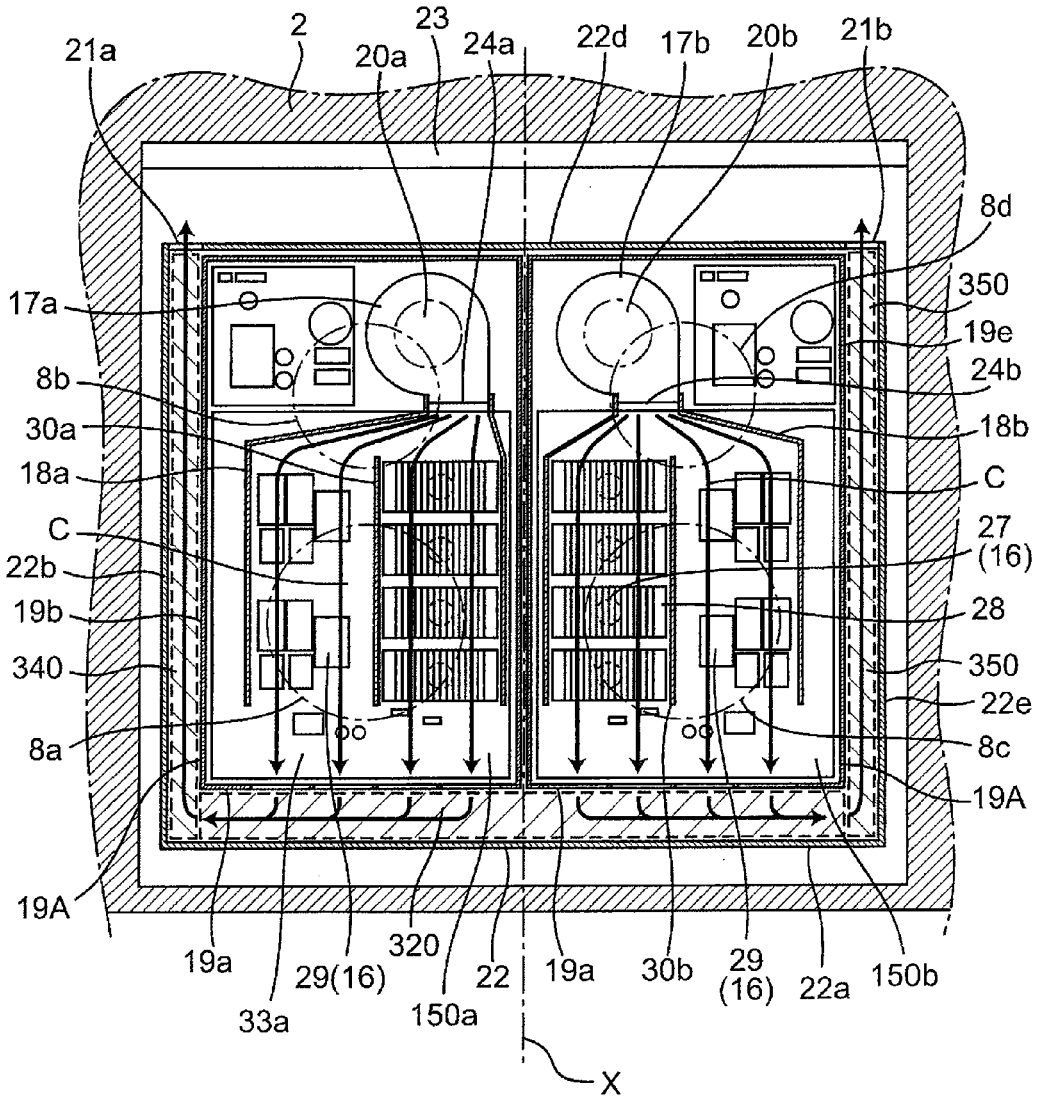
FIG. 14 is a horizontal cross-sectional view showing an internal configuration of an induction cooking appliance of an eleventh embodiment according to the present invention.

An induction cooking appliance according to an eleventh embodiment of the present invention will be hereinafter described with reference to the accompanied drawings. FIG. 14 is a horizontal cross-sectional view showing an internal configuration of the induction cooking appliance according to the eleventh embodiment of the present invention. In the induction cooking appliance of the eleventh embodiment, four heating regions 12*a*, 12*b*, 12*c*, 12*d* are arranged as in the seventh embodiment. The induction cooking appliance of the eleventh embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. In the following description of the eleventh embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

In the induction cooking appliance of the eleventh embodiment, two exhaust ports 21*a*, 21*b* are arranged on the rear surface wall 22*d* of the main case 22, or near the left side surface wall 22*b* and near the right side surface wall 22*e* in the rear surface wall 22*d*, as shown in FIG. 14. In the eleventh embodiment, the exhaust flow path configuration of the first exhaust flow path 320, the second exhaust flow path 340, and the third exhaust flow path 350 is the same as in the induction cooking appliance of the tenth embodiment. The two exhaust ports 21*a*, 21*b* are symmetrically arranged with respect to the center line X in which the center axis direction in the induction cooking appliance is the front and back direction (refer to FIG. 14). In the first exhaust flow path 320, the second exhaust flow path 340, and the third exhaust flow path 350 as well, they are symmetric with respect to the center line X in which the center axis direction in the induction cooking appliance is the front and back direction.

In the induction cooking appliance of the eleventh embodiment, the mounting arrangement of a first control circuit 150*a* in the first induction heating block 33*a* and the mounting arrangement of a second control circuit 150*b* in the second induction heating block 33*b* are different, as shown in FIG. 14.

In the first control circuit 150*a*, the switching element 27, the heat sink 28 joined to the switching element 27, and the like, which are heat generating components having a large amount of heat generation, are arranged in the region on the right side than a branched plate 30*a* extended in the front and back direction through substantially the middle of the duct 18*a*. The resonance capacitor 29, and the like, which are heat generating components in the first control circuit 150*a*, are arranged in the region on the left side than the branched plate 30*a*.

On the other hand, in the second control circuit 150*b*, the switching element 27, the heat sink 28 joined to the switching element 27, and the like, which are heat generating components having a large amount of heat generation, are arranged in the region on the right side than a branched plate 30*b* extended in the front and back direction through substantially the middle of the duct 18*b*. The resonance capacitor 29, and the like, which are heat generating components in the second control circuit 150*b*, are arranged in the region on the right side than the branched plate 30*b*.

As described above, the mounting configuration of the first control circuit 150*a* and the mounting configuration of the second control circuit 150*b* are such that each heat generating component is mounted so as to be substantially symmetric with respect to the center line X in which the center axis direction in the induction cooking appliance is the front and back direction.

The blower device 17*a* for cooling the first control circuit 150*a* is arranged in the region on the right side on the rear surface side in the sub-case 19A. The blowing port 24*a* of the blower device 17*a* is arranged on the right side so that the cooling wind C directly hits the heat sink 28 in the first control circuit 150*a*. The blower device 17*b* for cooling the second control circuit 150*b* is arranged in the region on the left side on the rear surface side in the sub-case 19B. The blowing port 24*b* of the blower device 17*b* is arranged on the left side so that the cooling wind C directly hits the heat sink 28 in the second control circuit 150*b*.

In the eleventh embodiment, the front surface wall 22*a* of the main case 22 is arranged in the wind direction of the cooling wind C sent from the blower device 17*a*, 17*b* to the control circuit 150*a*, 150*b*. The first exhaust flow path 320 is configured by the front surface wall 22*a*. The second exhaust flow path 340 is configured by the left side surface wall 22*b* of the main case 22, and the third exhaust flow path 350 is configured by the right side surface wall 22*e*. The intake ports 20*a*, 20*b* are formed on the rear surface side of the bottom surface plate 22*c* of the main case 22, and the exhaust ports 21*a*, 21*a* are formed at left and right ends of the rear surface wall 22*d* of the main case 22. In the configuration of the eleventh embodiment, the front surface wall 22*a* of the main case 22 corresponds to the first side surface wall, the left side surface wall 22*b* of the main case 22 corresponds to the second side surface wall, and the right side surface wall 22*e* of the main case 22 corresponds to the third side surface wall.

In the respective control circuit 150*a*, 150*b* in the first induction heating block 33*a* and the second induction heating block 33*b*, the first induction heating block 33*a* and the second induction heating block 33*b* are arranged side by side in the main case 22 such that the flowing direction of the cooling wind C becomes substantially the same direction. In the main case 22, the intake ports 20*a*, 20*b* and the exhaust ports 21*a*, 21*b* are formed to be substantially symmetric with respect to the center line X in which the center axis direction in the induction cooking appliance becomes the front and back direction. The blower devices 17*a*, 17*b* and the control circuits 150*a*, 150*b* are similarly arranged in a substantially symmetric manner according to the arrangement configuration of the intake ports 20*a*, 20*b* and the exhaust ports 21*a*, 21*b*. The ducts 18*a*, 18*b* are formed to guide the cooling wind C to the respective control circuits 150*a*, 150*b* according to the position of the blowing ports 24*a*, 24*b* of the blower devices 17*a*, 17*b*.

The operation in the induction cooking appliance of the eleventh embodiment configured as above will now be described.

In the first induction heating block 33*a*, the cooling wind C taken in from the intake port 20*a* by the blower device 17*a* is blown out in the direction of the near side from the blower device 17*a* to cool the control circuit 150*a*. The cooling wind C blown out in the direction of the near side from the blower device 17*a* is guided by the duct 18*a* to cool each heat generating component 16 of the control circuit 150*a*. The cooling wind C that cooled each heat generating component 16 is flowed towards the direction of the near side as is, and passed through the vent hole of the front surface wall 19*a* of the first sub-case 19A to reach the first exhaust flow path 320, which is the front surface exhaust flow path.

On the other hand, in the second induction heating block 33*b*, the cooling wind C taken in from the intake port 20*b* by the blower device 17*b* is blown out in the direction of the near side from the blower device 17*b* to cool the control circuit 150*b*. The cooling wind C blown out in the direction of the near side from the blower device 17*b* is guided by the duct 18*b* to cool each heat generating component 16 of the control circuit 150*b*. The cooling wind C that cooled each heat generating component 16 is flowed towards the direction of the near side as is, and passed through the vent hole of the front surface wall 19*a* of the second sub-case 19B to reach the first exhaust flow path 320, which is the front surface exhaust flow path.

In the first exhaust flow path 320, the cooling wind C from the first induction heating block 33*a* and the second induction heating block 33*b* makes contact with the front surface wall 22*a* of the main case 22 so that the flow of the cooling wind C is bent substantially 90 degrees. One part of the cooling wind C from the first induction heating block 33*a* is further bent substantially 90 degrees in the clockwise direction, and reaches the second exhaust flow path 340 or the left side surface exhaust flow path. One part of the cooling wind C from the second induction heating block 33*b* is further bent substantially 90 degrees in the counterclockwise direction, and reaches the third exhaust flow path 350 or the right side surface exhaust flow path. In this case, respective one parts of the cooling wind C from each of the first induction heating block 33*a* and the second induction heating block 33*b* mix at substantially the central portion in the first exhaust path 320.

The respective cooling wind divided to the left and the right at the first exhaust flow path 320 flows to the second exhaust flow path 340 and the third exhaust flow path 350. In the respective exhaust flow path of the second exhaust flow path 340 and the third exhaust flow path 350, the cooling wind C flows in the direction from the near side to the rear surface side. Thus, the cooling wind C flowing through the second exhaust flow path 340 and the third exhaust flow path 350 becomes the flow in which the flow vector in the direction from the near side to the rear surface side is the main stream. The cooling wind C discharged from each exhaust port 21*a*, 21*b* thus grows to the flow speed of a certain extent to become the exhaust air in which the flowing direction is clearly defined in the direction of the rear surface side (backward) of the kitchen cabinet 2. The exhausting direction is the direction of moving away from the intake ports 20*a*, 20*b*, so that the air discharged from the exhaust ports 21*a*, 21*b* is less likely to be taken in again from the intake ports 20*a*, 20*b*, and the cooling performance of the induction cooking appliance can be enhanced.

In the configuration of the induction cooking appliance of the eleventh embodiment, the direction of the exhaust air from the exhaust ports 21*a*, 21*b* is the rear surface side direction of the kitchen cabinet 2, and reaches the air vent 23 of the kitchen cabinet 2 as is. Thus, in the induction cooking appliance of the eleventh embodiment, the cooling wind C exhausted from the exhaust ports 21*a*, 21*b* is less likely to be taken in again from the intake ports 20*a*, 20*b*.

The induction cooking appliance of the eleventh embodiment has the arrangement of the intake ports 20*a*, 20*b* and the exhaust ports 21*a*, 21*b* substantially symmetric with respect to the center axis X (refer to FIG. 14), compared to the tenth embodiment shown in FIG. 13, so that the respective distance from the exhaust ports 21*a*, 21*b* to the intake ports 20*a*, 20*b* is substantially the same, and both cooling wind C exhausted from the exhaust ports 21*a*, 21*b* are also less likely to be taken in again from the intake ports 20*a*, 20*b*.

Twelfth Embodiment

Figure 15:
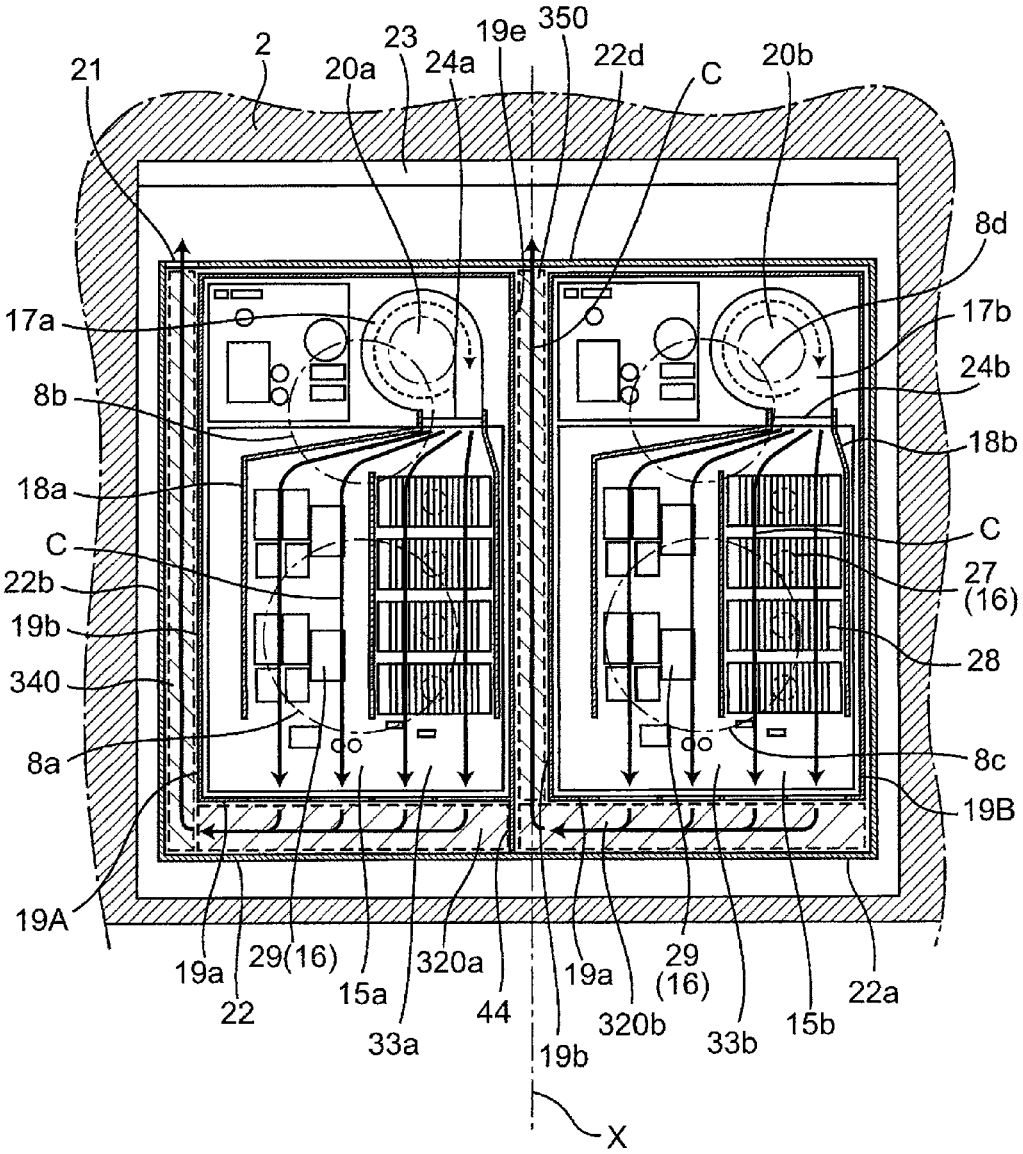
FIG. 15 is a horizontal cross-sectional view showing an internal configuration of an induction cooking appliance of a twelfth embodiment according to the present invention.

An induction cooking appliance according to a twelfth embodiment of the present invention will be hereinafter described with reference to the accompanied drawings. FIG. 15 is a horizontal cross-sectional view showing an internal configuration of the induction cooking appliance according to the twelfth embodiment of the present invention. In the induction cooking appliance of the twelfth embodiment, four heating regions 12*a*, 12*b*, 12*c*, 12*d* are arranged as in the seventh embodiment. The induction cooking appliance of the twelfth embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. In the following description of the twelfth embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

As shown in FIG. 15, in the induction cooking appliance of the twelfth embodiment, the two exhaust ports 21*a*, 21*b* are arranged on the rear surface wall 22*d* of the main case 22, and are formed at the left side end and at substantially the central part in the rear surface wall 22*d*. In the twelfth embodiment, the second exhaust flow path 340 is formed between the left side surface wall 19*b* of the first sub-case 19A and the left side surface wall 22*b* of the main case 22, and the third exhaust flow path 350 is formed between the right side surface wall 19*e* of the first sub-case 19A and the left side surface wall 19*b* of the second sub-case 19B.

The second exhaust flow path 340 is communicated to the exhaust port 21*a* formed on the left end side of the rear surface wall 22*d* of the main case 22, and the third exhaust flow path 350 is communicated to the exhaust port 21*b* formed at substantially the central part of the main case 22.

In the induction cooking appliance of the twelfth embodiment, the first exhaust flow paths 320*a*, 320*b* formed by the front surface wall 22*a* of the main case 22 are divided to the left and the right by the partition plate 44. The cooling wind C that flowed into the first exhaust flow path 320*a* from the first induction heating block 33*a* is flowed from the first exhaust flow path 320*a* to the exhaust port 21*a* through the second exhaust flow path 340*a*. The cooling wind C that flowed into the first exhaust flow path 320*b* from the second induction heating block 33*b* is flowed from the first exhaust flow path 320*b* to the exhaust port 21*b* through the third exhaust flow path 350.

In the twelfth embodiment, the front surface wall 22*a* of the main case 22 is arranged in the wind direction of the cooling wind C sent from the blower device 17*a*, 17*b* to the control circuit 15*a*, 15*b*. The first exhaust flow paths 320*a*, 320*b* are formed by the front surface wall 22*a*. The second exhaust flow path 340 is configured by the left side surface wall 22*b* of the main case 22. The third exhaust flow path 35 is configured by the right side surface wall 19*e* of the first sub-case 19A and the left side surface wall 19*b* of the second sub-case 19B at the central part of the main case 22. The intake ports 20*a*, 20*b* are formed on the rear surface side of the bottom surface plate 22*c* of the main case 22, and the exhaust ports 21*a*, 21*b* are formed at the left end and the central part in the rear surface wall 22*d* of the main case 22.

The operation in the induction cooking appliance of the twelfth embodiment configured as above will now be described.

In the first induction heating block 33*a*, the cooling wind C taken in from the intake port 20*a* by the blower device 17*a* is blown out in the direction of the near side from the blower device 17*a* to cool the control circuit 15*a*. The cooling wind C blown out in the direction of the near side from the blower device 17*a* is guided by the duct 18*a* to cool each heat generating component 16 of the control circuit 15*a*. The cooling wind C that cooled each heat generating component 16 is flowed towards the direction of the near side as is, and passed through the vent hole of the front surface wall 19*a* of the first sub-case 19A to reach the first exhaust flow path 320*a*, which is the front surface exhaust flow path.

In the second induction heating block 33*b*, the cooling wind C taken in from the intake port 20*b* by the blower device 17*b* is blown out in the direction of the near side from the blower device 17*b* to cool the control circuit 15*b*. The cooling wind C blown out in the direction of the near side from the blower device 17*b* is guided by the duct 18*b* to cool each heat generating component 16 of the control circuit 15*b*. The cooling wind C that cooled each heat generating component 16 is flowed towards the direction of the near side as is, and passed through the vent hole of the front surface wall 19*a* of the second sub-case 19B to reach the first exhaust flow path 320*b*, which is the front surface exhaust flow path.

In the first exhaust flow paths 320*a*, 320*b*, the cooling wind C from the first induction heating block 33*a* and the second induction heating block 33*b* makes contact with the front surface wall 22*a* of the main case 22 to be bent substantially 90 degrees in the clockwise direction. Therefore, the cooling wind C from the first induction heating block 33*a* is passed through the first exhaust flow path 320*a* and bent substantially 180 degrees in the clockwise direction to reach the second exhaust flow path 340, or the left side surface exhaust flow path. Similarly, the cooling wind C from the second induction heating block 33*b* is passed through the first exhaust flow path 320*b* and bent substantially 180 degrees in the clockwise direction to reach the third exhaust flow path 350, or the left side surface exhaust flow path. In this case, the respective cooling wind C from the first induction heating block 33*a* and the second induction heating block 33*b* is exhausted from the respective exhaust port 21*a*, 21*b* without mixing.

Therefore, the cooling wind C flowing through the second exhaust flow path 340 and the third exhaust flow path 350 becomes the flow in which the flow vector in the direction from the near side to the rear surface side becomes a main stream. Thus, the cooling wind C grows to a flow speed of a certain extent when discharged from each exhaust port 21*a*, 21*b*, and becomes an exhaust air in which the flowing direction is clearly defined as the direction (backward) on the rear surface side of the kitchen cabinet 2. The exhausting direction is the direction of moving away from the intake ports 20*a*, 20*b*. Thus, in the induction cooking appliance of the twelfth embodiment, the air discharged from the exhaust ports 21*a*, 21*b* is less likely to be taken in again from the intake ports 20*a*, 20*b*, and the cooling performance of the induction cooking appliance is enhanced.

In the induction cooking appliance of the twelfth embodiment, the exhausting direction from the exhaust ports 21*a*, 21*b* is the rear surface side direction of the kitchen cabinet 2 that reaches the air vent 23 of the kitchen cabinet 2 as is. Thus, the induction cooking appliance of the twelfth embodiment has a configuration in which the cooling wind C exhausted from the exhaust ports 21*a*, 21*b* is less likely to be taken in again from the intake ports 20*a*, 20*b*.

In the configuration of the induction cooking appliance of the twelfth embodiment, the mounting configuration in the induction heating blocks 33*a*, 33*b* and the exhaust flow path configuration from the intake port 20*a*, 20*b* to the exhaust port 21*a*, 21*b* are the same arrangement configuration. Thus, in the induction cooking appliance of the twelfth embodiment, a bock design including the exhaust flow path configuration can be made, and further common use including even the cooling design can be realized. Therefore, the configuration of the induction cooking appliance of the twelfth embodiment can easily have the distance between the induction heating blocks 33*a*, 33*b* to a desired spacing, and can be easily developed to the induction cooking appliance having various configurations such as configuration in which the spacing of the left and right heating regions is large, or a configuration in which the induction heating block is added to further increase the number of heating regions.

Thirteenth Embodiment

Figure 16:
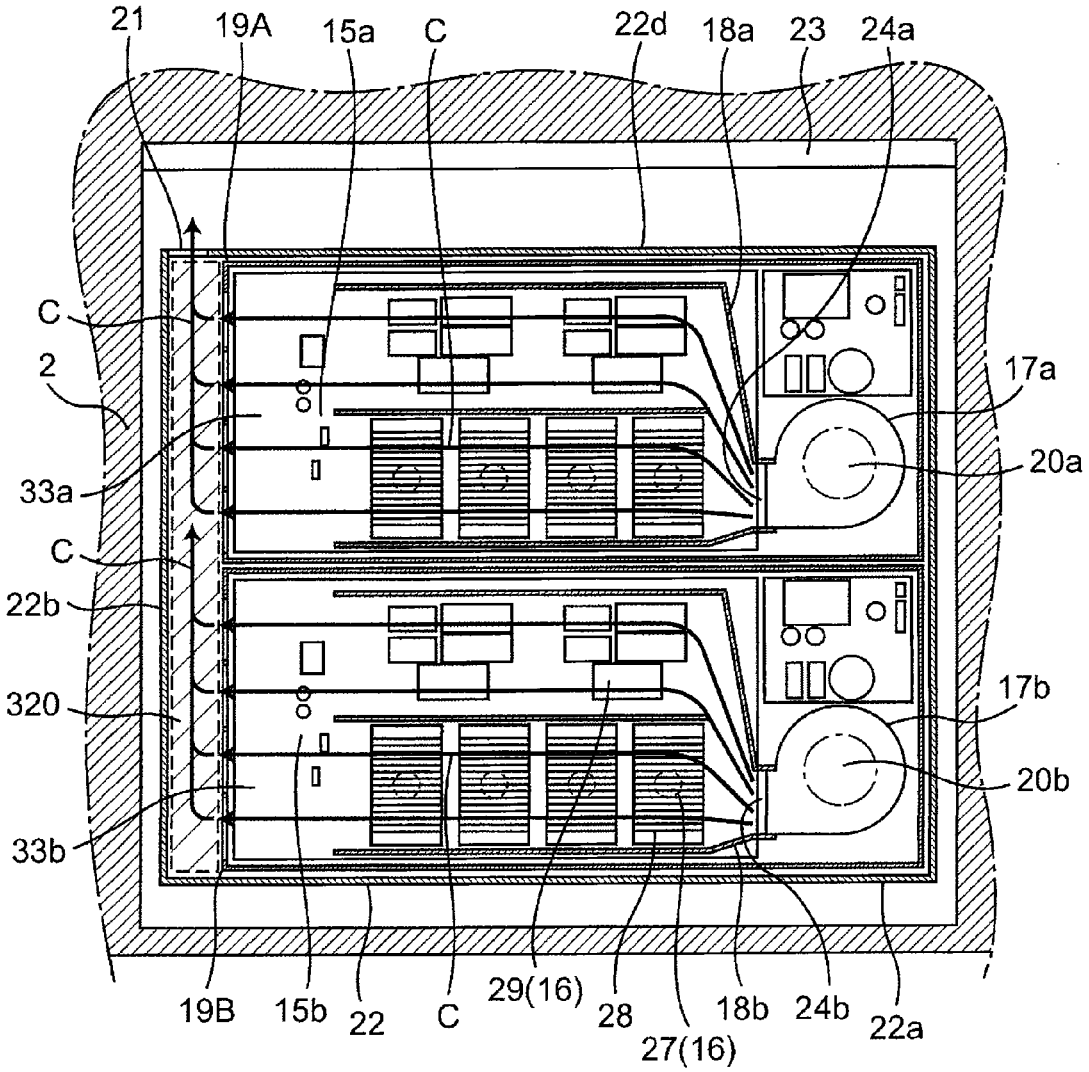
FIG. 16 is a horizontal cross-sectional view showing an internal configuration of an induction cooking appliance of a thirteenth embodiment according to the present invention.

An induction cooking appliance according to a thirteenth embodiment of the present invention will be hereinafter described with reference to the accompanied drawings. FIG. 16 is a horizontal cross-sectional view showing an internal configuration of the induction cooking appliance according to the thirteenth embodiment of the present invention. In the induction cooking appliance of the thirteenth embodiment, four heating regions 12*a*, 12*b*, 12*c*, 12*d* are arranged as in the seventh embodiment. The induction cooking appliance of the thirteenth embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. However, the first induction heating block 33*a* and the second induction heating block 33*b* in the induction cooking appliance of the thirteenth embodiment are arranged inside the main case 22 so that the cooling wind C flows from the right side to the left side of the induction cooking appliance, as shown in FIG. 16.

In the following description of the thirteenth embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

In the induction cooking appliance of the thirteenth embodiment, two induction heating blocks 33*a*, 33*b* are arranged side by side on the rear surface side and the near side inside the main case 22 so that the flowing direction of the cooling wind C for cooling the control circuits 15*a*, 15*b* is in the same direction (direction from right side to left side in FIG. 16). The first induction heating block 33*a* on the rear surface side corresponds to the heating regions 12*b*, 12*d* (refer to FIG. 8) formed on the rear surface side of the top plate 4, and the second induction heating block 33*b* on the near side corresponds to the heating regions 12*a*, 12*c* (refer to FIG. 8) formed on the near side of the top plate 4.

As shown in FIG. 16, in the induction cooking appliance of the thirteenth embodiment, the exhaust port 21 is formed at the left end in the rear surface wall 22*d* of the main case 22. In other words, the exhaust port 21 is arranged in the flow path direction (direction on rear surface side in FIG. 16) in the first exhaust flow path 320, and is communicated to the first exhaust flow path 320.

The intake ports 20*a*, 20*b* to the respective sub-cases 19A, 19B and the exhaust port 21 of the main case 22 are opened to the interior of the kitchen cabinet 2. The intake ports 20*a*, 20*b* are formed in the right side region in the bottom surface plate 22*c* of the main case 22, and the exhaust port 21 is formed at the left side end in the rear surface wall 22*d* of the main case 22.

As described above, in the thirteenth embodiment, the control circuits 15*a*, 15*b* are arranged on the left side than the intake ports 20*a*, 20*b*, where the cooling wind C from the blower devices 17*a*, 17*b* is flowed from the right to the left to cool the control circuits 15*a*, 15*b*. A gap is formed between the sub-case 19A, 19B and the left side surface wall 22*b* of the main case 22, which gap becomes the first exhaust flow path 320. The cooling wind C from each induction heating block 33*a*, 33*b* flows into the first exhaust flow path 320, and is exhausted from the exhaust port 21.

In the kitchen cabinet 2 in which the induction cooking appliance is incorporated, the air vent 23 for communicating the interior and the exterior of the kitchen cabinet 2 to carry out ventilation is arranged on the rear surface side.

In the thirteenth embodiment, the left side surface wall 22*b* of the main case 22 is arranged in the wind direction of the cooling wind C sent from the blower device 17*a*, 17*b* to the control circuit 15*a*, 15*b*. The first exhaust flow path 320 is configured by the left side surface wall 22*b*. The intake ports 20*a*, 20*b* are formed in the right side region in the bottom surface plate 22*c* of the main case 22, and the exhaust port 21 is formed at the left end of the rear surface wall 22*d* of the main case 22. In the configuration of the thirteenth embodiment, the left side surface wall 22*b* of the main case 22 corresponds to the first side surface wall.

The operation in the induction cooking appliance of the thirteenth embodiment configured as above will now be described.

In the first induction heating block 33*a*, the cooling wind C taken in from the intake port 20*a* by the blower device 17*a* is blown out in the left direction from the blower device 17*a* to cool the control circuit 15*a*. The cooling wind C blown out in the left direction from the blower device 17*a* is guided by the duct 18*a* to cool each heat generating component 16 of the control circuit 15*a*. The cooling wind C that cooled each heat generating component 16 is flowed towards the left direction as is, and flowed from the first sub-case 19A to the first exhaust flow path 320.

On the other hand, in the second induction heating block 33*b*, the cooling wind C taken in from the intake port 20*b* by the blower device 17*b* is blown out in the left direction from the blower device 17*b* to cool the control circuit 15*b*. The cooling wind C blown out in the left direction from the blower device 17*b* is guided by the duct 18*b* to cool each heat generating component 16 of the control circuit 15*b*. The cooling wind C that cooled each heat generating component 16 is flowed towards the left direction as is, and flowed from the second sub-case 19B to the first exhaust flow path 320.

In the first exhaust flow path 320, the respective cooling wind C from the first sub-case 19A and the second sub-case 19B makes contact with the left side surface wall 22*b* of the main case 22, and the flow of the cooling wind C is bent substantially 90 degrees. In this case, the cooling wind C from the first induction heating block 33*a* and the second induction heating block 33*b* is mixed. As the end on the near side in the first exhaust flow path 320 is closed, the cooling wind C is flowed through the first exhaust flow path 320 in the direction of the rear surface side, and discharged from the exhaust port 21 formed in the rear surface wall 22*d* of the main case 22.

The cooling wind C discharged from the exhaust port 21 is flowed in the direction of the rear surface side in the first exhaust flow path 320, and thus becomes a flow in which the flow vector in the direction from the near side to the rear surface side is a main stream. Thus, the wind grows to a flow speed of a certain extent when discharged from the exhaust port 21, and becomes an exhaust air in which the flowing direction is clearly defined as the direction (backward) in the rear surface side of the kitchen cabinet 2. The exhausting direction is the direction of moving away from the intake ports 20*a*, 20*b*. The air discharged from the exhaust port 21 is less likely to be taken in again from the intake ports 20*a*, 20*b*, and the cooling performance of the induction cooking appliance can be enhanced.

In the configuration of the induction cooking appliance of the thirteenth embodiment, the direction of the exhaust air from the exhaust port 21 is the direction of the rear surface side of the kitchen cabinet 2, and reaches the air vent 23 of the kitchen cabinet 2 as is. The induction cooking appliance of the thirteenth embodiment has a configuration in which the cooling wind C exhausted from the exhaust port 21 is less likely to be taken in again from the intake ports 20*a*, 20*b*.

In the induction cooking appliance of the thirteenth embodiment, the intake ports 20*a*, 20*b* are formed in the region on the right side of the main case 22, and the exhaust port 21 is formed in the region on the left side of the main case 22. The intake ports 20*a*, 20*b* and the exhaust port 21 are thus formed greatly spaced apart to the left and the right, and thus the cooling wind C discharged from the exhaust port 21 is less likely to be taken in again from the intake ports 20*a*, 20*b*.

In the thirteenth embodiment, an example in which the intake ports 20*a*, 20*b* are formed in the region on the right side and the exhaust port 21 is formed in the region on the left side has been described by way of example, but the present invention is not limited to such configuration, and the left and the right may be reversed. The exhaust port 21 may be formed in the front surface wall 22*a* of the main case 22 to respond to a case in which the air vent 23 of the kitchen cabinet 2 is on the near side.

Furthermore, a configuration in which the exhaust port 21 is formed in each of the rear surface wall 22*d* and the front surface wall 22*a* of the main case 22, so that the shielding plate capable of shielding either one of the exhaust port 21 is attached from the outer surface of the main case 22 may be adopted.

According to such configuration, when installing the induction cooking appliance in the kitchen cabinet 2, if the air vent 23 is arranged on the rear surface side of the kitchen cabinet 2, the exhaust port 21 formed in the front surface wall 22*a* of the main case 22 is shielded. If the air vent 23 is arranged on the near side of the kitchen cabinet 2, the exhaust port 21 formed in the rear surface wall 22*d* of the main case 22 is shielded. If the air vent 23 is arranged on both the near side and the rear surface side of the kitchen cabinet 2, both exhaust ports 21 are opened. Thus, the configuration in which the exhaust port 21 is formed in the rear surface wall 22*d* and the front surface wall 22*a* of the main case 22 can be installed with respect to the kitchen cabinet 2 of various ventilation configurations, and a more versatile induction cooking appliance can be obtained.

The shielding plate may be configured to be fixed at a plurality of different positions so that the opening area and the opening position of the exhaust port 21 can be adjusted. With the configuration in which the opening area and the opening position of the exhaust port 21 can be adjusted, the flow rate of the cooling wind C discharged from the respective exhaust port 21 can be adjusted. Therefore, the exhausting complying with the respective air vent 23 can be realized when the air vent 23 is arranged on both the near side and the rear surface side of the kitchen cabinet 2 and the opening area differs. In the induction cooking appliance having such configuration, the versatility with respect to the kitchen cabinet 2 to which it can be installed can be further enhanced.

In the configuration of the induction cooking appliance of the thirteenth embodiment shown in FIG. 16, an example in which the air vent 23 for carrying out the ventilation of the interior and the exterior of the kitchen cabinet 2 arranged only on the rear surface side of the kitchen cabinet 2 has been described, but is not limited to such configuration. For instance, the air vent 23 may be arranged on the rear surface side and the near side of the kitchen cabinet 2. In the case of such configuration, the outside air taken in from the air vent 23 on the near side of the kitchen cabinet 2 is taken in by the intake ports 20*a*, 20*b*, and discharged from the exhaust port 21 on the rear surface side after cooling the respective control circuit 15*a*, 15*b*. The cooling wind C discharged in this case is exhausted from the air vent 23 on the rear surface side of the kitchen cabinet 2. The flow of air described above can be realized in the inside of the kitchen cabinet 2, and the temperature rise of the intake air can be suppressed to a minimum.

In the thirteenth embodiment, the first induction heating block 33*a* corresponds to the heating regions 12*b*, 12*d* arranged on the rear surface side region of the top plate 4, and the second induction heating block 33*b* corresponds to the heating regions 12*a*, 12*c* arranged on the near side region of the top plate 4, but the present invention is not limited to such configuration.

In the configuration of the induction cooking appliance of the thirteenth embodiment, the heating regions 12*a*, 12*c* on the near side are commonly used by the control circuit 15*a* in the first induction heating block 33*a*, and the heating regions 12*b*, 12*d* on the rear surface side are commonly used by the control circuit 15*b* in the second induction heating block 33*b*. In the case of such configuration, the total power consumption of the heating regions 12*a*, 12*c* and the heating regions 12*b*, 12*d* becomes equal. If the heating region 12*a* is a high output, the heating region 12*c* inevitably becomes a low output. Therefore, in this configuration, it is difficult to have the heating regions 12*a*, 12*c* on the one side near the user, which are frequently used by the user, both as high output.

In another embodiment in which the heating regions 12*a*, 12*c* on the near side are both high output, a configuration in which the first induction heating block 33*a* on the rear surface side corresponds to the heating regions 12*a*, 12*b* arranged in the left region of the top plate 4, and the second induction heating block 33*b* on the near side corresponds to the heating regions 12*c*, 12*d* arranged in the right region of the top plate 4 may be adopted.

According to such configuration, the sub-cases 19A, 19B in which the control circuits 15*a*, 15*b* and the blower devices 17*a*, 17*b* are respectively interiorly arranged are arranged at front and back positions with respect to the main case 22. On the other hand, the radiator plates 10*a*, 10*b* for mounting the coil unit 8 are arranged side by side at the left and right positions with respect to the main case 22. Thus, the internal configuration of the main case 22 becomes difficult, but the heating region 12*a* corresponding to the control circuit 15*a* and the heating region 12*c* corresponding to the control circuit 15*b* both can be made as high output heating regions. As a result, the heating regions 12*a*, 12*c* on the near side, which are frequently used by the user, both can be high output.

In the thirteenth embodiment, the intake ports 20*a*, 20*b* are inevitably formed in either left or right region of the main case 22. If the intake ports 20*a*, 20*b* are formed in the bottom surface plate 22*c*, a space to taken in air of a certain extent needs to be ensured. Thus, it is difficult to arrange other units such as a roaster or an oven on the lower side of each intake port 20*a*, 20*b*.

If the intake ports 20*a*, 20*b* are formed in the region on the rear surface side in the bottom surface plate 22*c* of the main case 22, the region that can be used to arrange other units becomes a region on the near side of the main case 22. In such a case, if a roaster having an inner volume of greater than or equal to a certain volume is realized, the take-out port of the roaster becomes wider width and shorter depth, and thus is not easy to use.

If an auxiliary operation portion for carrying out an auxiliary operation is arranged on the near side of the main case 22, the width of the roaster cannot be ensured, and the inner volume of the roaster is reduced.

On the other hand, if the intake ports 20*a*, 20*b* are formed in the right side region of the bottom surface plate 22*c*, the exhaust port 21 is formed at the left end of the rear surface wall 22*d*, and the first exhaust flow path 320 is formed in the left side region of the main case 22, as in the induction cooking appliance of the thirteenth embodiment, the intake port and the exhaust port do not need to be formed in the left side region in the bottom surface plate 22*c*. Thus, other units such as the roaster and the oven can be arranged on the lower side of the first exhaust flow path 320.

If the roaster is arranged on the lower side of the first exhaust flow path 320, the case of the roaster on the lower side can be cooled by the cooling wind C flowing through the first exhaust flow path 320.

Fourteenth Embodiment

Figure 17:
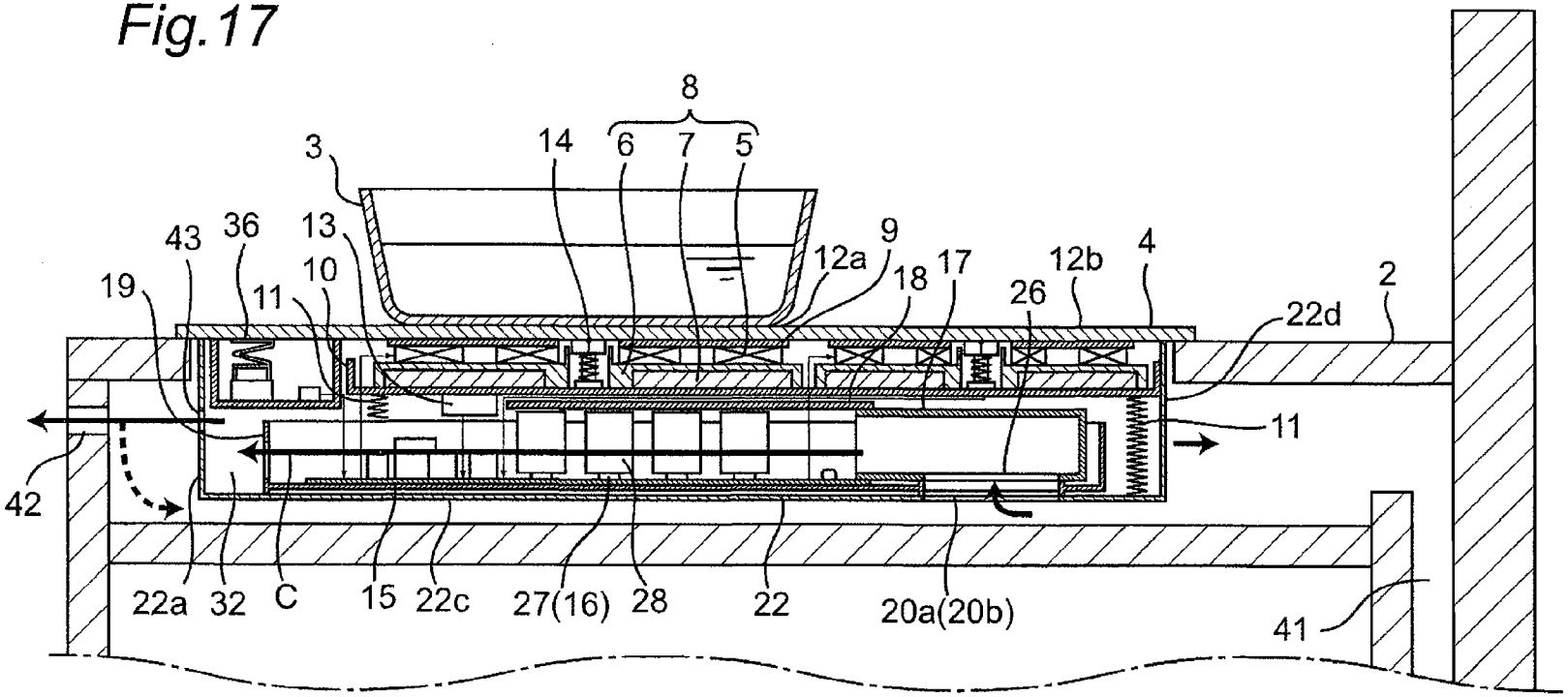
FIG. 17 is a horizontal cross-sectional view showing an internal configuration of an induction cooking appliance of a fourteenth embodiment according to the present invention.

An induction cooking appliance according to a fourteenth embodiment of the present invention will be hereinafter described with reference to the accompanied drawings. FIG. 17 is a cross-sectional view of the main parts showing a state in which the induction cooking appliance of the fourteenth embodiment according to the present invention is installed in the kitchen cabinet. In the induction cooking appliance of the fourteenth embodiment, four heating regions 12*a*, 12*b*, 12*c*, 12*d* are arranged as in the seventh embodiment. The induction cooking appliance of the fourteenth embodiment includes the first induction heating block 33*a* and the second induction heating block 33*b* as in the induction cooking appliance of the seventh embodiment, where two sets of the first induction heating block 33*a* and the second induction heating block 33*b* are arranged side by side. The configuration of the first induction heating block 33*a* and the second induction heating block 33*b* is the same as the induction cooking appliance of the seventh embodiment. In the following description of the fourteenth embodiment, the same reference numerals are denoted on the configuring elements having the same functions and configurations as the configuring elements in the induction cooking appliance of the seventh embodiment, so that the detailed description thereof is omitted and the description of the seventh embodiment is applied.

A first air vent 41 is formed on the rear surface side and a second air vent 42 is formed on the near side to carry out ventilation of the interior and the exterior at the kitchen cabinet 2 installed with the induction cooking appliance of the fourteenth embodiment. A vent hole 43 for communicating the internal space of the kitchen cabinet 2 and the internal space of the main case 22 is formed in the front surface wall 22*a* of the main case 22 of the induction cooking appliance. The second air vent 42 is formed in a region on the left side than the middle of the front surface wall 22*a* of the main case 22. The opening area of the vent hole 43 is substantially the same as the second air vent 42 in the kitchen cabinet 2, and the vent hole 43 is arranged substantially facing the second air vent 42.

In the induction cooking appliance of the fourteenth embodiment, the inner configuration of the sub-cases 19A, 19B and the exhaust flow path configuration (first exhaust flow path 320 and second exhaust flow path 34) are the same as the induction cooking appliance of the seventh embodiment shown in FIG. 10.

The operation in the induction cooking appliance of the fourteenth embodiment configured as above will now be described.

In the induction cooking appliance of the fourteenth embodiment, the flow of the respective cooling wind C from the interior of the sub-cases 19A, 19B to the first exhaust flow path 320 is the same as the operation in the induction cooking appliance of the seventh embodiment show in FIG. 10.

One part of the cooling wind C that reached the first exhaust flow path 320 is passed through the vent hole 43 and discharged to the interior of the kitchen cabinet 2. The remaining cooling wind C that reached the first exhaust flow path 320 is passed through the first exhaust flow path 320 and the second exhaust flow path 340 so that the direction is changed 180 degrees, and then discharged from the exhaust port 21 arranged on the left side in the rear surface wall 22*d* of the main case 22.

As described above, at least one part of the cooling wind C that reached the first exhaust flow path 320 is rectified while flowing through the second exhaust flow path 340, and is rectified to the flow in which the flow vector in the direction from the near side to the rear surface side is the main stream. Therefore, the cooling wind C is grown to a flow speed of a certain extent when discharged from the exhaust port 21, and becomes a flow in which the direction is clearly defined to be from the near side to the rear surface side of the induction cooking appliance. The direction exhausted from the exhaust port 21 is the direction of moving away from the intake ports 20*a*, 20*b*, and thus the air exhausted from the exhaust port 21 and heated is less likely to be taken in again from the intake ports 20*a*, 20*b*, and the cooling performance is enhanced.

The direction of the flow of air exhausted from the exhaust port 21 is the direction on the rear surface side of the kitchen cabinet 2, and reaches the first air vent 41, so that the air exhausted from the exhaust port 21 is less likely to be taken in again from the intake ports 20*a*, 20*b*.

As described above, in the induction cooking appliance of the fourteenth embodiment, one part of the cooling wind C flowing to the sub-cases 19A, 19B traverses the first exhaust flow path 320 to pass through the vent hole 43 or the gap formed in the front surface wall 22*a* of the main case 22 and be exhausted.

In the configuration of the fourteenth embodiment, the second air vent 42 of the kitchen cabinet 2 is formed at a position facing the vent hole 43 of the main case 22. Thus, the majority of the cooling wind C discharged from the vent hole 43 is discharged to outside of the kitchen cabinet 2 through the second air vent 42. Therefore, the cooling wind C exhausted from the vent hole 43 hits the front surface wall of the kitchen cabinet 2 to have the direction changed, and the amount remaining inside the kitchen cabinet 2 without being discharged to outside of the kitchen cabinet 2 becomes a minimum.

In the configuration of the fourteenth embodiment, the induction cooking appliance is installed in the kitchen cabinet 2 so that the second air vent 42 of the kitchen cabinet 2 is arranged at a position facing the vent hole 43 of the main case 22. Thus, the cooling wind C taken in again from the intake ports 20*a*, 20*b* is minimized in the entire cooling wind discharged from the induction cooking appliance, and the cooling performance can be enhanced.

In the configuration of the fourteenth embodiment, one part of the mixed wind after one part of the cooling wind C is mixed in the first exhaust flow path 320 is discharged since the vent hole 43 is formed on the left side than the central part of the front surface wall 22*a* of the main case 22. Thus, the cooling wind C which is evened to a certain extent and whose temperature rise is suppressed is discharged from the vent hole 43, and discharged to outside of the kitchen cabinet 2 through the second air vent 42. Thus, the temperature rise of the exhaust air that contacts the user in the kitchen is suppressed, so that the user can comfortably use the induction cooking appliance.

In the configuration of the fourteenth embodiment, the cooling wind contacts the inner surface of the front surface wall of the kitchen cabinet 2 to have the direction changed 180 degrees so as to be prevented from remaining inside without being exhausted to the exterior of the kitchen cabinet 2. Thus, the local temperature rise in the interior of the kitchen cabinet 2 can be suppressed, the rise in temperature of the intake air is suppressed as a result, and the high output heat cooking can be performed for a long time.

In the fourteenth embodiment, the vent hole 43 is constantly opened, but it is not restricted thereto and the shielding plate for completely shielding the vent hole 43 can be attached from the outer side of the main case 22.

According to such configuration, if the second air vent 42 is formed on the near side of the kitchen cabinet 2 when installing the induction cooking appliance in the kitchen cabinet 2, the vent hole 43 is to be opened without attaching the shielding plate. According to such configuration, one part of the cooling wind C can be discharged to outside of the kitchen cabinet 2 through the second air vent 42 as in the induction cooking appliance of the fourteenth embodiment, and the intake—exhaust configuration in which the cooling wind is less likely to be taken in again from the intake port 20 is realized.

If the air vent is not arranged on the near side of the kitchen cabinet 2 and the first air vent 41 is arranged only on the rear surface side of the kitchen cabinet 2, the shielding plate is to be attached to shield the vent hole 43. Thus, in the case of the kitchen cabinet 2 having a configuration in which the ventilation of the interior and the exterior of the kitchen cabinet 2 is carried out by the first air vent 41 on the rear surface side, all the cooling wind C is discharged from the exhaust port 21 arranged in the rear surface wall 22*d* of the main case 22 by blocking the vent hole 43 using the shielding plate. As a result, the intake—exhaust configuration the cooling wind exhausted from the exhaust port 21 is less likely to be taken in again from the intake ports 20*a*, 20*b* is obtained.

With the configuration in which the shielding plate can be attached, a more versatile induction cooking appliance can be realized since it can be installed in the kitchen cabinet 2 having various ventilation configurations. The shielding plate may be fixed at a plurality of different positions in the main case 22, and the opening area and the opening position of the vent hole 43 may be adjusted. According to such configuration, the versatility with respect to the installation of the kitchen cabinet 2 can be further enhanced.

In the configuration of the induction cooking appliance having a plurality of heating regions, if a plurality of control circuits are arranged in correspondence with each heating region, the flow path of the cooling wind flowing through the interior of the main body becomes complex and the pressure loss increases due to the necessity to cool a plurality of places in the main case. As a result, a large blower device becomes necessary, and the entire device enlarges. According to the present invention, however, with the configuration of the induction cooking appliance including a plurality of heating regions shown in the seventh embodiment to the fourteenth embodiment, in particular, an efficient intake—exhaust is realized, and response can be made with a small blower device.

Fifteenth Embodiment

Figure 18:
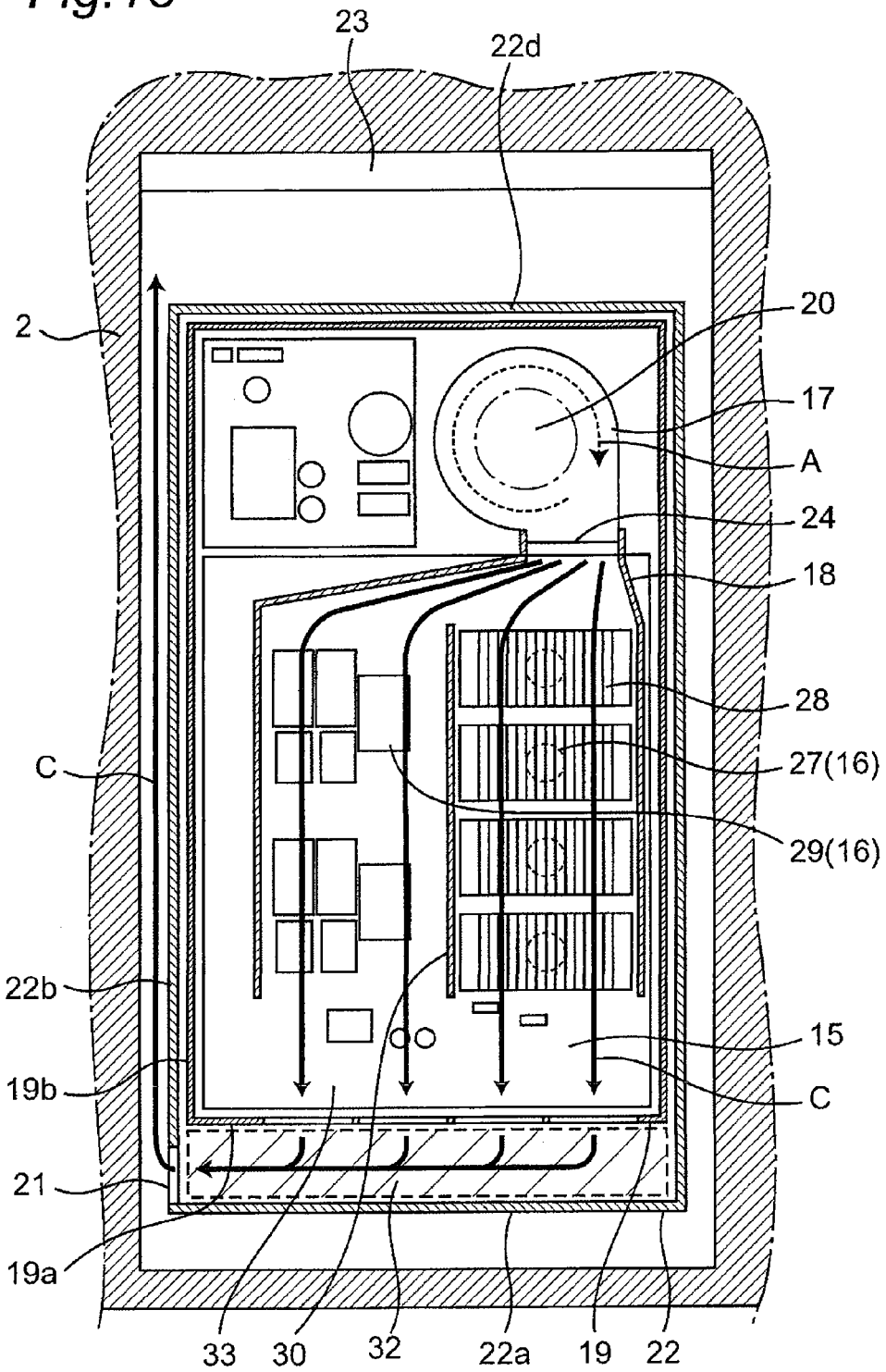
FIG. 18 is a horizontal cross-sectional view showing an internal configuration of an induction cooking appliance of a fifteenth embodiment according to the present invention.

An induction cooking appliance of a fifteenth embodiment according to the present invention will be hereinafter described with reference to the accompanied drawings. FIG. 18 is a horizontal cross-sectional view showing an internal configuration of an induction cooking appliance of the fifteenth embodiment according to the present invention. In the induction cooking appliance of the fifteenth embodiment, two heating regions 12*a*, 12*b* are arranged as in the first embodiment shown in FIG. 1. The induction cooking appliance of the fifteenth embodiment is configured to include an induction heating block 33 having the same configuration as the induction heating block 33 in the induction cooking appliance (refer to FIG. 3) of the first embodiment. In the induction cooking appliance of the fifteenth embodiment, the basic configuration is the same as the induction cooking appliance of the first embodiment, and hence the different aspects will be centrally described. In the following description of the fifteenth embodiment, the same reference numerals are denoted on the configuring elements having the same functions and configurations as the configuring elements in the induction cooking appliance of the first embodiment, so that the detailed description thereof is omitted and the description of the first embodiment is applied.

As shown in FIG. 18, in the induction cooking appliance of the fifteenth embodiment, the exhaust port 21 is formed in the vicinity of the front surface wall 22*a* in the left side surface wall 22*b* of the main case 22. In other words, the exhaust port 21 is formed on the near side in the left side surface wall 22*b*, is arranged in the flow path direction (left direction in FIG. 18) in the first exhaust flow path 32, and is communicated to the first exhaust flow path 32.

In the fifteenth embodiment, the front surface wall 22*a* of the main case 22 is arranged in the wind direction of the cooling wind C sent from the blower device 17 to the control circuit 15. The first exhaust flow path 32 is configured by the front surface wall 22*a*. The intake port 20 is formed on the rear surface side of the bottom surface plate 22*c* of the main case 22, and the exhaust port 21 is formed in the left side surface wall 22*b* of the main case 22. In the configuration of the fifteenth embodiment, the front surface wall 22*a* of the main case 22 corresponds to the first side surface wall.

The operation in the induction cooking appliance of the fifteenth embodiment configured as above will now be described.

In the induction heating block 33, the cooling wind C taken in from the intake port 20 by the blower device 17 is blown out in the direction of the near side from the blower device 17 to cool the control circuit 15. The cooling wind C blown out in the direction of the near side from the blower device 17 is guided by the duct 18 to cool each heat generating component 16 (switching element 27, resonance capacitor 29, etc.) of the control circuit 15. The cooling wind C that cooled each heat generating component 16 is flowed towards the direction of the near side as is to pass through the vent hole of the front surface wall 19*a* of the first sub-case 19 and reach the first exhaust flow path 32, which is the front surface exhaust flow path.

In the first exhaust flow path 32, the cooling wind C from the first sub-case 19 contacts the front surface wall 22*a* of the main case 22 so that the flow of the cooling wind C is bent substantially 90 degrees. As the right end of the first exhaust flow path 32 is closed, the cooling wind C is flowed in the left direction through the first exhaust flow path 32, and is discharged from the exhaust port 21 formed in the left side surface wall 22*b* of the main case 22.

The cooling wind C discharged from the exhaust port 21 is flowed in the left direction in the first exhaust flow path 32, and thus becomes a flow in which the flow vector in the left direction is the main stream. Thus, the cooling wind C discharged from the exhaust port 21 hits the inner wall surface of the kitchen cabinet 2 facing the exhaust port 21. The cooling wind that hit the inner wall surface of the kitchen cabinet 2 is bent substantially 90 degrees to flow in the direction of the rear surface side since the near side is blocked and the air vent 23 is arranged in the rear surface side. In this case, the cooling wind C flows along the space between the inner wall surface of the kitchen cabinet 2 and the left side surface wall 22*b* of the main case 22 of the induction cooking appliance. Therefore, the cooling wind C discharged from the exhaust port 21 becomes a flow in the direction of the rear surface side by simply being bent substantially 90 degrees, and is flowed while maintaining a flow speed of a certain extent. Therefore, the cooling wind is less likely to be taken in again from the intake port 20 formed in the bottom surface plate 22*c* of the main case 22, and the cooling performance is enhanced in the induction cooking appliance of the fifteenth embodiment. Furthermore, the exhaust air that contact the inner wall surface of the kitchen cabinet 2 and became a flow in the direction of the rear surface side reaches the air vent 23 as is, and thus is less likely to be taken in again from the intake port 20.

In the configuration of the fifteenth embodiment, the flow path in which the cooling wind C taken in from the intake port 20 by the blower device 17 and sent from the rear surface side to the near side cools the control circuit 15 and reaches the exhaust port 21 of the left side surface wall 22*b* is bent in the clockwise direction by substantially 90 degrees when seen from the vertically upward direction. Therefore, in the flow path, the pressure loss may occur, the number of rotations of the blower device 17 may lower, the flow rate of the cooling wind C may reduce, and the cooling performance may lower.

However, in the fifteenth embodiment, the sirocco fan is used for the blower device 17, where the flow of the cooling wind C blown out from the sirocco fan includes the flow vector component in the clockwise direction or the rotating direction of the sirocco fan.

Thus, the flow path that bends in the clockwise direction from the intake port 20 to the exhaust port 21 is the same rotating direction as the flow vector of the cooling wind C blown out from the sirocco fan. Therefore, if the flow path causes the flow to bend at substantially 90 degrees as in the fifteenth embodiment, the disturbance of the flow is less likely to occur in the flow path. Therefore, in the induction cooking appliance of the fifteenth embodiment, the pressure loss of the entire flow path is reduced, and the reduction of the flow rate of the cooling wind can be suppressed.

In the induction cooking appliance of the fifteenth embodiment, the noise generated by the disturbance of the flow in the flow path is reduced since the disturbance of the flow in the cooling wind C is reduced as described above.

When the cooling wind C exhausted from the exhaust port 21 hits the inner wall surface of the kitchen cabinet 2 facing the exhaust port 21, the cooling wind C includes the flow vector in the clockwise direction or the rotating direction of the sirocco fan, and thus bends in the clockwise direction and easily becomes the flow in the direction of the rear surface side. Therefore, in the induction cooking appliance of the fifteenth embodiment, the lowering in the flow speed in the cooling wind C is suppressed, and the cooling wind C from the exhaust port 21 is less likely to be taken in again from the intake port 20.

In the kitchen cabinet 2 in which the induction cooking appliance of the fifteenth embodiment is arranged, the air vent 23 communicating the interior and the exterior of the kitchen cabinet 2 is not arranged on the near side nor the upper surface side of the kitchen cabinet 2, and is arranged only on the rear surface side of the kitchen cabinet 2 near the intake port 20. Therefore, the ventilation operation through the internal space of the kitchen cabinet 2 in the induction cooking appliance becomes smooth by arranging the air vent 23 for communicating the interior and the exterior of the kitchen cabinet 2 on the rear surface side. Thus, the comfortable operation and cooking can be carried out without the ventilation wind directly hitting the user by arranging the induction cooking appliance of the fifteenth embodiment in the kitchen cabinet 2.

The induction cooking appliance of the fifteenth embodiment has a configuration that does not need to form an open portion in the upper surface of the kitchen cabinet 2. Thus, water vapor and oil smoke are less likely to enter inside the kitchen cabinet 2 and the induction cooking appliance, and the wind noise generated when taking in or exhausting air is also reduced.

In the induction cooking appliance of the fifteenth embodiment, an opening such as the intake port 20 and the exhaust port 21 is not formed in the top plate 4, and hence the degree of freedom of design of the top plate 4 is greatly enhanced.

In the induction cooking appliance of the fifteenth embodiment, the air on the lower side of the internal space of the kitchen cabinet 2 where the temperature is relatively low can be taken in since the intake port 20 is arranged at the bottom surface plate 22*c* of the main case 22. Furthermore, the high temperature exhaust air flows to the upper side in the internal space of the kitchen cabinet 2 since the exhaust port 21 is formed in the left side surface wall 22*b* and not the bottom surface plate 22*c* of the main case 22. As a result, in the induction cooking appliance of the fifteenth embodiment, the intake—exhaust configuration in which the cooling wind C discharged from the exhaust port 21 is less likely to be taken in again from the intake port 20 is provided.

A shielding plate for shielding the space between the intake port 20 and the exhaust port 21 of the induction cooking appliance may be arranged inside the kitchen cabinet 2 to more reliably prevent the wind from being taken in again.

In the configuration of the fifteenth embodiment, an example in which the exhaust port 21 is formed near the front surface wall 22*a* of the left side surface wall 22*b* of the main case 22 has been described, but is not limited to such configuration. For instance, the exhaust port 21 may be formed on the near side in the bottom surface plate 22*c* and near the left side surface wall 22*b*. In such configuration as well, the cooling wind C is bent substantially 90 degrees, flowed through the first exhaust flow path 32 in the left direction and then exhausted from the exhaust port 21, so that similar effects can be obtained. The exhaust port 21 may be formed in the right side surface wall 22*e* instead of the left side surface wall 22*b*.

In the first exhaust flow path 32, the gap between the sub-case 19 and the main case 22 is specially formed, but a similar exhaust flow path may be formed using one part of the side surface wall (front surface wall 22*a*, left side surface wall 22*b*, bottom surface plate 22*c*, and right side surface wall 22*e*) of the main case 22, the lower surface of the radiator plate 10 mounted with the coil unit 8, and the side surface wall (front surface wall 19*a*, left side surface wall 19*b* and right side surface wall) of the sub-case 19 without separately forming a duct or the like. Thus, the space can be saved by forming the exhaust flow path using one part of the radiator plate 10, the sub-case 19 for mounting the control circuit 15, and the main case 22 for covering the entire device.

Furthermore, the cooling effect of the radiator plate 10 can be enhanced and the temperature of the heating coil 5 can be lowered by forming the exhaust flow path using the lower surface of the radiator plate 10. Such configuration does not need to directly cool the heating coil 5, and thus the flow path of the cooling wind C to the heating coil 5 does not need to be formed. As a result, the induction cooking appliance can be thinned and the space can be saved.

In the induction cooking appliance of the fifteenth embodiment, the cooling wind C that cooled the heating coil 5, the heat generating component 16, and the like and whose temperature is raised is immediately exhausted to the exterior of the main case 22 without making contact with other electronic components. Thus, in the induction cooking appliance, the other electronic components etc. are prevented from being heated by the cooling wind C, whose temperature is raised, so that the temperature is prevented from being raised.

In the induction cooking appliance of the fifteenth embodiment, a particularly large component that inhibits the flow of the cooling wind C is not used, and the cooling wind C smoothly flows in the direction of the near side through the sub-case 19. Thus, in the induction cooking appliance of the fifteenth embodiment, the pressure loss is reduced.

In the induction cooking appliance of the fifteenth embodiment, the space on the lower side of the operation portion 36 can be used as the first exhaust flow path 32. Thus, the space can be saved using the dead space in the internal space of the induction cooking appliance.

In the induction cooking appliance of the fifteenth embodiment, the cooling wind C is not mixed between the flow in which the cooling wind C from the blower device 17 on the rear surface side flows in the direction of the near side by the duct 18 and the side surface wall of the sub-case 19 to become the flow leading to the first exhaust flow path 32, and the flow in which the direction is changed substantially 180 degrees to be directed from the near side to the rear surface side. Thus, the short circuit does not occur inside the induction cooking appliance, and each heat generating component 16 inside the induction cooking appliance can be reliably and stably cooled. Furthermore, as the disturbance of flow by the mixed flow does not occur inside the induction cooking appliance, the air is exhausted without the magnitude of the flow vector in the direction from the near side to the rear surface side being attenuated in the induction cooking appliance. As a result, the induction cooking appliance of the fifteenth embodiment has a configuration in which the exhaust air discharged from the exhaust port 21 is less likely to be taken in again from the intake port 20, so that the cooling performance is enhanced.

If the component that particularly requires forced air cooling in the induction cooking appliance is only the heat generating component 16 attached to the heat sink 28, the radiator plate 10 and the heat sink 28 may be used in place of the duct 18 for guiding the cooling wind C. For instance, the lower surface of the radiator plate 10 may be used as the upper wall in the duct, and the fin on the outermost side of the heat sink 28 may be extended to be used as the side surface wall of the duct.

Through the use of the radiator plate 10 and the heat sink 28, the cooling wind C does not mix between the flow from the blower device 17 on the rear surface side towards the direction of the near side to the first exhaust flow path 32 and the flow in which the direction is changed substantially 180 degrees to flow in the direction from the near side to the rear surface side inside the induction cooking appliance even if the side surface wall of the sub-case 18 and the duct 18 are not arranged. Thus, the short circuit does not occur inside the induction cooking appliance, and each component inside the induction cooking appliance can be reliably and stably cooled.

In the induction cooking appliance of the fifteenth embodiment, the cooling wind C exhausted from the exhaust port 21 is less likely to be taken in by the intake port 20 even if nothing is provided between the intake port 20 and the exhaust port 21 opened to the internal space of the kitchen cabinet 2. However, the air exhausted from the exhaust port 20 is more reliably prevented from being taken in again by the intake port 20 by arranging a partition plate that blocks the flow of the cooling wind C between the intake port 20 and the exhaust port 21, so that the cooling performance can be further enhanced.

The partition plate desirably has a configuration that completely divides the region where the intake port 20 is arranged and the region where the exhaust port 21 is arranged in the internal space of the kitchen cabinet 2. However, the partition plate may exhibit the effect with a configuration that guides the flow of the air flow by arranging the partition plate at one part of the internal space rather than completely dividing the region where the intake port 20 is arranged and the region where the exhaust port 21 is arranged.

In the induction cooking appliance of the fifteenth embodiment, a configuration using the duct 18 that forms the flow path to guide the cooling wind C from the blowing port 24 of the blower device 17 to the heat generating component 16 in the control circuit 15, the infrared sensor 13, and the like has been described, but the present invention is not limited to such configuration of the duct 18 and may be configured merely with a flat plate guide plate.

The above described guide plate may be configured to rise from the bottom surface plate 22*c* of the main case 22. In another configuration, the guide plate may be arranged on the lower surface of the radiator plate 10 arranged on the upper side of the control circuit 15 and the like, and the radiator plate 10 and the guide plate may be integrally configured.

In the configuration of the fifteenth embodiment, an example in which one intake port 20 is arranged on the rear surface side in the bottom surface plate 22*c* of the induction cooking appliance, and one exhaust port 21 is arranged on the left side surface wall 22*b* of the induction cooking appliance has been described, but the present invention is not limited to such configuration. For instance, with the intake port 20 and the exhaust port 21 of the fifteenth embodiment as a main intake port and a main exhaust port, an auxiliary intake port and exhaust port with lesser air intake quantity and air exhaust quantity may be added to other side surface wall and bottom surface plate in the induction cooking appliance.

If the auxiliary intake port and exhaust port are arranged in plurals on the left side surface wall 22*b*, the bottom surface plate 22*c*, the rear surface wall 22*d*, and the like of the main case 22 in the induction cooking appliance, even when installed such that one part of the inner wall of the kitchen cabinet incorporating the induction cooking appliance is proximate to one of the intake ports or the exhaust ports, the air can be taken in and the air can be exhausted from the intake port and the exhaust port provided at other places, so that rise in pressure loss can be prevented.

Sixteenth Embodiment

Figure 19:
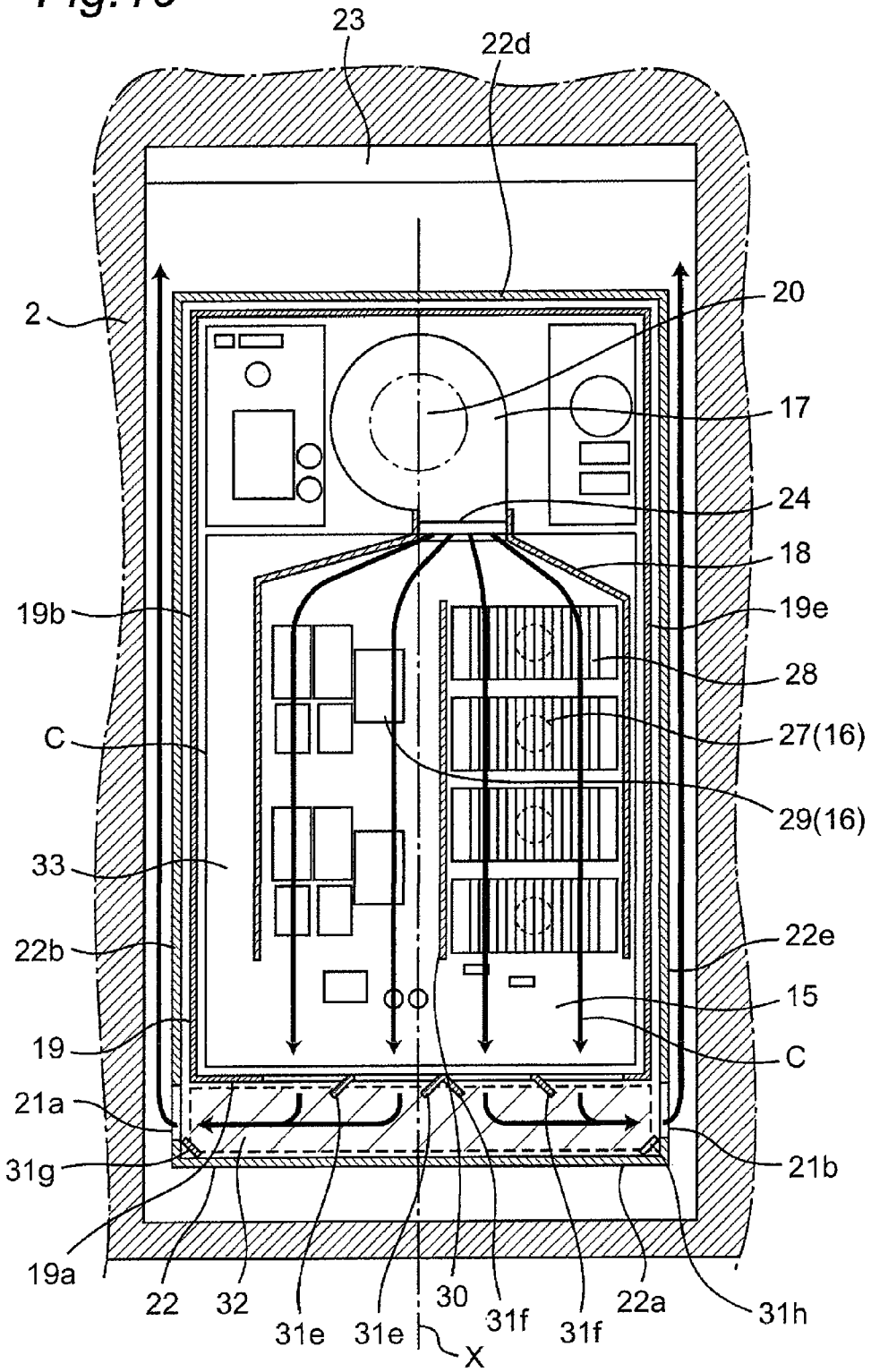
FIG. 19 is a horizontal cross-sectional view showing an internal configuration of an induction cooking appliance of a sixteenth embodiment according to the present invention.

An induction cooking appliance according to a sixteenth embodiment of the present invention will be hereinafter described with reference to the accompanied drawings. FIG. 19 is a horizontal cross-sectional view showing an internal configuration of an induction cooking appliance of the sixteenth embodiment according to the present invention. In the induction cooking appliance of the sixteenth embodiment, the basic configuration is the same as the induction cooking appliance of the first embodiment, and hence the different aspects will be centrally described. In the following description of the sixteenth embodiment, the same reference numerals are denoted on the configuring elements having the same functions and configurations as the configuring elements in the induction cooking appliance of the first embodiment, so that the detailed description thereof is omitted and the description of the first embodiment is applied.

As shown in FIG. 19, in the induction cooking appliance of the sixteenth embodiment, the cooling wind C from the blower device 17 arranged at substantially the middle of the rear surface side is guided by the duct 18 to cool each heat generating component 16 and flow into the first exhaust flow path 32. The intake port 20 for taking in air to the blower device 17 is formed at substantially middle on the rear surface side in the bottom surface plate 22*c* of the main case 22. The cooling wind C that reached the first exhaust flow path 32 is divided and flowed to the left and right, and exhausted from the exhaust ports 21*a*, 21*b*. The exhaust ports 21*a*, 21*b* are formed in the vicinity (near side) of the left side surface wall 22*b* and the right side surface wall 22*e* of the main case 22.

A plurality of flow path guiding plates 31*e*, 31*f* is arranged in a region where the flow of the cooling wind C is bent substantially 90 degrees when the cooling wind C flows into the first exhaust flow path 32 from the interior of the sub-case 19. The flow path guiding plates 31*e*, 31*f* are arranged inclined by substantially 45 degrees with respect to the direction of the flow from the rear surface side to the near side of the induction cooking appliance. The cooling wind C from the sub-case 19 is smoothly bent substantially 90 degrees to flow through the first exhaust flow path 32. The plurality of flow path guiding plates 31*e*, 31*f* are arranged at the open portion of the front surface wall 19*a* of the sub-case 19, where the flow path guiding plate 31*e* of the left side region and the flow path guiding plate 31*f* of the right side region are inclined in different directions. The flow path guiding plate 31*e* of the left side region is inclined to flow the majority of the cooling wind C of the left side region of the branched plate 30 in the sub-case 19 to the exhaust port 21*a* in the left side.

The flow path guiding plate 31*f* of the right side region is inclined to flow the majority of the cooling wind C of the right side region of the branched plate 30 in the sub-case 19 to the exhaust port 21*b* in the right side.

Furthermore, in the first exhaust flow path 32, a flow path guiding plate 31*g* is arranged at a corner portion on the near side of the left side configured by the front surface wall 22*a* and the left side surface wall 22*b* of the main case 22. The flow path guiding plate 31*g* is arranged inclined so that the cooling wind C of the first exhaust flow path 32 is smoothly exhausted from the exhaust port 21*a* on the left side without the cooling wind C flowing to the corner portion of the front surface wall 22*a* and the left side surface wall 22*b* of the main case 22. Similarly, in the first exhaust flow path 32, a flow path guiding plate 31*h* is arranged at a corner portion on the near side of the right side configured by the front surface wall 22*a* and the right side surface wall 22*e* of the main case 22. The flow path guiding plate 31*h* is arranged inclined so that the cooling wind C of the first exhaust flow path 32 is smoothly exhausted from the exhaust port 21*b* on the right side without the cooling wind C flowing to the corner portion of the front surface wall 22*a* and the right side surface wall 22*e* of the main case 22.

As described above, in the induction cooking appliance of the sixteenth embodiment, as shown in the horizontal cross-sectional view of FIG. 19, the intake port of the bottom surface plate 22*c* of the main case 22 is formed at substantially the middle, and the two exhaust ports 21*a*, 21*b* are formed at positions substantially horizontally symmetric with respect to the center line X in which the center axis direction in the induction cooking appliance including the center of the intake port 20 is the front and back direction. The position and the angle of the plurality of flow path guiding plates 31*e*, 31*f*, 31*g*, 31 *h* are also basically substantially horizontally symmetric with respect to the above described center line X.

In the induction cooking appliance of the sixteenth embodiment, the front surface wall 22*a* of the main case 22 is arranged in the wind direction of the cooling wind C sent from the blower device 17 arranged on the rear surface side to the control circuit 15. The first exhaust flow path 32 is configured by the front surface wall 22*a*. The intake port 20 is arranged at substantially the middle on the rear surface side in the bottom surface plate 22*c* of the main case 22, and the exhaust ports 21*a*, 21*b* are arranged on the left side surface wall 22*b* and the right side surface wall 22*e* of the main case 22. In the configuration of the sixteenth embodiment, the front surface wall 22*a* of the main case 22 corresponds to the first side surface wall.

The operation in the induction cooking appliance of the sixteenth embodiment configured as above will now be described.

In the induction cooking appliance of the sixteenth embodiment, the cooling wind C from the blower device 17 arranged on the rear surface side at substantially the middle is guided by the duct 18 to cool each heat generating component 16 of the control circuit 15, and is passed through the opening of the front surface wall 19*a* of the sub-case 19 to flow to the first exhaust passage 32.

A plurality of flow path guiding plates 31*e*, 31*f* inclined with respect to the flowing direction of the cooling wind C in the sub-case 19 is arranged at the opening of the front surface wall 19*a* of the sub-case 19. At the opening of the front surface wall 19*a* of the sub-case 19, the flow path guiding plate 31*e* on the left side arranged in the left region from substantially the middle is arranged inclined by substantially 45 degrees to the left with respect to the flowing direction from the rear surface side to the near side in the sub-case 19 so that the cooling wind C from the sub-case 19 flows in the left direction through the first exhaust flow path 32.

On the other hand, the flow path guiding plate 31*f* on the right side arranged in the right region from substantially the middle at the opening of the front surface wall 19*a* is arranged inclined by substantially 45 degrees to the right with respect to the flowing direction from the rear surface side to the near side in the sub-case 19 so that the cooling wind C from the sub-case 19 flows in the right direction through the first exhaust flow path 32. The branched position of the flow path guiding plate 31*e* on the left side and the flow path guiding plate 31*f* on the right side is on substantially the extended line of the branched plate 30 arranged on the inner side of the duct 18 in the sub-case 19, and is on substantially the center line X.

Since the plurality of flow path guiding plates 31*e*, 31*f* are arranged at the opening of the front surface wall 19*a* of the sub-case 19 as described above, the cooling wind C exhausted from the opening of the front surface wall 19*a* of the sub-case 19 is smoothly divided to the left and the right, and flowed through the first exhaust flow path 32.

In the configuration of the sixteenth embodiment, since the inclined flow path guiding plates 31*e*, 31*g* are arranged at both end portions of the first exhaust flow path 32, the cooling wind C flowing to the left and the right through the first exhaust flow path 32 can be smoothly exhausted from the left and right exhaust ports 21*a*, 21*b*.

The cooling wind C flowing to the left and the right through the first exhaust flow path 32 has the flow vector towards the left direction or the right direction as the main stream. Thus, even if brought into contact with the inner wall surface of the kitchen cabinet 2 facing the exhaust ports 21*a*, 21*b*, the cooling wind C becomes a flow in the direction (backward) of the rear surface side by simply being further bent 90 degrees, and is flowed while maintaining the flow speed of a certain extent. As a result, the induction cooking appliance of the sixteenth embodiment has a configuration in which the cooling wind C discharged from the exhaust ports 21*a*, 21*b* is less likely to be taken in again from the intake port 20 at the central portion of the main case 22, and has a high cooling performance.

In the induction cooking appliance of the sixteenth embodiment, the air exhausted from the exhaust ports 21*a*, 21*b* is flowed along the outer surface of the left side surface wall 22*b* and the right side surface wall 22*e* of the main case 22 to the air vent 23 formed on the rear surface side of the kitchen cabinet 2. Thus, the induction cooking appliance of the sixteenth embodiment has a configuration in which the air exhausted from the exhaust ports 21*a*, 21*b* is less likely to be taken in again from the intake port 20.

In the induction cooking appliance of the sixteenth embodiment, the flow of the cooling wind C becomes smooth and the pressure loss is reduced by arranging the flow path guiding plates 31*e*, 31*f*, 31*g*, 31 *h* at the portions where the flow of the cooling wind C is greatly bent. Thus, in the cooling wind C, the occurrence of the disturbance of flow is reduced, and the flow of air discharged from the exhaust ports 21*a*, 21*b* grows to a greater flow speed to become an exhaust air in which the flowing direction is clearly defined. As a result, the air exhausted from the exhaust ports 21*a*, 21*b* and heated is suppressed from being taken in again from the intake port 20 at the central portion of the main case 22, and the cooling performance is enhanced.

In the induction cooking appliance of the sixteenth embodiment, the flow path configuration (first exhaust flow path 32 and exhaust ports 21*a*, 21*b*) of the cooling wind C is substantially symmetric with respect to the center line X in which the center axis direction in the induction cooking appliance is the front and back direction, and thus the heated air is dispersed to about half each and then exhausted from the left and right exhaust ports 21*a*, 21*b*. As a result, the local temperature rise in the region on the rear surface side in the internal space of the kitchen cabinet 2 is suppressed, and hence the temperature is raised substantially evenly without variation in the entire internal space of the kitchen cabinet 2.

Furthermore, in the configuration of the induction cooking appliance of the sixteenth embodiment, the cooling wind C, which became a heated air, flows along both side surface walls 22*b*, 22*e* of the main case 22, and thus the heat of the cooling wind C is transmitted to both side surface walls 22*b*, 22*e* and the bottom surface plate 22*c* thus raising the temperature of the main case 22. However, the cooling wind C is divided, and the heat conduction to both side surface walls 22*b*, 22*e* and the bottom surface plate 22*c* is also substantially symmetric with respect to the center line X. Therefore, the induction cooking appliance of the sixteenth embodiment has the local temperature rise suppressed in the main case 22 configured by the side surface walls 22*b*, 22*e* and the bottom surface plate 22*c*.

In the induction cooking appliance of the sixteenth embodiment, the plurality of flow path guiding plates 31*e*, 31*f*, 31*g*, 31 *h* are arranged at the front surface wall 19*a* of the sub-case 19, but a partition plate for separating the cooling wind C to the left and the right may be arranged at substantially the middle of the first exhaust flow path 32 to more reliably separate the cooling wind C in the first exhaust flow path 32. The partition plate preferably has a configuration of being inclined with respect to the flowing direction of the cooling wind C so that the cooling wind C is separated to the left and right and then smoothly flowed.

If the amount of heat generation in each heat generating component 16 arranged on the inner side of the duct 18 is asymmetric with respect to the center line X, the temperature of the cooling wind C discharged from the duct 18 differs between the left and right regions. Thus, the temperature of the cooling wind C discharged from the left and right exhaust ports 21*a*, 21*b* and the temperature of both side surface walls 22*b*, 22*e* and the bottom surface plate 22*c* also may become uneven between the left and the right.

Therefore, if the amount of heat generation of the heat generating component 16 in the duct 18 is asymmetric with respect to the center line X, the tilt angle, the shape, and the number of the flow path guiding plates 31*e*, 31*f* are preferably adjusted so that the heat quantity of the air discharged from the exhaust ports 21*a*, 21*b* is substantially equal. For instance, the tilt angle of the flow path guiding plates 31*e*, 31*f* is adjusted so that the cooling wind C discharged from the left and right regions of the duct 18 are both directed to the central portion of the first exhaust flow path 32 (portion near center line X in which center axis direction in induction cooking appliance is front and back direction). At least one part of the cooling wind C is mixed at the central portion of the first exhaust flow path 32 by adjusting the tilt angle of the flow path guiding plates 31*e*, 31*f* in such manner, and thereafter, the cooling wind is separated to the left and right direction and discharged from the exhaust ports 21*a*, 21*b*. According to such configuration, the temperature difference of the cooling wind C divided to the left and the right in the first exhaust flow path 32 can be alleviated.

Seventeenth Embodiment

Figure 20:
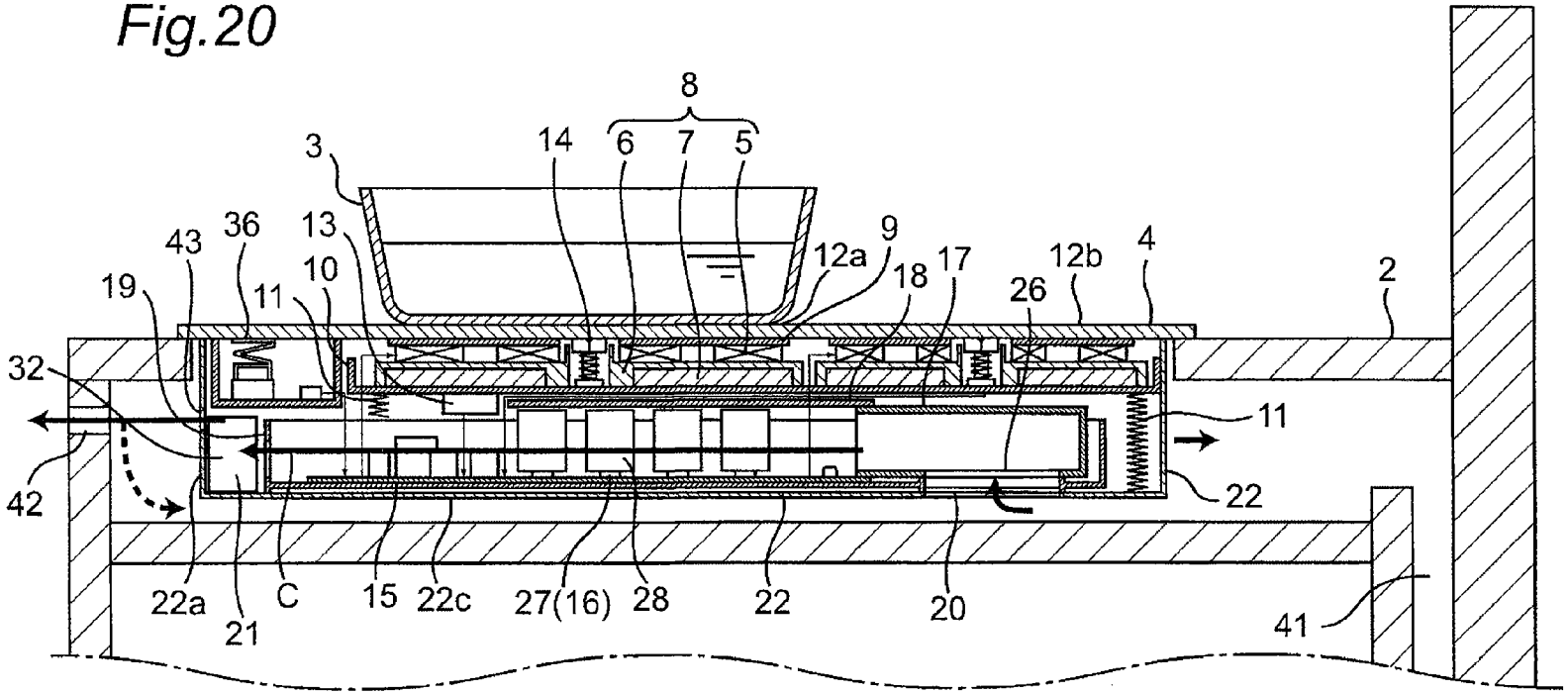
FIG. 20 is a horizontal cross-sectional view showing an internal configuration of an induction cooking appliance of a seventeenth embodiment according to the present invention.

An induction cooking appliance according to a seventeenth embodiment of the present invention will be hereinafter described with reference to the accompanied drawings. FIG. 20 is a cross-sectional view of the main parts showing a state in which the induction cooking appliance of the seventeenth embodiment according to the present invention is installed in the kitchen cabinet. In the induction cooking appliance of the seventeenth embodiment, the basic configuration is the same as the induction cooking appliance of the fifteenth embodiment shown in FIG. 18, and includes two heating regions 12*a*, 12*b*. In the following description of the seventeenth embodiment, the same reference numerals are denoted on the configuring elements having the same functions and configurations as the configuring elements in the induction cooking appliance of the fifteenth embodiment, so that the detailed description thereof is omitted and the description of the fifteenth embodiment is applied.

In the kitchen cabinet 2 installed with the induction cooking appliance of the seventeenth embodiment, the first air vent 41 is formed on the rear surface side and the second air vent 42 is formed on the near side to carry out ventilation between the interior and the exterior. A vent hole 43 communicating the internal space of the kitchen cabinet 2 and the internal space of the main case 22 is formed in the front surface wall 22*a* of the main case 22 of the induction cooking appliance. The opening area of the vent hole 43 is substantially the same as the second air vent 42 in the kitchen cabinet 2, and the vent hole 43 is arranged substantially facing the second air vent 42.

In the induction cooking appliance of the seventeenth embodiment, the internal configuration of the sub-case 19 and the exhaust flow path configuration (first exhaust flow path 320 and exhaust ports 21*a*, 21*b*) are the same as the induction cooking appliance of the fifteenth embodiment shown in FIG. 18 as described above.

In the seventeenth embodiment, the front surface wall 22*a* of the main case 22 is arranged in the wind direction of the cooling wind C sent from the blower device 17 to the control circuit 15. The first exhaust flow path 32 is configured by the front surface wall 22*a*. The intake port 20 is formed on the rear surface side of the bottom surface plate 22*c* of the main case 22, and the exhaust port 21 is formed in the left side surface wall 22*b* of the main case 22. In the configuration of the seventeenth embodiment, the front surface wall 22*a* of the main case 22 corresponds to the first side surface wall.

The operation in the induction cooking appliance of the seventeenth embodiment configured as above will now be described.

In the induction cooking appliance of the seventeenth embodiment, the flow of each cooling wind C from the interior of the sub-case 19 to the first exhaust flow path 32 is the same as the operation in the induction cooking appliance of the fifteenth embodiment shown in FIG. 18.

One part of the cooling wind C that reached the first exhaust flow path 32 is discharged to the interior of the kitchen cabinet 2 through the vent hole 43. The remaining cooling wind C that reached the first exhaust flow path 32 is flowed through the first exhaust flow path 32 in the left direction and discharged from the exhaust port 21.

As described above, at least the one part of the cooling wind C that reached the first exhaust flow path 32 is rectified while flowing through the first exhaust flow path 32, and is then rectified to the flow having the flow vector in the left direction as the main stream. Therefore, the cooling wind C is grown to a flow speed of a certain extent when discharged from the exhaust port 21, and becomes a flow in which the direction is clearly defined as being from the near side to the rear surface side of the induction cooking appliance. Even if the air exhausted from the exhaust port 21 hits the inner wall surface of the kitchen cabinet 2 facing the exhaust port 21, the cooling wind C becomes a flow in the direction (backward) of the rear surface side by simply being bent further by 90 degrees and is flowed while maintaining the flow speed of a certain extent. The direction of the flow is the direction of moving away from the intake ports 20*a*, 20*b*, and hence the cooling wind C exhausted from the exhaust port 21 is less likely to be taken in from the intake ports 20*a*, 20*b*, and hence the cooling performance is enhanced.

As the direction of flow of the cooling wind C exhausted from the exhaust port 21 is the direction of the rear surface side of the kitchen cabinet 2 and reaches the first air vent 41 as is, the cooling wind C exhausted from the exhaust port 21 is less likely to be taken in again from the intake ports 20*a*, 20*b*.

In the configuration of the seventeenth embodiment, the second air vent 42 of the kitchen cabinet 2 is formed at a position facing the vent hole 43 of the main case 22. The majority of the cooling wind C discharged from the vent hole 43 is discharged to outside of the kitchen cabinet 2 through the second air vent 42. Therefore, the cooling wind C exhausted from the vent hole 43 hits the front surface wall of the kitchen cabinet 2 to have the direction changed, and the amount remained in the kitchen cabinet 2 without being discharged to outside of the kitchen cabinet 2 can be minimized.

As described above, in the configuration of the seventeenth embodiment, the induction cooking appliance is installed in the kitchen cabinet 2 so that the second air vent 42 of the kitchen cabinet 2 is arranged at a position facing the vent hole 43 of the main case 22. Thus, the cooling wind C taken in again from the intake port 20 can be minimized for the cooling wind C discharged from the induction cooking appliance as a whole, and the cooling performance can be enhanced.

In the seventeenth embodiment, the vent hole 43 has been described as being opened at all times, but is not limited thereto, and may be a configuration capable of attaching a shielding plate for completely shielding the vent hole 43 from the outer side of the main case 22.

According to such configuration, if the second air vent 42 is arranged on the near side of the kitchen cabinet 2 when installing the induction cooking appliance in the kitchen cabinet 2, the vent hole 43 may be opened without attaching the shielding plate. According to such configuration, one part of the cooling wind C can be discharged to outside of the kitchen cabinet 2 through the second air vent 42 as in the induction cooking appliance of the seventeenth embodiment, so that the intake—exhaust configuration in which the exhausted cooling wind C is less likely to be again taken in from the intake port 20.

If the air vent is not arranged on the near side of the kitchen cabinet 2 and the first air vent 41 is arranged only on the rear surface side of the kitchen cabinet 2, the shielding plate may be attached to shield the vent hole 43. Thus, in the case of the kitchen cabinet 2 having a configuration of carrying out the ventilation of the interior and the exterior of the kitchen cabinet 2 by the first air vent 41 on the rear surface side, all the cooling wind C is discharged from the exhaust port 21 arranged on the left side surface wall 22*b* of the main case 22 by blocking the vent hole 43 using the shielding plate. As a result, the induction cooking appliance has an intake—exhaust configuration in which the cooling wind C exhausted from the exhaust port 21 is less likely to be again taken in from the intake ports 20*a*, 20*b*.

As described above, a highly versatile induction cooking appliance can be obtained since installation can be made to the kitchen cabinet 2 having various ventilation configurations with the configuration capable of attaching the shielding plate. Furthermore, the shielding plate may be fixed at a plurality of different positions in the main case 22 so that the opening area and the opening position of the vent hole 43 can be adjusted. The versatility with respect to the installation of the kitchen cabinet 2 can be further enhanced by configuring such configuration.

Eighteenth Embodiment

Figure 21:
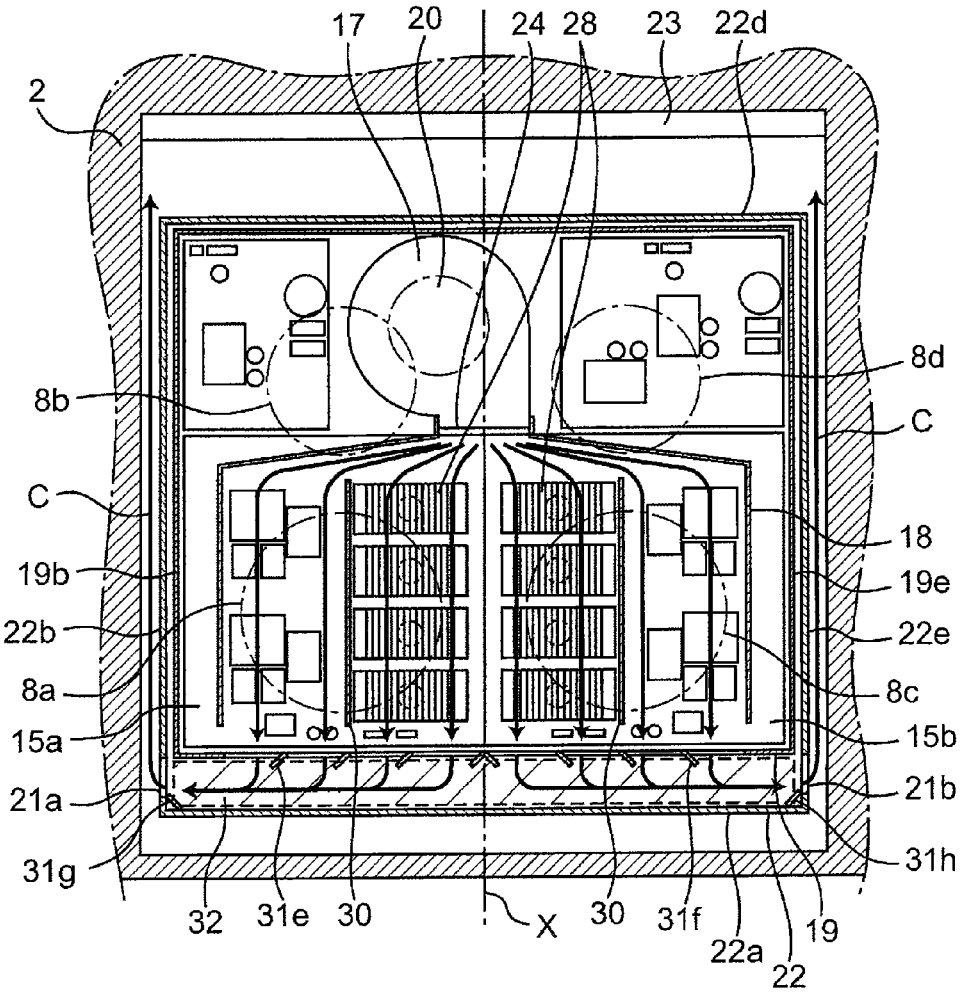
FIG. 21 is a horizontal cross-sectional view showing an internal configuration of an induction cooking appliance of an eighteenth embodiment according to the present invention.

An induction cooking appliance according to an eighteenth embodiment of the present invention will be hereinafter described with reference to the accompanied drawings. FIG. 21 is a horizontal cross-sectional view showing an internal configuration of the induction cooking appliance of the eighteenth embodiment of the present invention. The induction cooking appliance of the eighteenth embodiment has a configuration of including four heating regions 12*a*, 12*b*, 12*c*, 12*d* as in the sixth embodiment shown in FIG. 8. In the following description of the eighteenth embodiment, the same reference numerals are denoted on the configuring elements having the same functions and configurations as the configuring elements in the induction cooking appliance of the first embodiment and the sixth embodiment, so that the detailed description thereof is omitted and the description of the first embodiment and the sixth embodiment is applied.

In the induction cooking appliance of the eighteenth embodiment, the four heating regions 12*a*, 12*b*, 12*c*, 12*d* are formed in the top plate 4 (refer to FIG. 8), and coil units 8*a*, 8*b*, 8*c*, 8*d* are respectively arranged immediately below each heating region 12*a*, 12*b*, 12*c*, 12*d* in correspondence with each heating region 12*a*, 12*b*, 12*c*, 12*d*.

In the internal configuration of the induction cooking appliance shown in FIG. 21, the control circuit 15*a*, 15*b* is roughly divided to the left side region and the right side region. The two sets of coil units 8*a*, 8*b* at the front and the back corresponding to the two heating regions 12*a*, 12*b* on the left side are controlled with the control circuit 15*a* of the left side region, and the two sets of coil units 8*c*, 8*d* at the front and the back corresponding to the two heating regions 12*c*, 12*d* on the right side are controlled with the control circuit 15*b* of the right side.

The intake port 20 is formed at substantially the middle on the rear surface side in the bottom surface plate 22*c* of the main case 22. The suction port of the blower device 17 is formed at a position facing the intake port 20. The left and right control circuits 15*a*, 15*b* and the blower device 17 are arranged inside one sub-case 19.

The duct 18 is arranged so as to guide the cooling wind C with respect to each heat generating component 16 in the left and right control circuits 15*a*, 15*b* from the blower device 17. In the heat generating component 16 in the control circuit 15*a*, 15*b*, in particular, the switching element (IGBT) 27 having a large amount of heat generation is joined to the heat sink 28 to further enhance the cooling performance and is arranged on the central side to further enhance the cooling performance. As shown in FIG. 21, the switching element 27 joined to the heat sink 28 in each left and right control circuit 15*a*, 15*b* are both arranged on the central side, and are arranged at positions relatively close from the blowing port 24 of the blower device 17. In the configuration of the eighteenth embodiment, the left and right control circuits 15*a*, 15*b* are symmetrically arranged with respect to the center line X in which the center axis in the induction cooking appliance is the front and back direction.

Therefore, the arrangement of the heat generating component 16 such as the switching element (IGBT) 27 and the resonance capacitor 29 in the control circuit 15*a*, 15*b* is substantially symmetric with respect to the center line X.

In the configuration of the eighteenth embodiment, the center of the blowing port 24 of the blower device 17 is arranged on the center line X, and the duct 18 continuing to the blowing port 24 of the blower device 17 is arranged symmetric with respect to the center line X. Furthermore, two branched plates 30 are arranged substantially symmetric with respect to the center line X on the inner side of the duct 18, and the duct 18 and the branched plate 30 are arranged such that the cooling wind C from the blower device 17 highly efficiently contacts the switching element 27 joined to the heat sink 28 in the left and right control circuits 15*a*, 15*b*.

As shown in FIG. 21, in the induction cooking appliance of the eighteenth embodiment, the cooling wind C from the blower device 17 arranged at substantially the middle on the rear surface side is guided to the duct 18 to cool the heat generating components 16 and the like and flow into the first exhaust flow path 32. The cooling wind C that reached the first exhaust flow path 32 is divided to the left and the right and then flowed, and exhausted from the left and right exhaust ports 21*a*, 21*b*. The exhaust port 21*a* on the left side is formed on the near side of the left side surface wall 22*b* of the main case 22, and the exhaust port 21*b* on the right side is formed on the near side of the right side surface wall 22*e* of the main case 22.

A plurality of flow path guiding plates 31*e*, 31*f* are arranged in a region where the flow of the cooling wind C is bent substantially 90 degrees when the cooling wind C flows into the first exhaust flow path 32 from the interior of the sub-case 19. The flow path guiding plates 31*e*, 31*f* are arranged inclined by substantially 45 degrees with respect to the direction of the flow from the rear surface side to the near side of the induction cooking appliance, so that the cooling wind C from the sub-case 19 is smoothly bent substantially 90 degrees to flow through the first exhaust flow path 32. The plurality of flow path guiding plates 31*e*, 31*f* are arranged at the open portion of the front surface wall 19*a* of the sub-case 19, where the flow path guiding plate 31*e* of the left side region and the flow path guiding plate 31*f* of the right side region are inclined in different directions. The flow path guiding plate 31*e* of the left side region is inclined to flow the cooling wind C that cooled the control circuit 15*a* on the left side in the sub-case 19 to the exhaust port 21*a* in the left side. The flow path guiding plate 31*f* of the right side region is inclined to flow the cooling wind C that cooled the control circuit 15*b* on the right side in the sub-case 19 to the exhaust port 21*b* in the right side.

Furthermore, in the first exhaust flow path 32, the flow path guiding plate 31*g* is arranged at a corner portion on the near side of the left side configured by the front surface wall 22*a* and the left side surface wall 22*b* of the main case 22. The flow path guiding plate 31*g* is arranged inclined so that the cooling wind C of the first exhaust flow path 32 is smoothly exhausted from the exhaust port 21*a* on the left side without the cooling wind C flowing to the corner portion of the front surface wall 22*a* and the left side surface wall 22*b* of the main case 22. Similarly, in the first exhaust flow path 32, a flow path guiding plate 31*h* is arranged at a corner portion on the near side of the right side configured by the front surface wall 22*a* and the right side surface wall 22*e* of the main case 22. The flow path guiding plate 31*h* is arranged inclined so that the cooling wind C of the first exhaust flow path 32 is smoothly exhausted from the exhaust port 21*b* on the right side without the cooling wind C flowing to the corner portion of the front surface wall 22*a* and the right side surface wall 22*e* of the main case 22.

In the induction cooking appliance of the eighteenth embodiment, the front surface wall 22*a* of the main case 22 is arranged in the wind direction of the cooling wind C sent from the blower device 17 arranged on the rear surface side to the control circuit 15*a*, 15*b*. The first exhaust flow path 32 is configured by the front surface wall 22*a*. The intake port 20 is arranged at substantially the middle on the rear surface side in the bottom surface plate 22*c* of the main case 22, and the exhaust ports 21*a*, 21*b* are arranged on the left side surface wall 22*b* and the right side surface wall 22*e* of the main case 22. In the configuration of the eighteenth embodiment, the front surface wall 22*a* of the main case 22 corresponds to the first side surface wall.

The operation in the induction cooking appliance of the eighteenth embodiment configured as above will now be described.

In the induction cooking appliance of the eighteenth embodiment, the cooling wind C from the blower device 17 arranged on the rear surface side at substantially the middle is guided by the duct 18 to cool each heat generating component 16 of the control circuit 15*a*, 15*b*, and is passed through the opening of the front surface wall 19*a* of the sub-case 19 to flow to the first exhaust passage 32.

A plurality of flow path viding plates 31*e*, 31*f* inclined with respect to the flowing direction of the cooling wind C in the sub-case 19 is arranged at the opening of the front surface wall 19*a* of the sub-case 19. At the opening of the front surface wall 19*a* of the sub-case 19, the flow path guiding plate 31*e* on the left side arranged in the left region from substantially the middle is arranged inclined by substantially 45 degrees to the left with respect to the flowing direction from the rear surface side to the near side in the sub-case 19 so that the cooling wind C from the sub-case 19 flows in the left direction through the first exhaust flow path 32.

On the other hand, the flow path guiding plate 31*f* on the right side arranged in the right region from substantially the middle at the opening of the front surface wall 19*a* is arranged inclined by substantially 45 degrees to the right with respect to the flowing direction from the rear surface side to the near side in the sub-case 19 so that the cooling wind C from the sub-case 19 flows in the right direction through the first exhaust flow path 32. The branched position of the flow path guiding plate 31*e* on the left side and the flow path guiding plate 31*f* on the right side is on substantially the extended line of the center line X in which the center axis in the induction cooking appliance is the front and back direction.

Since the plurality of flow path guiding plates 31*e*, 31*f* are arranged at the opening of the front surface wall 19*a* of the sub-case 19 as described above, the cooling wind C exhausted from the opening of the front surface wall 19*a* of the sub-case 19 is smoothly divided to the left and the right, and flowed through the first exhaust flow path 32.

In the configuration of the eighteenth embodiment, since the inclined flow path guiding plates 31*e*, 31*g* are arranged at both end portions of the first exhaust flow path 32, the cooling wind C flowing to the left and the right through the first exhaust flow path 32 can be smoothly exhausted from the left and right exhaust ports 21*a*, 21*b*.

The cooling wind C flowing to the left and the right through the first exhaust flow path 32 has the flow vector towards the left direction or the right direction as the main stream. Thus, even if brought into contact with the inner wall surface of the kitchen cabinet 2 facing the exhaust ports 21*a*, 21*b*, the cooling wind C becomes a flow in the direction (backward) of the rear surface side by simply being further bent 90 degrees, and is flowed while maintaining the flow speed of a certain extent. As a result, the induction cooking appliance of the eighteenth embodiment has a configuration in which the cooling wind C discharged from the exhaust ports 21*a*, 21*b* is less likely to be taken in again from the intake port 20 at the central portion of the main case 22, and has a high cooling performance.

In the induction cooking appliance of the eighteenth embodiment, the cooling wind C exhausted from the exhaust ports 21*a*, 21*b* is flowed to the air vent 23 formed on the rear surface side of the kitchen cabinet 2, and thus the induction cooking appliance of the eighteenth embodiment has a configuration in which the air exhausted from the exhaust ports 21*a*, 21*b* and become high temperature is less likely to be taken in again from the intake port 20.

In the induction cooking appliance of the eighteenth embodiment, the two control circuits 15*a*, 15*b* each including the heat generating component 16 are arranged on the left and the right in one sub-case 19. In this configuration, the heat generating components 16 are collected to the central side of the sub-case 19, and cooled using the cooling wind C taken in from one intake port 20 by one blower device 17. Therefore, in the configuration of the eighteenth embodiment, the distance between the exhaust ports 21*a*, 21*b* respectively arranged on the left side surface wall 22*b* and the right side surface wall 22*e* and the intake port 20 becomes long and the air exhausted from the exhaust ports 21*a*, 21*b* is less likely to be taken in again from the intake port 20, compared to the configuration in which two control circuits are arranged in each of the two sub-cases and the intake port and the blower device 17 corresponding to such intake port are arranged in the respective sub-case.

In the configuration of the induction cooking appliance of the eighteenth embodiment, the space can be saved since the blower device 17 can be collected to one. As the blower device 17 can be collected to one, the intake port 20 can be designed large, and the blower device 17 of large diameter can be adopted. As a result, the amount of cooling wind can be increased and the cooling performance can be enhanced in the induction cooking appliance of the eighteenth embodiment.

In the induction cooking appliance of the eighteenth embodiment, a configuration in which a total of four heating regions 12*a*, 12*b*, 12*c*, 12*d*, two in the left side region and two in the right side region, is arranged has been described, but the number of heating regions is not limited to the number in the eighteenth embodiment, and three heating regions may be arranged. In such a case, three heating regions may be arranged as a whole with either one of the left or right region as one heating region, or two may be arranged in the region on the near side of the top plate 4 and one may be arranged at substantially the middle in the region on the rear surface side so as to be substantially symmetric with respect to the center line X in which the center axis direction in the induction cooking appliance becomes the front and back direction.

In the induction cooking appliance of the present invention, five or more heating regions may be arranged by further adding the control circuit and the like.

Nineteenth Embodiment

Figure 22:
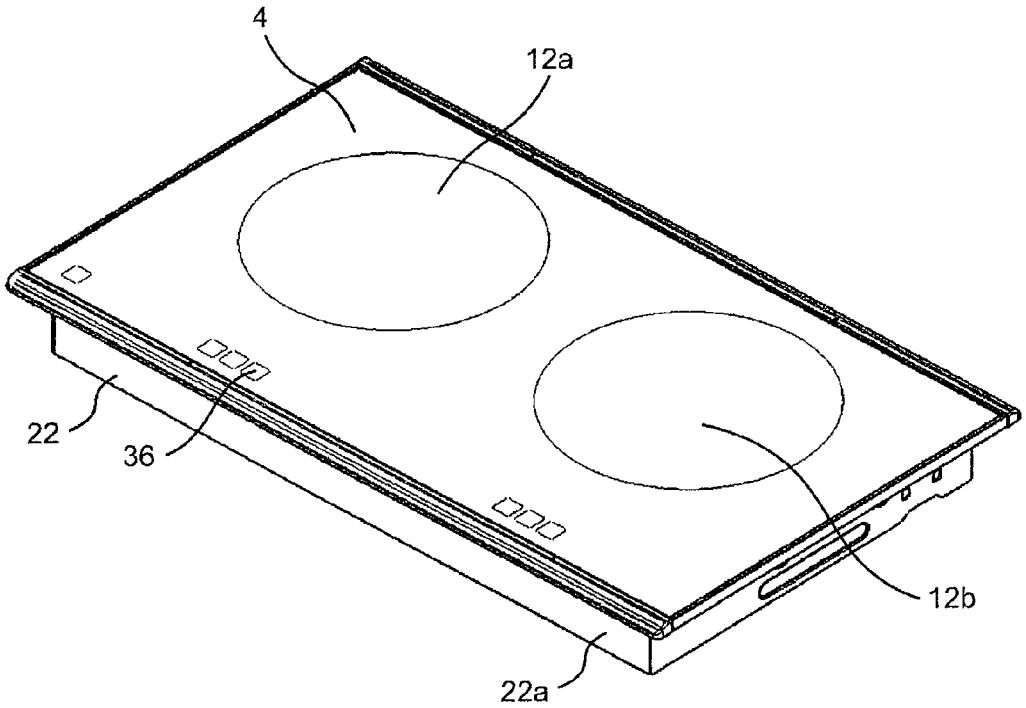
FIG. 22 is a perspective view showing an entire induction cooking appliance of a nineteenth embodiment according to the present invention.
Figure 23:
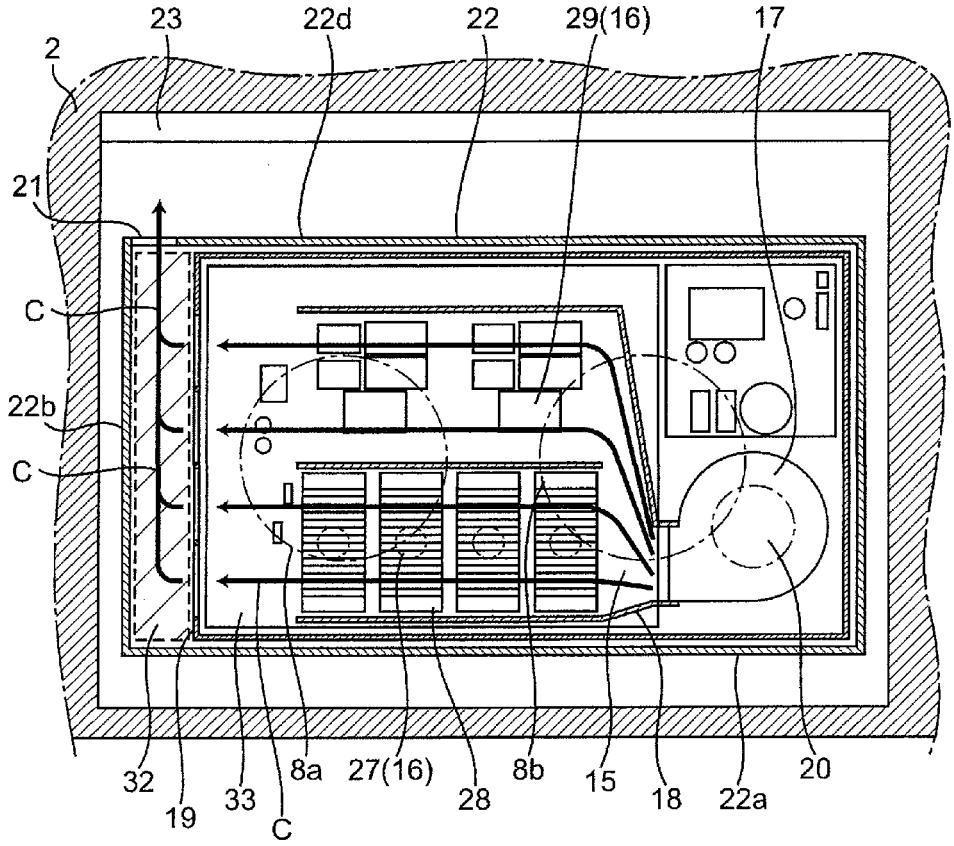
FIG. 23 is a horizontal cross-sectional view showing an internal configuration of the induction cooking appliance of the nineteenth embodiment according to the present invention.

An induction cooking appliance according to a nineteenth embodiment of the present invention will be hereinafter described with reference to the accompanied drawings. FIG. 22 is a perspective view showing an outer appearance configuration of the induction cooking appliance of the nineteenth embodiment according to the present invention. FIG. 23 is a horizontal cross-sectional view showing an internal configuration of the induction cooking appliance according to the nineteenth embodiment. In the induction cooking appliance of the nineteenth embodiment, the two heating regions 12*a*, 12*b* are arranged in one row horizontally, as shown in FIG. 22. In the following description of the nineteenth embodiment, the same reference numerals are denoted on the configuring elements having the same functions and configurations as the configuring elements in the induction cooking appliance of the first embodiment, so that the detailed description thereof is omitted and the description of the first embodiment is applied.

In FIG. 22, two heating regions 12*a* (left side), 12*b* (right side) are arranged to be lined on the left and the right in the top plate 4, and two coil units 8*a* (left side), 8*b* (right side) are arranged in correspondence with the respective heating regions 12*a*, 12*b*.

In the induction cooking appliance of the nineteenth embodiment, the exhaust port 21 is formed at the left end in the rear surface wall 22*d* of the main case 22, as shown in FIG. 23. In other words, the exhaust port 21 is arranged in the flow path direction (direction of rear surface side in FIG. 23) in the first exhaust flow path 32 to communicate with the first exhaust flow path 32.

The intake port 20 to the sub-case 19 and the exhaust port 21 of the main case 22 are opened to the interior of the kitchen cabinet 2. The intake port 20 is formed in the right side region in the bottom surface plate 22*c* of the main case 22, and the exhaust port 21 is formed at the left side end in the rear surface wall 22*d* of the main case 22.

As described above, in the nineteenth embodiment, the control circuit 15 is arranged on the left side than the intake port 20, and the cooling wind C from the blower device 17 flows from the right to the left to cool the control circuit 15. A gap is formed between the sub-case 19 and the left side surface wall 22*b* of the main case 22, which gap is the first exhaust flow path 32. The cooling wind C from the induction heating block 33 flows into the first exhaust flow path 32, and flows through the first exhaust flow path 32 to be exhausted from the exhaust port 21.

The air vent for communicating the interior and the exterior of the kitchen cabinet 2 to carry out the ventilation is arranged on the rear surface side in the kitchen cabinet 2 in which the induction cooking appliance is incorporated.

In the nineteenth embodiment, the left side surface wall 22*b* of the main case 22 is arranged in the wind direction of the cooling wind C sent from the blower device 17 to the control circuit 15. The first exhaust flow path 32 is configured by the left side surface wall 22*b*. The intake port 20 is formed in the right side region in the bottom surface plate 22*c* of the main case 22, and the exhaust port 21 is formed in the rear surface wall 22*d* of the main case 22. In the configuration of the nineteenth embodiment, the left side surface wall 22*b* of the main case 22 corresponds to the first side surface wall.

The operation in the induction cooking appliance of the nineteenth embodiment configured as above will now be described.

In the induction heating block 33, the cooling wind C taken in from the intake port 20 by the blower device 17 is blown out in the left direction from the blower device 17 to cool the control circuit 15. The cooling wind C blown out in the left direction from the blower device 17 is guided by the duct 18 to cool each heat generating component 16 of the control circuit 15. The cooling wind C that cooled each heat generating component 16 is flowed towards the left direction as is, and flowed from the first sub-case 19 to the first exhaust flow path 32.

In the first exhaust flow path 32, the cooling wind C from the sub-case 19 makes contact with the left side surface wall 22*b* of the main case 22, and the flow of the cooling wind C is bent substantially 90 degrees. As the end on the near side in the first exhaust flow path 32 is closed, the cooling wind C is flowed through the first exhaust flow path 32 in the direction of the rear surface side, and discharged from the exhaust port 21 formed in the rear surface wall 22*d* of the main case 22.

The cooling wind C discharged from the exhaust port 21 is flowed in the direction of the rear surface side in the first exhaust flow path 32, and thus becomes a flow in which the flow vector in the direction to the rear surface side is a main stream. Thus, the wind grows to a flow speed of a certain extent when discharged from the exhaust port 21, and becomes an exhaust air in which the flowing direction is clearly defined as the direction (backward) in the rear surface side of the kitchen cabinet 2. The exhausting direction is the direction of moving away from the intake port, and thus the cooling wind C discharged from the exhaust port 21 is less likely to be taken in again from the intake port 20, and the cooling performance of the induction cooking appliance can be enhanced.

In the configuration of the induction cooking appliance of the nineteenth embodiment, the heating regions 12*a*, 12*b* are arranged on the left and the right, so that the intake port 20 and the exhaust port 21 are formed greatly separated in the right side region and the left side region of the main case 22. As a result, the induction cooking appliance of the nineteenth embodiment has a configuration in which the high temperature air discharged from the exhaust port 21 is more unlikely to be taken in again from the intake port 20.

In the nineteenth embodiment, a configuration in which the intake port 20 is formed in the right side region and the exhaust port 21 is formed in the left side region has been described, but is not limited to such configuration and the left and the right may be reversed.

An example in which the air vent 23 of the kitchen cabinet 2 is formed on the rear surface side has been described, but the exhaust port 21 of the induction cooking appliance may be formed in the front surface wall 22*a* of the main case 22 so as to correspond to a case in which the air vent is on the near side of the kitchen cabinet 2.

Furthermore, the exhaust port 21 may be formed in the rear surface wall 22*d* and the front surface wall 22*a* of the main case 22, and the shielding plate for shielding either one of the exhaust port 21 may attached from the outer surface of the main case 22.

According to such configuration, the exhaust port 21 formed in the front surface wall 22*a* of the main case 22 is shielded if the air vent 23 is arranged on the rear surface side of the kitchen cabinet 2 when installing the induction cooking appliance in the kitchen cabinet 2. On the contrary, if the air vent 23 is arranged on the near side of the kitchen cabinet 2, the exhaust port 21 formed in the rear surface wall 22*d* of the main case 22 is shielded. If the air vent 23 is formed on both the near side and the rear surface side of the kitchen cabinet 22, both exhaust ports 21 are opened. Therefore, the configuration in which the exhaust port 21 is formed in the rear surface wall 22*d* and the front surface wall 22*a* of the main case 22 can be installed with respect to the kitchen cabinet 2 having various ventilation configurations, and a highly versatile induction cooking appliance can be obtained.

The shielding plate may be fixed at a plurality of different positions so that the opening area and the opening position of the exhaust port 21 can be adjusted. The flow rate of the cooling wind C discharged from the respective exhaust port 21 can be adjusted by configuring so that the opening area and the opening position of the exhaust port 21 can be adjusted. Therefore, the air vent 23 may be provided on both the near side and the rear surface side of the kitchen cabinet 2, and the exhausting that complies with the respective air vent 23 may be realized even if the respective opening area differs. Furthermore, the induction cooking appliance of such configuration has higher versatility with respect to the kitchen cabinet 2 to which it can be installed.

In the configuration of the induction cooking appliance of the nineteenth embodiment shown in FIG. 23, an example in which the air vent 23 for carrying out the ventilation of the interior and the exterior of the kitchen cabinet 2 is arranged only on the rear surface side of the kitchen cabinet 2 has been described, but is not limited to such configuration described above. For instance, the air vent 23 may be provided on the rear surface side and the near side of the kitchen cabinet 2. In the case of such configuration, the outside air taken in from the air vent 23 on the near side of the kitchen cabinet 2 is taken in by the intake port 20, and discharged from the exhaust port 21 on the rear surface side after cooling the control circuit 15. The cooling wind C discharged in this case is exhausted from the air vent 23 on the rear surface side of the kitchen cabinet 2. The flow of air described above can be realized inside the kitchen cabinet 2, and the rise in the temperature of the intake air can be suppressed to a minimum.

Twentieth Embodiment

Figure 24:
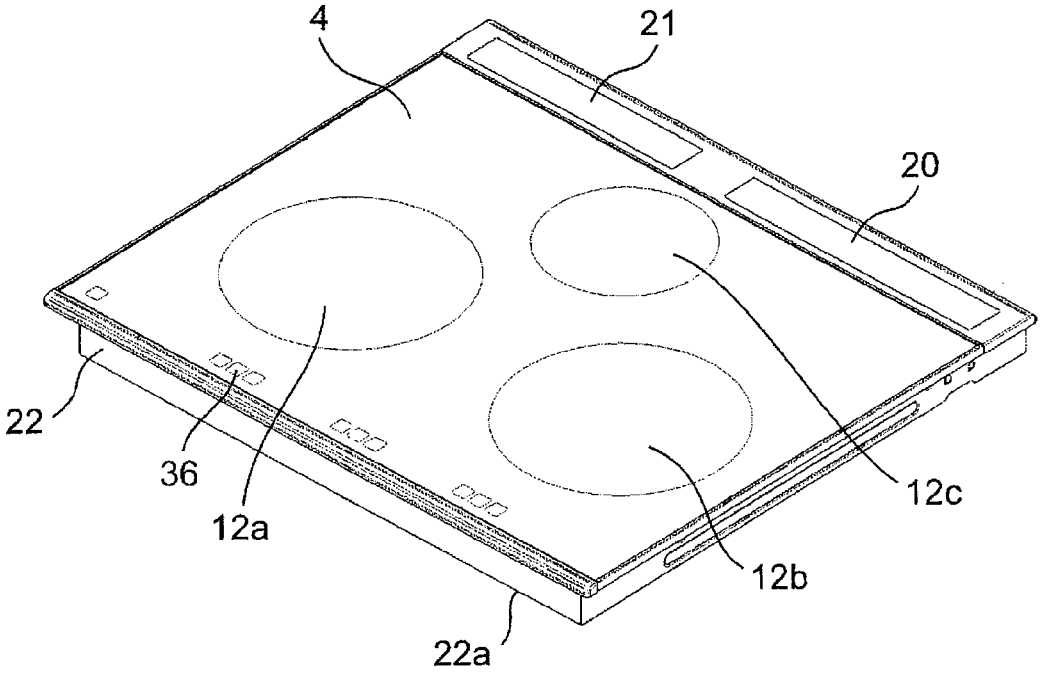
FIG. 24 is a perspective view showing an entire induction cooking appliance of a twentieth embodiment according to the present invention.
Figure 25:
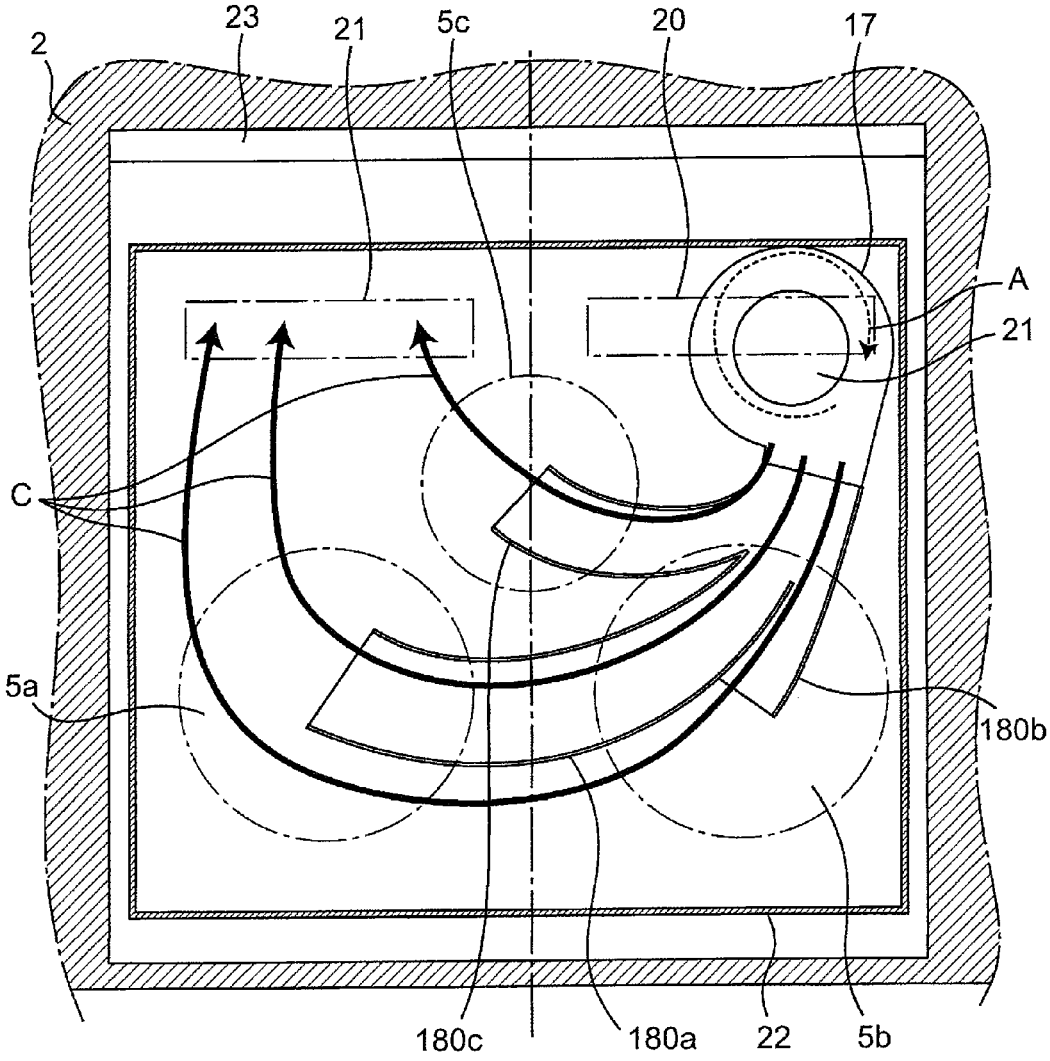
FIG. 25 is a horizontal cross-sectional view showing a duct configuration inside the induction cooking appliance of the twentieth embodiment according to the present invention.
Figure 26:
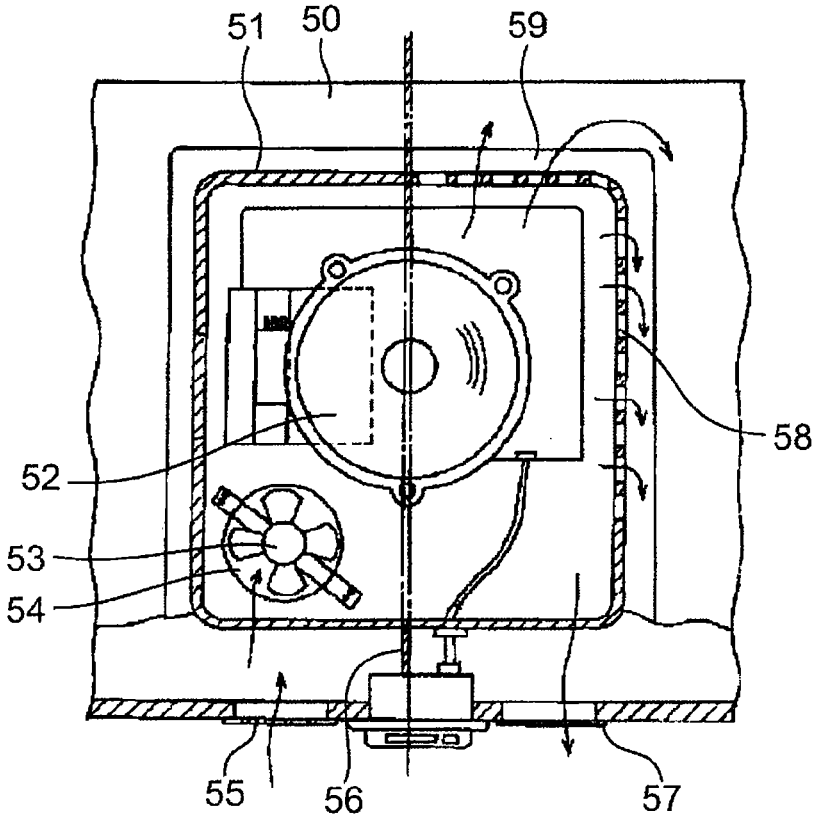
Fig.26 Prior Art
FIG. 26 is the plan view showing the internal configuration of the conventional built-in type induction cooking appliance.

An induction cooking appliance of a twentieth embodiment according to the present invention will be hereinafter described with reference to the accompanied drawings. FIG. 24 is a perspective view showing an outer appearance configuration of the induction cooking appliance of the twentieth embodiment according to the present invention. FIG. 25 is a horizontal cross-sectional view showing a blower device, a duct, and the like in the induction cooking appliance of the twentieth embodiment according to the present invention. In the following description of the twentieth embodiment, the same reference numerals are denoted on the configuring elements having the same functions and configurations as the configuring elements in the induction cooking appliance of the first embodiment, so that the detailed description thereof is omitted and the description of the first embodiment is applied.

As shown in FIG. 24, in the induction cooking appliance of the twentieth embodiment, three heating regions 12*a* (left side on near side), 12*b* (right side on near side), and 12*c* (middle on rear surface side) are arranged in the top plate 4. The two heating regions 12*a*, 12*b* on the near side in the top plate 4 are arranged side by side on the left and right. Similar to each embodiment described above, three coil units 8 (refer to FIG. 2) are arranged in correspondence with the respective heating regions 12*a*, 12*b*, 12*c*.

The heating coils 5*a*, 5*b*, 5*c* (shown with circular broken line in FIG. 25) for inductively heating the cooking container 3 of the to-be-heated object are arranged at the lower part of the top plate 4 in correspondence with the heating regions 12*a*, 12*b*, 12*c* formed in the top plate 4. The control circuit 15 for controlling the output of the respective heating coils 5*a*, 5*b*, 5*c* is arranged on the lower side of the heating coils 5*a*, 5*b*, 5*c*.

In the induction cooking appliance of the twentieth embodiment, a sirocco fan is arranged for the blower device 17 for cooling the heating coils 5*a*, 5*b*, 5*c*, the control circuit 15, and the like. The blower device 17 is arranged such that the rotation shaft is in the vertical direction on the rear surface side of the right side region of the main case 22. The rotating direction of the blower device 17 is the clockwise direction when seen from the vertically upward direction, as shown with an arrow A in FIG. 25.

In the induction cooking appliance of the twentieth embodiment, the intake port 20 and the exhaust port 21 are arranged on the rear surface side of the top plate 4, which is the upper surface in the induction cooking appliance. As shown in FIG. 24, the intake port 20 is on the right side of the upper surface, and the exhaust port 21 is on the left side. In the twentieth embodiment, the inlet port of the blower device 17 is arranged immediately below the intake port 20 so that the air from the outside is smoothly taken in. In the twentieth embodiment, an example in which the intake port 20 and the exhaust port 21 are arranged at the upper surface of the induction cooking appliance has been described, but may be formed in the side surface wall or the bottom surface plate of the main case 22 as in the other embodiments.

In the induction cooking appliance of the twentieth embodiment, the cooling wind C from the blower device 17 is guided so as to be divided to top and bottom to cool both the heating coils 5*a*, 5*b*, 5*c* arranged in the upper side region in the internal space of the main case 22 and the control circuit 15 arranged in the lower side region in the internal space of the main case 22.

The cooling of the heat generating component 16 in the control circuit 15 arranged in the lower side region of the main case 22 is carried out using the duct 18 (for example, refer to FIG. 3) and the exhaust flow path configuration described in each embodiment above. In other words, the cooling wind C from the blower device 17 is flowed to the control circuit 15 using the duct 18 to cool the heat generating component 16. Thereafter, the cooling wind C is exhausted from the exhaust port 21 though the exhaust flow path formed in the side surface wall, for example, the left side surface wall 22*b* of the main case 22.

Ducts 180*a*, 180*b*, 180*c* for cooling the three heating coils 5*a*, 5*b*, 5*c*, etc. arranged in the upper side region of the main case 22 are arranged. In other words, as shown in FIG. 25, the ducts 180*a*, 180*b*, 180*c* extending from the blowing port 24 of the blower device 17 to substantially the center position of each heating coil 5*a*, 5*b*, 4*c* are arranged so that the cooling wind C from the blower device 17 is directed to the respective heating coil 5*a*, 5*b*, 5*c*.

The operation in the induction cooking appliance of the twentieth embodiment configured as above will now be described.

The cooling wind C blown out from the blower device 17 is guided to the control circuit 15 and the heating coils 5*a*, 5*b*, 4*c* by the ducts 18, 180*a*, 180*b*, 180*c*, and discharged to outside of the induction cooking appliance by the exhaust port 21 after cooling the control circuit 15 and the heating coils 5*a*, 5*b*, 5*c*.

In the induction cooking appliance of the twentieth embodiment, the flow path in which the cooling wind C taken in from the intake port 20 cools the control circuit 15 and the heating coils 5*a*, 5*b*, 5*c*, and reaches the exhaust port 21 is bent in the clockwise direction by substantially 180 degrees when seen from the vertically upward direction. Therefore, in the flow path, the pressure loss occurs, the number of rotations of the blower device 17 lowers, the flow rate of the cooling wind C reduces, and the cooling performance lowers.

However, in the twentieth embodiment, the sirocco fan is used for the blower device 17, where the flow of the cooling wind C blown out from the sirocco fan includes the flow vector component in the clockwise direction or the rotating direction of the sirocco fan. Thus, the flow path that bends in the clockwise direction from the intake port 20 to the exhaust port 21 is the same rotating direction as the flow vector of the cooling wind C blown out from the sirocco fan. Therefore, even in the flow path configuration in which the flow is greatly bent at substantially 180 degrees as in the twentieth embodiment, the disturbance of the flow is less likely to occur in the flow path, the pressure loss of the entire flow path is reduced, and the reduction of the flow rate of the cooling wind can be suppressed.

In the induction cooking appliance of the twentieth embodiment, the noise generated by the disturbance of the flow in the flow path is reduced since the disturbance of the flow in the cooling wind C is reduced.

In the induction cooking appliance of the twentieth embodiment, a configuration in which the heating coil and the control circuit are both cooled with one blower device 17 has been described, but is not limited to such configuration. For instance, the blower device for cooling the heating coil and the blower device for cooling the control circuit may be arranged, or the main case 22 may be divided to left and right regions, or the left half and the right half, and the blower device may be arranged in each region. Thus, the flow path of the cooling wind C can be simplified and the pressure loss in the flow path can be reduced by cooling using a plurality of blower devices.

In the induction cooking appliance of the twentieth embodiment, the ducts 180*a*, 180*b*, 180*c* are formed from the blowing port 24 of the blower device 17 to each heating coil 5*a*, 5*b*, 5*c*, and the cooling wind C guided to the respective heating coils 5*a*, 5*b*, 5*c* is led to the exhaust port 21 along such flow. However, this is not the sole configuration, and the flow path guiding plate may be arranged to smoothly guide the cooling wind C after cooling heating coils 5*a*, 5*b*, 5*c* to the exhaust port 21.

In the induction cooking appliance of the present invention, a configuration in which the exhausted air is less likely to be taken in again even if there is an obstacle facing the exhaust port of the induction cooking appliance when incorporated in the kitchen cabinet or when installed near other devices is adopted. As a result, with the configuration in which the exhausted high temperature air is less likely to be taken in, the rise in temperature of the intake air can be reduced, and each component in the induction cooking appliance can be reliably cooled. In the induction cooking appliance of the present invention, the damage caused by the high temperature of the cooling wind with respect to each component is prevented, and a highly reliable cooking instrument can be provided.

In the present invention, installation can be made without using a special member such as a shielding plate even when installing the induction cooking appliance with respect to the kitchen cabinet in which the ventilation of the intake and exhaust air is carried out at the backward position. The use of the induction cooking appliance of the present invention is a reassurance to the user, and a satisfactory cooking can be carried out without feeling a sense of unpleasantness from the exhaust air.

In the induction cooking appliance of the present invention, the air discharged from the exhaust port is less likely to be taken in again from the intake port and the temperature rise of the cooling wind is suppressed even if there is an obstacle facing the exhaust port of the induction cooking appliance when incorporated in the kitchen cabinet or when installed near other devices. According to the present invention, the degradation in the reliability due to the temperature with respect to each component in the induction cooking appliance can be suppressed, and a highly reliable induction cooking appliance can be provided. In the present invention, installation can be made without using a special member such as a separation plate even when installing the induction cooking appliance to various types of kitchen cabinets in which the ventilation of the intake and exhaust air is carried out at the backward position. According to the present invention, the induction cooking appliance that is a reassurance to the user, and that enables a satisfactory cooking to be carried out without feeling a sense of unpleasantness from the exhaust air can be provided.

INDUSTRIAL APPLICABILITY

The induction cooking appliance of the present invention has excellent cooling performance, has a cooling structure satisfactory to the user, and realizes an induction cooking appliance with high design ability, less failure and high reliability in a space saving manner. Therefore, not limited to the induction cooking appliance in a form of incorporating in the kitchen cabinet, application can be made to various types of induction cooking appliances such as a mounting type induction cooking appliance, a built-in type induction cooking appliance of being incorporated in the kitchen table, and a small table installing type induction cooking appliance, and high versatility is realized.

The invention claimed is:

1. An induction cooking appliance comprising:

a heating coil arranged below a top plate for mounting a to-be-heated object so as to inductively heat the to-be-heated object;

a control circuit that includes a heat generating component for generating and controlling a high frequency current to supply to the heating coil;

a blower device for drawing air from an intake port and for directing a cooling wind over the control circuit; and a main case that includes a plurality of side surface walls and a bottom surface plate, wherein the heating coil, the control circuit, and the blower device are arranged within the main case, wherein a first side surface wall of the plurality of side surface walls is arranged perpendicular to a direction in which the cooling wind flows over the control circuit to thereby cause the direction of the cooling wind to change so as to flow along the first side surface and towards an exhaust port arranged below the top plate on a portion of the main case other than the first side surface wall so that substantially all the cooling wind flows in a direction different from the direction in which the cooling wind flows over the control circuit as the cooling wind exits the main case.

2. The induction cooking appliance according to claim 1, wherein the plurality of side surface walls include a second side surface wall that extends perpendicularly from the first side surface wall to thereby change the direction of the cooling wind so that the cooling wind flows in a direction opposite to the direction in which the cooling wing flows over the control circuit as the cooling wind exits the main case.

3. The induction cooking appliance according to claim 1, wherein the exhaust port is formed in a side surface wall that is connected to the first side surface wall via a bent portion.

4. The induction cooking appliance according to claim 1, wherein a sub-case having an upper side opened is accommodated in an internal space of the main case, the control circuit and the blower device being arranged inside the sub-case; and a first exhaust flow path is formed between the first side surface wall and a side surface wall of the sub-case facing the first side surface wall, and is formed inside the internal space so that the cooling wind after cooling the control circuit contacts the side surface wall and flows in a constant direction through the first exhaust flow path.

5. The induction cooking appliance according to claim 4, wherein a second exhaust flow path that is orthogonal with the first exhaust flow path is in communication with the first exhaust flow path so as to discharge from the exhaust port that is formed in an internal space of the main case.

6. The induction cooking appliance according to claim 4, wherein an operation portion is arranged on a front surface side in the of the main case; and the first exhaust flow path is arranged on a lower side of the operation portion.

7. The induction cooking appliance according to claim 4, wherein a coil base for holding the heating coil and a radiator plate for mounting the coil base are arranged above the sub-case in the internal space of the main case, one part of an upper surface in a flow path, through which the cooling wind from the blower device passes to cool the control circuit, being configured by the radiator plate.

8. The induction cooking appliance according to claim 4, wherein a flow path guiding plate having a surface inclined in a flowing direction of the cooling wind for cooling the control circuit is arranged at an opening of the sub-case so that the cooling wind flows along the first exhaust flow path when the cooling wind after cooling the control circuit passes through an opening formed in a side surface wall of the sub-case to flow to the first exhaust flow path.

9. The induction cooking appliance according to claim 4, wherein in the internal space of the main case, the exhaust port is formed at a position symmetric with respect to a center line in which a center axis is a front and back direction, one part of the cooling wind guided to the first exhaust flow path after cooling the control circuit is discharged from one exhaust port, and the remaining cooling wind is discharged from the other exhaust port.

10. The induction cooking appliance according to claim 9, wherein the main case includes a second side surface wall and a third side surface wall connected to the first side surface wall via a bent portion; and the cooling wind that flows along the first exhaust flow path configured by the first side surface wall flows along a second exhaust flow path configured by the second side surface wall and a third exhaust flow path configured by the third side surface wall to be exhausted from a first exhaust port communicating to the second exhaust flow path and a second exhaust port communicating to the third exhaust flow path.

11. The induction cooking appliance according to claim 1, wherein the first side surface wall includes a vent hole, wherein a portion of the cooling wind, after cooling the control circuit, is discharged from the vent hole.

12. The induction cooking appliance according to claim 1, wherein an induction heating block including the heating coil, the control circuit, and the blower device is arranged in plurals below the top plate;

a flowing direction of a cooling wind for cooling the respective control circuit is the same in the respective induction heating block, and the induction heating blocks are arranged side by side inside the main case so that the cooling wind after cooling the respective control circuit contacts the first side surface wall; and the cooling wind that contacts the first side surface wall flows along the first side surface wall so as to be exhausted from the exhaust port.

13. The induction cooking appliance according to claim 12, wherein the main case includes a second side surface wall connected to the first side surface wall such that a discharging direction of the cooling wind from the exhaust port flows in a direction of regressing a flowing direction of the cooling wind for cooling the control circuit in the respective induction heating block, and the cooling wind that flows along the first side surface wall flows in a constant direction along the second side surface wall.

14. The induction cooking appliance according to claim 13, wherein each of the induction heating block is accommodated in a plurality of sub-cases having the upper side opened in an internal space of the main case;

a flowing direction of the cooling wind flowing along the first side surface wall is parallel to an arranged direction of the plurality of sub-cases arranged side by side; and a flowing direction the of cooling wind flowing along the second side surface wall is orthogonal to the arranged direction of the plurality of sub-cases arranged side by side.

15. The induction cooking appliance according to claim 12, wherein the cooling wind that flows along the first side surface wall flows through an exhaust flow path formed in a space between the plurality of induction heating blocks arranged side by side so as to be discharged from the exhaust port.

16. The induction cooking appliance according to claim 14, wherein the cooling wind that flows along the first side surface wall flows through an exhaust flow path formed in both spaces between the induction heating blocks on both sides of the plurality of induction heating blocks arranged side by side and the main case so as to be discharged from two exhaust ports.

17. The induction cooking appliance according to claim 16, wherein an exhaust port is formed at a position symmetric with respect to a center line in which a center axis is a front and back direction in the internal space of the main case, an internal configuration of the induction heating block in the respective sub-case being arranged to be symmetric with respect to the center line.

18. The induction cooking appliance according to claim 12, wherein in the main case, the exhaust flow path through which the cooling wind discharged from the respective induction heating block is divided by a partition plate, and the cooling wind discharged from the respective induction heating block is flowed through an individual exhaust flow path so as to be discharged from a respective exhaust port.

19. The induction cooking appliance according to claim 12, wherein a flowing direction of the cooling wind flowing along the first side surface wall is a direction from a front surface side to a rear surface side in the main case.

20. The induction cooking appliance according to claim 1, wherein the heat generating component is arranged in a flowing direction of the cooling wind from the blower device, and the exhaust flow path of the cooling wind after cooling the heat generating component is the same direction as a flowing direction of the cooling wind from the blower device.

* * * * *